US012553004B2

(12) United States Patent
Quanci et al.

(10) Patent No.: US 12,553,004 B2
(45) Date of Patent: Feb. 17, 2026

(54) FOUNDRY COKE PRODUCTS, AND ASSOCIATED SYSTEMS AND METHODS

(71) Applicant: SUNCOKE TECHNOLOGY AND DEVELOPMENT LLC, Lisle, IL (US)

(72) Inventors: John Francis Quanci, Haddonfield, NJ (US); Jonathan Perkins, Lisle, IL (US)

(73) Assignee: SUNCOKE TECHNOLOGY AND DEVELOPMENT LLC, Lisle, IL (US)

( * ) Notice: Subject to any disclaimer, the term of this patent is extended or adjusted under 35 U.S.C. 154(b) by 440 days.

(21) Appl. No.: 17/736,960

(22) Filed: May 4, 2022

(65) Prior Publication Data

US 2022/0356410 A1 Nov. 10, 2022

Related U.S. Application Data

(60) Provisional application No. 63/184,016, filed on May 4, 2021.

(51) Int. Cl.

| | |
|---|---|
| ***C10L 5/36*** | (2006.01) |
| ***C10L 5/06*** | (2006.01) |
| ***C10L 5/28*** | (2006.01) |

(52) U.S. Cl.

CPC ..... *C10L 5/361* (2013.01); *C10L 5/06* (2013.01); *C10L 5/28* (2013.01); *C10L 5/365* (2013.01); *C10L 2290/02* (2013.01)

(58) Field of Classification Search

None

See application file for complete search history.

(56) References Cited

U.S. PATENT DOCUMENTS

| | | | |
|---|---|---|---|
| 425,797 | A | 4/1890 | Hunt |
| 469,868 | A | 3/1892 | Osbourn |
| 705,926 | A | 7/1902 | Hemingway |

(Continued)

FOREIGN PATENT DOCUMENTS

| | | |
|---|---|---|
| CA | 1172895 | 8/1984 |
| CA | 2775992 | 5/2011 |

(Continued)

OTHER PUBLICATIONS

U.S. Appl. No. 17/947,520, filed Sep. 19, 2022, Quanci et al.

(Continued)

*Primary Examiner* — Anthony M Liang

(74) *Attorney, Agent, or Firm* — Perkins Coie LLP

(57) ABSTRACT

Coke products configured to be combusted in a cupola furnace are disclosed herein. The coke products can include foundry coke products having a hydraulic diameter of at least 3.5", egg coke products having a hydraulic diameter of 1.5-3.5", and breeze coke products having a hydraulic diameter of 0.5-1.5". Individual foundry coke products can comprise an oblong shape including a length of at least 4", a width of at least 1.5", and a length:width ratio of at least 2.0. In some embodiments, the length of individual coke products can be between 6-12" and the width can be at least 2.5". Additionally, the foundry coke products can have a Coke Reactivity Index (CRI) of at least 40%. The coke products can be made from a blend of coal and breeze coke products in horizontal ovens, such as horizontal heat recovery or horizontal non-recovery ovens.

12 Claims, 23 Drawing Sheets

(56) References Cited

U.S. PATENT DOCUMENTS 760,372 A 5/1904 Beam
845,719 A 2/1907 Schniewind
875,989 A 1/1908 Garner
976,580 A 11/1910 Krause
1,140,798 A 5/1915 Carpenter
1,220,232 A 3/1917 Jackson
1,378,782 A 5/1921 Griffin
1,424,777 A 8/1922 Schondeling
1,429,346 A 9/1922 Horn
1,430,027 A 9/1922 Plantinga
1,486,401 A 3/1924 Van Ackeren
1,530,995 A 3/1925 Geiger
1,572,391 A 2/1926 Klaiber
1,676,729 A 7/1928 Erwin
1,677,973 A 7/1928 Marquard
1,705,039 A 3/1929 Thornhill
1,721,813 A 7/1929 Geipert
1,757,682 A 5/1930 Palm
1,818,370 A 8/1931 Wine
1,818,994 A 8/1931 Kreisinger
1,830,951 A 11/1931 Lovett
1,848,818 A 3/1932 Becker
1,895,202 A 1/1933 Montgomery
1,947,499 A 2/1934 Schrader et al.
1,955,962 A 4/1934 Jones
1,979,507 A 11/1934 Underwood
2,075,337 A 3/1937 Burnaugh
2,141,035 A 12/1938 Daniels
2,195,466 A 4/1940 Otto
2,235,970 A 3/1941 Wilputte
2,340,283 A 1/1944 Vladu
2,340,981 A 2/1944 Otto
2,343,034 A 2/1944 Weber
2,394,173 A 2/1946 Harris et al.
2,424,012 A 7/1947 Bangham et al.
2,486,199 A 10/1949 Nier
2,609,948 A 9/1952 Laveley
2,641,575 A 6/1953 Otto
2,649,978 A 8/1953 Smith
2,667,185 A 1/1954 Beavers
2,723,725 A 11/1955 Keiffer
2,756,842 A 7/1956 Chamberlin et al.
2,765,266 A 10/1956 Throop et al.
2,813,708 A 11/1957 Frey
2,827,424 A 3/1958 Homan
2,873,816 A 2/1959 Emil et al.
2,902,991 A 9/1959 Whitman
2,907,698 A 10/1959 Schulz
2,968,083 A 1/1961 Lentz et al.
3,010,882 A 11/1961 Barclay et al.
3,015,893 A 1/1962 McCreary
3,026,715 A 3/1962 Briggs
3,033,764 A 5/1962 Hannes
3,085,582 A 4/1963 Slosman
3,134,733 A 5/1964 Rose
3,175,961 A 3/1965 Samson
3,199,135 A 8/1965 Trucker
3,224,805 A 12/1965 Clyatt
3,259,551 A 7/1966 Thompson
3,265,044 A 8/1966 Juchtern
3,267,913 A 8/1966 Jakob
3,327,521 A 6/1967 Briggs
3,342,990 A 9/1967 Barrington et al.
3,381,355 A 5/1968 Bixby
3,444,046 A 5/1969 Harlow
3,444,047 A 5/1969 Wilde
3,448,012 A 6/1969 Allred
3,453,839 A 7/1969 Sabin
3,462,345 A 8/1969 Kernan
3,462,346 A 8/1969 Kernan et al.
3,494,461 A 2/1970 Fournier et al.
3,511,030 A 5/1970 Brown et al.
3,542,650 A 11/1970 Kulakov
3,545,470 A 12/1970 Paton
3,587,198 A 6/1971 Hensel
3,591,827 A 7/1971 Hall
3,592,742 A 7/1971 Thompson
3,616,408 A 10/1971 Hickam
3,623,511 A 11/1971 Levin
3,630,852 A 12/1971 Nashan et al.
3,652,403 A 3/1972 Knappstein et al.
3,676,305 A 7/1972 Cremer
3,709,794 A 1/1973 Kinzler et al.
3,710,551 A 1/1973 Sved
3,746,626 A 7/1973 Morrison, Jr.
3,748,235 A 7/1973 Pries
3,784,034 A 1/1974 Thompson
3,788,236 A 1/1974 Edgar et al.
3,806,032 A 4/1974 Pries
3,811,572 A 5/1974 Tatterson
3,836,161 A 9/1974 Buhl
3,839,156 A 10/1974 Jakobi et al.
3,844,900 A 10/1974 Schulte
3,848,744 A 11/1974 Flaherty
3,857,758 A 12/1974 Mole
3,868,309 A 2/1975 Sustarsic et al.
3,875,016 A 4/1975 Schmidt-Balve
3,876,143 A 4/1975 Rossow et al.
3,876,506 A 4/1975 Dix et al.
3,878,053 A 4/1975 Hyde
3,894,302 A 7/1975 Lasater
3,897,312 A 7/1975 Armour et al.
3,897,313 A 7/1975 Ibaragi et al.
3,901,801 A 8/1975 Bixby
3,906,992 A 9/1975 Leach
3,912,091 A 10/1975 Thompson
3,912,597 A 10/1975 MacDonald
3,917,458 A 11/1975 Polak
3,928,144 A 12/1975 Jakimowicz
3,930,961 A 1/1976 Sustarsic et al.
3,933,443 A 1/1976 Lohrmann
3,957,591 A 5/1976 Riecker
3,959,084 A 5/1976 Price
3,963,582 A 6/1976 Helm et al.
3,969,191 A 7/1976 Bollenbach
3,975,148 A 8/1976 Fukuda et al.
3,979,870 A 9/1976 Moore
3,984,289 A 10/1976 Sustarsic et al.
3,990,948 A 11/1976 Lindgren
4,004,702 A 1/1977 Szendroi
4,004,983 A 1/1977 Pries
4,010,695 A 3/1977 Mantione
4,019,963 A 4/1977 Hanley, Jr.
4,025,395 A 5/1977 Ekholm et al.
4,040,910 A 8/1977 Knappstein et al.
4,045,056 A 8/1977 Kandakov et al.
4,045,299 A 8/1977 McDonald
4,059,885 A 11/1977 Oldengott
4,065,059 A 12/1977 Jablin
4,067,462 A 1/1978 Thompson
4,077,848 A 3/1978 Grainer et al.
4,083,753 A 4/1978 Rogers et al.
4,086,231 A 4/1978 Ikio
4,093,245 A 6/1978 Connor
4,100,033 A 7/1978 Holter
4,100,491 A 7/1978 Newman, Jr. et al.
4,100,889 A 7/1978 Chayes
4,111,757 A 9/1978 Carimboli
4,120,790 A 10/1978 Tinker et al.
4,124,450 A 11/1978 MacDonald
4,131,070 A 12/1978 Jonnet
4,133,720 A 1/1979 Franzer et al.
4,135,948 A 1/1979 Mertens et al.
4,135,986 A 1/1979 Cain et al.
4,141,299 A 2/1979 Friend et al.
4,141,796 A 2/1979 Clark et al.
4,143,104 A 3/1979 van Konijnenburg et al.
4,145,195 A 3/1979 Knappstein et al.
4,147,230 A 4/1979 Ormond et al.
4,162,546 A 7/1979 Shortell et al.
4,176,013 A 11/1979 Garthus et al.
4,181,459 A 1/1980 Price
4,189,272 A 2/1980 Gregor et al.
4,194,951 A 3/1980 Pries

(56) References Cited

U.S. PATENT DOCUMENTS 4,196,053 A 4/1980 Grohmann
4,196,054 A 4/1980 Becker, Jr. et al.
4,211,608 A 7/1980 Kwasnoski et al.
4,211,611 A 7/1980 Bocsanczy
4,213,489 A 7/1980 Cain
4,213,827 A 7/1980 Calderon
4,213,828 A 7/1980 Calderon
4,222,748 A 9/1980 Argo et al.
4,222,824 A 9/1980 Flockenhaus et al.
4,224,109 A 9/1980 Flockenhaus et al.
4,225,393 A 9/1980 Gregor et al.
4,226,113 A 10/1980 Pelletier et al.
4,230,498 A 10/1980 Ruecki
4,235,830 A 11/1980 Bennett et al.
4,236,998 A 12/1980 Heys
4,239,602 A 12/1980 La Bate
4,248,671 A 2/1981 Belding
4,249,997 A 2/1981 Schmitz
4,263,099 A 4/1981 Porter
4,268,360 A 5/1981 Tsuzuki et al.
4,271,814 A 6/1981 Lister
4,284,478 A 8/1981 Brommel
4,285,772 A 8/1981 Kress
4,287,024 A 9/1981 Thompson
4,289,479 A 9/1981 Johnson
4,289,584 A 9/1981 Chuss et al.
4,289,585 A 9/1981 Wagener et al.
4,296,938 A 10/1981 Offermann et al.
4,298,497 A 11/1981 Colombo
4,299,666 A 11/1981 Ostmann
4,302,935 A 12/1981 Cousimano
4,303,615 A 12/1981 Jarmell et al.
4,307,673 A 12/1981 Caughey
4,312,711 A 1/1982 Brown et al.
4,312,712 A 1/1982 Kwasnik et al.
4,314,787 A 2/1982 Kwasnik et al.
4,316,435 A 2/1982 Nagamatsu et al.
4,324,568 A 4/1982 Wilcox et al.
4,330,372 A 5/1982 Cairns et al.
4,334,963 A 6/1982 Stog
4,336,107 A 6/1982 Irwin
4,336,843 A 6/1982 Petty
4,340,445 A 7/1982 Kucher et al.
4,342,195 A 8/1982 Lo
4,344,820 A 8/1982 Thompson
4,344,822 A 8/1982 Schwartz et al.
4,353,189 A 10/1982 Thiersch et al.
4,366,029 A 12/1982 Bixby et al.
4,373,244 A 2/1983 Mertens et al.
4,375,388 A 3/1983 Hara et al.
4,385,962 A 5/1983 Stewen et al.
4,391,674 A 7/1983 Velmin et al.
4,392,824 A 7/1983 Struck et al.
4,394,217 A 7/1983 Holz et al.
4,395,269 A 7/1983 Schuler
4,396,394 A 8/1983 Li et al.
4,396,461 A 8/1983 Neubaum et al.
4,406,619 A 9/1983 Oldengott
4,407,237 A 10/1983 Merritt
4,421,070 A 12/1983 Sullivan
4,431,484 A 2/1984 Weber et al.
4,439,277 A 3/1984 Dix
4,440,098 A 4/1984 Adams
4,441,892 A 4/1984 Schuster
4,445,977 A 5/1984 Husher
4,446,018 A 5/1984 Cerwick
4,448,541 A 5/1984 Lucas
4,452,749 A 6/1984 Kolvek et al.
4,459,103 A 7/1984 Gieskieng
4,469,446 A 9/1984 Goodboy
4,474,344 A 10/1984 Bennett
4,487,137 A 12/1984 Horvat et al.
4,498,786 A 2/1985 Ruscheweyh
4,506,025 A 3/1985 Kleeb et al.
4,508,539 A 4/1985 Nakai
4,518,461 A 5/1985 Gelfand
4,527,488 A 7/1985 Lindgren
4,529,407 A 7/1985 Johnston et al.
4,564,420 A 1/1986 Spindeler et al.
4,568,424 A 2/1986 Bauer
4,568,426 A 2/1986 Orlando
4,570,670 A 2/1986 Johnson
4,614,567 A 9/1986 Stahlherm et al.
4,643,327 A 2/1987 Campbell
4,645,513 A 2/1987 Kubota et al.
4,655,193 A 4/1987 Blacket
4,655,804 A 4/1987 Kercheval et al.
4,666,675 A 5/1987 Parker et al.
4,680,167 A 7/1987 Orlando
4,681,662 A 7/1987 Kutsumura et al.
4,690,689 A 9/1987 Malcosky et al.
4,704,195 A 11/1987 Janicka et al.
4,720,262 A 1/1988 Durr et al.
4,724,976 A 2/1988 Lee
4,726,465 A 2/1988 Kwasnik et al.
4,732,652 A 3/1988 Durselen et al.
4,749,446 A 6/1988 van Laar et al.
4,793,981 A 12/1988 Doyle et al.
4,821,473 A 4/1989 Cowell
4,822,388 A 4/1989 Gee
4,824,614 A 4/1989 Jones et al.
4,889,698 A 12/1989 Moller et al.
4,898,021 A 2/1990 Weaver et al.
4,918,975 A 4/1990 Voss
4,919,170 A 4/1990 Kallinich et al.
4,929,179 A 5/1990 Breidenbach et al.
4,941,824 A 7/1990 Holter et al.
4,981,496 A 1/1991 Hausslein
5,013,408 A 5/1991 Asai et al.
5,052,922 A 10/1991 Stokman et al.
5,062,925 A 11/1991 Durselen et al.
5,078,822 A 1/1992 Hodges et al.
5,087,328 A 2/1992 Wegerer et al.
5,114,542 A 5/1992 Childress et al.
5,213,138 A 5/1993 Presz
5,227,106 A 7/1993 Kolvek
5,228,955 A 7/1993 Westbrook, III
5,234,601 A 8/1993 Janke et al.
5,318,671 A 6/1994 Pruitt
5,370,218 A 12/1994 Johnson et al.
5,394,600 A 3/1995 Chen
5,398,543 A 3/1995 Fukushima et al.
5,423,152 A 6/1995 Kolvek
5,447,606 A 9/1995 Pruitt
5,480,594 A 1/1996 Wilkerson et al.
5,542,650 A 8/1996 Abel et al.
5,597,452 A 1/1997 Hippe et al.
5,603,810 A 2/1997 Michler
5,622,280 A 4/1997 Mays et al.
5,659,110 A 8/1997 Herden et al.
5,670,025 A 9/1997 Baird
5,687,768 A 11/1997 Albrecht et al.
5,705,037 A 1/1998 Reinke et al.
5,715,962 A 2/1998 McDonnell
5,720,855 A 2/1998 Baird
5,745,969 A 5/1998 Yamada et al.
5,752,548 A 5/1998 Matsumoto et al.
5,752,993 A 5/1998 Eatough et al.
5,787,821 A 8/1998 Bhat et al.
5,810,032 A 9/1998 Hong et al.
5,816,210 A 10/1998 Yamaguchi
5,857,308 A 1/1999 Dismore et al.
5,881,551 A 3/1999 Dang
5,913,448 A 6/1999 Mann et al.
5,928,476 A 7/1999 Daniels
5,966,886 A 10/1999 Di Loreto
5,968,320 A 10/1999 Sprague
6,002,993 A 12/1999 Naito et al.
6,003,706 A 12/1999 Rosen
6,017,214 A 1/2000 Sturgulewski
6,022,112 A 2/2000 Isler et al.
6,059,932 A 5/2000 Sturgulewski
6,126,910 A 10/2000 Wilhelm et al.
6,139,692 A 10/2000 Tamura et al.

(56) References Cited

U.S. PATENT DOCUMENTS

| | | | |
|---|---|---|---|
| 6,152,668 | A | 11/2000 | Knoch |
| 6,156,688 | A | 12/2000 | Ando et al. |
| 6,173,679 | B1 | 1/2001 | Bruckner et al. |
| 6,187,148 | B1 | 2/2001 | Sturgulewski |
| 6,189,819 | B1 | 2/2001 | Racine |
| 6,290,494 | B1 | 9/2001 | Barkdoll |
| 6,412,221 | B1 | 7/2002 | Emsbo |
| 6,424,457 | B1 | 7/2002 | Koonmen et al. |
| 6,495,268 | B1 | 12/2002 | Harth, III et al. |
| 6,539,602 | B1 | 4/2003 | Ozawa et al. |
| 6,596,128 | B2 | 7/2003 | Westbrook |
| 6,626,984 | B1 | 9/2003 | Taylor |
| 6,699,035 | B2 | 3/2004 | Brooker |
| 6,712,576 | B2 | 3/2004 | Skarzenski et al. |
| 6,758,875 | B2 | 7/2004 | Reid et al. |
| 6,786,941 | B2 | 9/2004 | Reeves et al. |
| 6,830,660 | B1 | 12/2004 | Yamauchi et al. |
| 6,907,895 | B2 | 6/2005 | Johnson et al. |
| 6,946,011 | B2 | 9/2005 | Snyder |
| 6,964,236 | B2 | 11/2005 | Schücker et al. |
| 7,056,390 | B2 | 6/2006 | Fratello |
| 7,077,892 | B2 | 7/2006 | Lee |
| 7,314,060 | B2 | 1/2008 | Chen et al. |
| 7,331,298 | B2 | 2/2008 | Barkdoll et al. |
| 7,433,743 | B2 | 10/2008 | Pistikopoulos et al. |
| 7,497,930 | B2 | 3/2009 | Barkdoll et al. |
| 7,547,377 | B2 | 6/2009 | Inamasu et al. |
| 7,611,609 | B1 | 11/2009 | Valia et al. |
| 7,644,711 | B2 | 1/2010 | Creel |
| 7,722,843 | B1 | 5/2010 | Srinivasachar |
| 7,727,307 | B2 | 6/2010 | Winkler |
| 7,785,447 | B2 | 8/2010 | Eatough et al. |
| 7,803,627 | B2 | 9/2010 | Hodges et al. |
| 7,823,401 | B2 | 11/2010 | Takeuchi et al. |
| 7,827,689 | B2 | 11/2010 | Crane |
| 7,998,316 | B2 | 8/2011 | Barkdoll |
| 8,071,060 | B2 | 12/2011 | Ukai et al. |
| 8,079,751 | B2 | 12/2011 | Kapila et al. |
| 8,080,088 | B1 | 12/2011 | Srinivasachar |
| 8,146,376 | B1 | 4/2012 | Williams et al. |
| 8,152,970 | B2 | 4/2012 | Barkdoll et al. |
| 8,172,930 | B2 | 5/2012 | Barkdoll |
| 8,236,142 | B2 | 8/2012 | Westbrook |
| 8,266,853 | B2 | 9/2012 | Bloom et al. |
| 8,311,777 | B2 | 11/2012 | Suguira et al. |
| 8,383,055 | B2 | 2/2013 | Palmer |
| 8,398,935 | B2 | 3/2013 | Howell et al. |
| 8,409,405 | B2 | 4/2013 | Kim et al. |
| 8,500,881 | B2 | 8/2013 | Orita et al. |
| 8,515,508 | B2 | 8/2013 | Kawamura et al. |
| 8,568,568 | B2 | 10/2013 | Schuecker et al. |
| 8,640,635 | B2 | 2/2014 | Bloom et al. |
| 8,647,476 | B2 | 2/2014 | Kim et al. |
| 8,800,795 | B2 | 8/2014 | Hwang |
| 8,956,995 | B2 | 2/2015 | Masatsugu et al. |
| 8,980,063 | B2 | 3/2015 | Kim et al. |
| 9,039,869 | B2 | 5/2015 | Kim et al. |
| 9,057,023 | B2 | 6/2015 | Reichelt et al. |
| 9,103,234 | B2 | 8/2015 | Gu et al. |
| 9,169,439 | B2 | 10/2015 | Sarpen et al. |
| 9,193,913 | B2 | 11/2015 | Quanci et al. |
| 9,193,915 | B2 | 11/2015 | West et al. |
| 9,200,225 | B2 | 12/2015 | Barkdoll et al. |
| 9,238,778 | B2 | 1/2016 | Quanci et al. |
| 9,243,186 | B2 | 1/2016 | Quanci et al. |
| 9,249,357 | B2 | 2/2016 | Quanci et al. |
| 9,273,249 | B2 | 3/2016 | Quanci et al. |
| 9,273,250 | B2 | 3/2016 | Choi et al. |
| 9,321,965 | B2 | 4/2016 | Barkdoll |
| 9,359,554 | B2 | 6/2016 | Quanci et al. |
| 9,404,043 | B2 | 8/2016 | Kim |
| 9,463,980 | B2 | 10/2016 | Fukada et al. |
| 9,498,786 | B2 | 11/2016 | Pearson |
| 9,580,656 | B2 | 2/2017 | Quanci et al. |
| 9,672,499 | B2 | 6/2017 | Quanci et al. |
| 9,708,542 | B2 | 7/2017 | Quanci et al. |
| 9,862,888 | B2 | 1/2018 | Quanci et al. |
| 9,976,089 | B2 | 5/2018 | Quanci et al. |
| 10,016,714 | B2 | 7/2018 | Quanci et al. |
| 10,041,002 | B2 | 8/2018 | Quanci et al. |
| 10,047,295 | B2 | 8/2018 | Chun et al. |
| 10,047,296 | B2 | 8/2018 | Chun et al. |
| 10,053,627 | B2 | 8/2018 | Sarpen et al. |
| 10,087,579 | B2 | 10/2018 | Ottosson et al. |
| 10,233,392 | B2 | 3/2019 | Quanci et al. |
| 10,308,876 | B2 | 6/2019 | Quanci et al. |
| 10,323,192 | B2 | 6/2019 | Quanci et al. |
| 10,392,563 | B2 | 8/2019 | Kim et al. |
| 10,435,042 | B1 | 10/2019 | Weymouth |
| 10,526,541 | B2 | 1/2020 | West et al. |
| 10,578,521 | B1 | 3/2020 | Dinakaran et al. |
| 10,611,965 | B2 | 4/2020 | Quanci et al. |
| 10,619,101 | B2 | 4/2020 | Quanci et al. |
| 10,732,621 | B2 | 8/2020 | Cella et al. |
| 10,877,007 | B2 | 12/2020 | Steele et al. |
| 10,883,051 | B2 | 1/2021 | Quanci et al. |
| 10,920,148 | B2 | 2/2021 | Quanci et al. |
| 10,927,303 | B2 | 2/2021 | Choi et al. |
| 10,947,455 | B2 | 3/2021 | Quanci et al. |
| 10,968,393 | B2 | 4/2021 | West et al. |
| 10,968,395 | B2 | 4/2021 | Quanci et al. |
| 10,975,309 | B2 | 4/2021 | Quanci et al. |
| 10,975,310 | B2 | 4/2021 | Quanci et al. |
| 10,975,311 | B2 | 4/2021 | Quanci et al. |
| 11,008,517 | B2 | 5/2021 | Chun et al. |
| 11,008,518 | B2 | 5/2021 | Quanci et al. |
| 11,021,655 | B2 | 6/2021 | Quanci et al. |
| 11,053,444 | B2 | 7/2021 | Quanci et al. |
| 11,071,935 | B2 | 7/2021 | Quanci et al. |
| 11,098,252 | B2 | 8/2021 | Quanci et al. |
| 11,117,087 | B2 | 9/2021 | Quanci |
| 11,142,699 | B2 | 10/2021 | West et al. |
| 11,186,778 | B2 | 11/2021 | Crum et al. |
| 11,193,069 | B2 | 12/2021 | Quanci et al. |
| 11,214,739 | B2 | 1/2022 | Quanci et al. |
| 11,261,381 | B2 | 3/2022 | Quanci et al. |
| 2002/0170605 | A1 | 11/2002 | Shiraishi et al. |
| 2003/0014954 | A1 | 1/2003 | Ronning et al. |
| 2003/0015809 | A1 | 1/2003 | Carson |
| 2003/0057083 | A1 | 3/2003 | Eatough et al. |
| 2004/0016377 | A1 | 1/2004 | Johnson et al. |
| 2004/0220840 | A1 | 11/2004 | Bonissone et al. |
| 2005/0087767 | A1 | 4/2005 | Fitzgerald et al. |
| 2005/0096759 | A1 | 5/2005 | Benjamin et al. |
| 2006/0029532 | A1 | 2/2006 | Breen et al. |
| 2006/0102420 | A1 | 5/2006 | Huber et al. |
| 2006/0149407 | A1 | 7/2006 | Markham et al. |
| 2007/0087946 | A1 | 4/2007 | Quest et al. |
| 2007/0102278 | A1 | 5/2007 | Inamasu et al. |
| 2007/0116619 | A1 | 5/2007 | Taylor et al. |
| 2007/0181717 | A1 | 8/2007 | Fuller |
| 2007/0251198 | A1 | 11/2007 | Witter |
| 2008/0028935 | A1 | 2/2008 | Andersson |
| 2008/0116052 | A1 | 5/2008 | Eatough et al. |
| 2008/0179165 | A1 | 7/2008 | Chen et al. |
| 2008/0250863 | A1 | 10/2008 | Moore |
| 2008/0257236 | A1 | 10/2008 | Green |
| 2008/0271985 | A1 | 11/2008 | Yamasaki |
| 2008/0289305 | A1 | 11/2008 | Girondi |
| 2009/0007785 | A1 | 1/2009 | Kimura et al. |
| 2009/0032385 | A1 | 2/2009 | Engle |
| 2009/0105852 | A1 | 4/2009 | Wintrich et al. |
| 2009/0152092 | A1 | 6/2009 | Kim et al. |
| 2009/0162269 | A1 | 6/2009 | Barger et al. |
| 2009/0217576 | A1 | 9/2009 | Kim et al. |
| 2009/0257932 | A1 | 10/2009 | Canari et al. |
| 2009/0283395 | A1 | 11/2009 | Hippe |
| 2010/0015564 | A1 | 1/2010 | Chun et al. |
| 2010/0095521 | A1 | 4/2010 | Kartal et al. |
| 2010/0106310 | A1 | 4/2010 | Grohman |
| 2010/0113266 | A1 | 5/2010 | Abe et al. |
| 2010/0115912 | A1 | 5/2010 | Worley |
| 2010/0119425 | A1 | 5/2010 | Palmer |
| 2010/0159247 | A1 | 6/2010 | Kaya et al. |

(56) References Cited

U.S. PATENT DOCUMENTS

| | | | |
|---|---|---|---|
| 2010/0181297 | A1 | 7/2010 | Whysail |
| 2010/0196597 | A1 | 8/2010 | Di Loreto |
| 2010/0276269 | A1 | 11/2010 | Schuecker et al. |
| 2010/0287871 | A1 | 11/2010 | Bloom et al. |
| 2010/0300867 | A1 | 12/2010 | Kim et al. |
| 2010/0314234 | A1 | 12/2010 | Knoch et al. |
| 2011/0000284 | A1 | 1/2011 | Kumar et al. |
| 2011/0014406 | A1 | 1/2011 | Coleman et al. |
| 2011/0048917 | A1 | 3/2011 | Kim et al. |
| 2011/0083314 | A1 | 4/2011 | Baird |
| 2011/0088600 | A1 | 4/2011 | McRae |
| 2011/0100273 | A1 | 5/2011 | Ptacek |
| 2011/0120852 | A1 | 5/2011 | Kim |
| 2011/0144406 | A1 | 6/2011 | Masatsugu et al. |
| 2011/0156902 | A1 | 6/2011 | Wang et al. |
| 2011/0162265 | A1 | 7/2011 | Krupp et al. |
| 2011/0168482 | A1 | 7/2011 | Merchant et al. |
| 2011/0174301 | A1 | 7/2011 | Haydock et al. |
| 2011/0192395 | A1 | 8/2011 | Kim |
| 2011/0198206 | A1 | 8/2011 | Kim et al. |
| 2011/0223088 | A1 | 9/2011 | Chang et al. |
| 2011/0253521 | A1 | 10/2011 | Kim |
| 2011/0272508 | A1 | 11/2011 | Krebs et al. |
| 2011/0291827 | A1 | 12/2011 | Baldocchi et al. |
| 2011/0313218 | A1 | 12/2011 | Dana |
| 2011/0315538 | A1 | 12/2011 | Kim et al. |
| 2012/0031076 | A1 | 2/2012 | Frank et al. |
| 2012/0125709 | A1 | 5/2012 | Merchant et al. |
| 2012/0152720 | A1 | 6/2012 | Reichelt et al. |
| 2012/0177541 | A1 | 7/2012 | Mutsuda et al. |
| 2012/0179421 | A1 | 7/2012 | Dasgupta |
| 2012/0180133 | A1 | 7/2012 | Al-Harbi et al. |
| 2012/0195815 | A1 | 8/2012 | Moore et al. |
| 2012/0210635 | A1 | 8/2012 | Edwards |
| 2012/0228115 | A1 | 9/2012 | Westbrook |
| 2012/0247939 | A1 | 10/2012 | Kim et al. |
| 2012/0285080 | A1 | 11/2012 | Despen et al. |
| 2012/0305380 | A1 | 12/2012 | Wang et al. |
| 2012/0312019 | A1 | 12/2012 | Rechtman |
| 2013/0020781 | A1 | 1/2013 | Kishikawa |
| 2013/0045149 | A1 | 2/2013 | Miller |
| 2013/0213114 | A1 | 8/2013 | Wetzig et al. |
| 2013/0216717 | A1 | 8/2013 | Rago et al. |
| 2013/0220373 | A1 | 8/2013 | Kim |
| 2013/0306462 | A1 | 11/2013 | Kim et al. |
| 2014/0033917 | A1 | 2/2014 | Rodgers et al. |
| 2014/0039833 | A1 | 2/2014 | Sharpe, Jr. et al. |
| 2014/0156584 | A1 | 6/2014 | Motukuri et al. |
| 2014/0182683 | A1 | 7/2014 | Quanci et al. |
| 2014/0208997 | A1 | 7/2014 | Alferyev et al. |
| 2014/0224123 | A1 | 8/2014 | Walters |
| 2014/0245803 | A1 | 9/2014 | Forsythe et al. |
| 2014/0262726 | A1 | 9/2014 | West et al. |
| 2014/0308620 | A1 | 10/2014 | Deng et al. |
| 2015/0041304 | A1 | 2/2015 | Kiim et al. |
| 2015/0075962 | A1 | 3/2015 | Shimoyama et al. |
| 2015/0122629 | A1 | 5/2015 | Freimuth et al. |
| 2015/0143908 | A1 | 5/2015 | Cetinkaya |
| 2015/0175433 | A1 | 6/2015 | Micka et al. |
| 2015/0176095 | A1 | 6/2015 | Connors et al. |
| 2015/0219530 | A1 | 8/2015 | Li et al. |
| 2015/0226499 | A1 | 8/2015 | Mikkelsen |
| 2015/0361347 | A1 | 12/2015 | Ball et al. |
| 2016/0026193 | A1 | 1/2016 | Rhodes et al. |
| 2016/0048139 | A1 | 2/2016 | Samples et al. |
| 2016/0149944 | A1 | 5/2016 | Obermeirer et al. |
| 2016/0154171 | A1 | 6/2016 | Kato et al. |
| 2016/0319198 | A1 | 11/2016 | Quanci et al. |
| 2016/0370082 | A1 | 12/2016 | Olivo |
| 2016/0377430 | A1 | 12/2016 | Kalagnanam et al. |
| 2017/0173519 | A1 | 6/2017 | Naito |
| 2017/0182447 | A1 | 6/2017 | Sappok et al. |
| 2017/0183569 | A1 | 6/2017 | Quanci et al. |
| 2017/0218274 | A1 | 8/2017 | Yu et al. |
| 2017/0226425 | A1 | 8/2017 | Kim et al. |
| 2017/0261417 | A1 | 9/2017 | Zhang |
| 2017/0313943 | A1 | 11/2017 | Valdevies |
| 2017/0352243 | A1 | 12/2017 | Quanci et al. |
| 2018/0340122 | A1 | 11/2018 | Crum et al. |
| 2019/0169503 | A1 | 6/2019 | Chun et al. |
| 2019/0317167 | A1 | 10/2019 | LaBorde et al. |
| 2020/0071190 | A1 | 3/2020 | Wiederin et al. |
| 2020/0139273 | A1 | 5/2020 | Badiei |
| 2020/0173679 | A1 | 6/2020 | O'Reilly et al. |
| 2020/0206683 | A1 | 7/2020 | Quanci et al. |
| 2020/0208059 | A1 | 7/2020 | Quanci et al. |
| 2020/0208060 | A1 | 7/2020 | Quanci et al. |
| 2020/0208063 | A1 | 7/2020 | Quanci et al. |
| 2020/0208833 | A1 | 7/2020 | Quanci et al. |
| 2020/0407641 | A1 | 12/2020 | Quanci et al. |
| 2021/0024828 | A1 | 1/2021 | Ball et al. |
| 2021/0040391 | A1 | 2/2021 | Quanci et al. |
| 2021/0130697 | A1 | 5/2021 | Quanci et al. |
| 2021/0163821 | A1 | 6/2021 | Quanci et al. |
| 2021/0163822 | A1 | 6/2021 | Quanci et al. |
| 2021/0163823 | A1 | 6/2021 | Quanci et al. |
| 2021/0198579 | A1 | 7/2021 | Quanci et al. |
| 2021/0261877 | A1 | 8/2021 | Despen et al. |
| 2021/0340454 | A1 | 11/2021 | Quanci et al. |
| 2021/0363426 | A1 | 11/2021 | West et al. |
| 2021/0363427 | A1 | 11/2021 | Quanci et al. |
| 2021/0371752 | A1 | 12/2021 | Quanci et al. |
| 2021/0388270 | A1 | 12/2021 | Choi et al. |
| 2022/0056342 | A1 | 2/2022 | Quanci et al. |
| 2022/0106527 | A1 | 4/2022 | Quanci et al. |
| 2022/0195303 | A1 | 6/2022 | Quanci et al. |
| 2022/0204858 | A1 | 6/2022 | West et al. |
| 2022/0204859 | A1 | 6/2022 | Crum et al. |
| 2022/0298423 | A1 | 9/2022 | Quanci et al. |
| 2022/0325183 | A1 | 10/2022 | Quanci et al. |
| 2023/0012031 | A1 | 1/2023 | Quanci et al. |
| 2023/0258326 | A1 | 8/2023 | Quanci et al. |
| 2023/0330596 | A1 | 10/2023 | Bumb et al. |
| 2023/0360511 | A1 | 11/2023 | Quanci et al. |
| 2023/0416629 | A1 | 12/2023 | Quanci et al. |
| 2024/0110103 | A1 | 4/2024 | Quanci et al. |
| 2025/0161988 | A1 | 5/2025 | Quanci |
| 2025/0163328 | A1 | 5/2025 | Choi et al. |
| 2025/0163329 | A1 | 5/2025 | Choi et al. |
| 2025/0163339 | A1 | 5/2025 | Quanci et al. |
| 2025/0187018 | A1 | 6/2025 | Quanci et al. |
| 2025/0188353 | A1 | 6/2025 | Quanci et al. |

FOREIGN PATENT DOCUMENTS

| | | | |
|---|---|---|---|
| CA | 2822841 | | 7/2012 |
| CA | 2822857 | | 7/2012 |
| CA | 2905110 | A1 | 9/2014 |
| CN | 87212113 | U | 6/1988 |
| CN | 87107195 | A | 7/1988 |
| CN | 2064363 | U | 10/1990 |
| CN | 2139121 | Y | 7/1993 |
| CN | 1092457 | A | 9/1994 |
| CN | 1255528 | A | 6/2000 |
| CN | 1270983 | A | 10/2000 |
| CN | 2528771 | Y | 2/2002 |
| CN | 1358822 | A | 7/2002 |
| CN | 2521473 | Y | 11/2002 |
| CN | 1468364 | A | 1/2004 |
| CN | 1527872 | A | 9/2004 |
| CN | 2668641 | | 1/2005 |
| CN | 1957204 | A | 5/2007 |
| CN | 101037603 | A | 9/2007 |
| CN | 101058731 | A | 10/2007 |
| CN | 101157874 | A | 4/2008 |
| CN | 101211495 | A | 7/2008 |
| CN | 201121178 | Y | 9/2008 |
| CN | 101362971 | A | 2/2009 |
| CN | 101395248 | A | 3/2009 |
| CN | 100510004 | C | 7/2009 |
| CN | 101486017 | A | 7/2009 |
| CN | 201264981 | Y | 7/2009 |
| CN | 101497835 | A | 8/2009 |
| CN | 101509427 | A | 8/2009 |

(56) References Cited

FOREIGN PATENT DOCUMENTS

| | | | |
|---|---|---|---|
| CN | 101886466 | A | 11/2010 |
| CN | 101910530 | A | 12/2010 |
| CN | 101921643 | A | 12/2010 |
| CN | 102072829 | A | 5/2011 |
| CN | 102155300 | A | 8/2011 |
| CN | 2509188 | Y | 11/2011 |
| CN | 202226816 | | 5/2012 |
| CN | 202265541 | U | 6/2012 |
| CN | 102584294 | A | 7/2012 |
| CN | 202415446 | U | 9/2012 |
| CN | 202470353 | U | 10/2012 |
| CN | 103399536 | A | 11/2013 |
| CN | 103468289 | A | 12/2013 |
| CN | 103468841 | A | 12/2013 |
| CN | 103756699 | A | 4/2014 |
| CN | 103913193 | A | 7/2014 |
| CN | 203981700 | U | 12/2014 |
| CN | 104498059 | A | 4/2015 |
| CN | 104915746 | A | 9/2015 |
| CN | 105001914 | A | 10/2015 |
| CN | 105137947 | A | 12/2015 |
| CN | 105189704 | A | 12/2015 |
| CN | 105264448 | A | 1/2016 |
| CN | 105467949 | A | 4/2016 |
| CN | 105842065 | A | 8/2016 |
| CN | 106399607 | A | 2/2017 |
| CN | 106661456 | A | 5/2017 |
| CN | 106687564 | A | 5/2017 |
| CN | 107022359 | A | 8/2017 |
| CN | 107267183 | A | 10/2017 |
| CN | 107445633 | A | 12/2017 |
| CN | 108219807 | A | 6/2018 |
| CN | 110141947 | A | 8/2019 |
| CN | 100500619 | C | 6/2020 |
| CN | 111621313 | A | 9/2020 |
| CN | 111621314 | 1 | 9/2020 |
| CN | 111778048 | A | 10/2020 |
| CN | 113088310 | A | 7/2021 |
| CN | 113322085 | A | 8/2021 |
| CN | 113462415 | A | 10/2021 |
| CN | 114517099 | A | 5/2022 |
| CN | 101921643 | B | 12/2022 |
| CN | 116606664 | A | 8/2023 |
| DE | 201729 | C | 9/1908 |
| DE | 212176 | | 7/1909 |
| DE | 912453 | C | 5/1954 |
| DE | 1103949 | B | 6/1961 |
| DE | 1212037 | B | 3/1966 |
| DE | 2212544 | A | 1/1973 |
| DE | 2720688 | A1 | 11/1978 |
| DE | 3231697 | C1 | 1/1984 |
| DE | 3328702 | A1 | 2/1984 |
| DE | 3315738 | C2 | 3/1984 |
| DE | 3329367 | C | 11/1984 |
| DE | 3407487 | C1 | 6/1985 |
| DE | 19545736 | | 6/1997 |
| DE | 19803455 | | 8/1999 |
| DE | 10122531 | A1 | 11/2002 |
| DE | 10154785 | | 5/2003 |
| DE | 102004062936 | A1 | 7/2006 |
| DE | 102005015301 | | 10/2006 |
| DE | 102006004669 | | 8/2007 |
| DE | 102006026521 | | 12/2007 |
| DE | 102009031436 | | 1/2011 |
| DE | 102011052785 | | 12/2012 |
| EA | 010510 | B1 | 10/2008 |
| EP | 0126399 | A1 | 11/1984 |
| EP | 0208490 | A1 | 1/1987 |
| EP | 0418801 | A1 | 3/1991 |
| EP | 0433498 | A1 | 6/1991 |
| EP | 0903393 | A2 | 3/1999 |
| EP | 1538503 | A1 | 6/2005 |
| EP | 1860034 | A1 | 11/2007 |
| EP | 2295129 | A1 | 3/2011 |
| EP | 2468837 | A1 | 6/2012 |
| FR | 2339664 | | 8/1977 |
| FR | 2517802 | | 6/1983 |
| FR | 2764978 | | 12/1998 |
| GB | 364236 | A | 1/1932 |
| GB | 368649 | A | 3/1932 |
| GB | 441784 | | 1/1936 |
| GB | 606340 | | 8/1948 |
| GB | 611524 | | 11/1948 |
| GB | 725865 | | 3/1955 |
| GB | 783720 | A | 9/1957 |
| GB | 871094 | | 6/1961 |
| GB | 923205 | A | 5/1963 |
| GB | 977905 | A | 12/1964 |
| GB | 1148379 | A | 4/1969 |
| GB | 2000193 | A | 1/1979 |
| JP | S50148405 | | 11/1975 |
| JP | S5319301 | A | 2/1978 |
| JP | 54054101 | | 4/1979 |
| JP | S5453103 | A | 4/1979 |
| JP | 57051786 | | 3/1982 |
| JP | 57051787 | | 3/1982 |
| JP | 57083585 | | 5/1982 |
| JP | 57090092 | | 6/1982 |
| JP | S57172978 | A | 10/1982 |
| JP | 58091788 | | 5/1983 |
| JP | 59051978 | | 3/1984 |
| JP | 59053589 | | 3/1984 |
| JP | 59071388 | | 4/1984 |
| JP | 59108083 | | 6/1984 |
| JP | 59145281 | | 8/1984 |
| JP | 60004588 | | 1/1985 |
| JP | 61106690 | | 5/1986 |
| JP | 62011794 | | 1/1987 |
| JP | 62285980 | | 12/1987 |
| JP | 01103694 | | 4/1989 |
| JP | 01249886 | | 10/1989 |
| JP | H0319127 | | 3/1991 |
| JP | 03197588 | | 8/1991 |
| JP | 04159392 | | 6/1992 |
| JP | H04178494 | A | 6/1992 |
| JP | H05230466 | A | 9/1993 |
| JP | H0649450 | A | 2/1994 |
| JP | H0654753 | U | 7/1994 |
| JP | H06264062 | | 9/1994 |
| JP | H06299156 | A | 10/1994 |
| JP | H0776713 | A | 3/1995 |
| JP | 07188668 | | 7/1995 |
| JP | 07216357 | | 8/1995 |
| JP | H07204432 | | 8/1995 |
| JP | H07252480 | A | 10/1995 |
| JP | H0843314 | A | 2/1996 |
| JP | H08104875 | A | 4/1996 |
| JP | 08127778 | | 5/1996 |
| JP | H08218071 | A | 8/1996 |
| JP | H09310074 | A | 12/1997 |
| JP | H10273672 | A | 10/1998 |
| JP | H11131074 | | 5/1999 |
| JP | H11256166 | A | 9/1999 |
| JP | 2000204373 | A | 7/2000 |
| JP | 2000219883 | A | 8/2000 |
| JP | 2001055576 | A | 2/2001 |
| JP | 2001187887 | A | 7/2001 |
| JP | 2001200258 | | 7/2001 |
| JP | 2002097472 | A | 4/2002 |
| JP | 2002106941 | | 4/2002 |
| JP | 2003041258 | | 2/2003 |
| JP | 2003041618 | A | 2/2003 |
| JP | 2003051082 | A | 2/2003 |
| JP | 2003071313 | A | 3/2003 |
| JP | 2003292968 | A | 10/2003 |
| JP | 2003342581 | A | 12/2003 |
| JP | 2004169016 | A | 6/2004 |
| JP | 2005503448 | A | 2/2005 |
| JP | 2005135422 | A | 5/2005 |
| JP | 2005154597 | A | 6/2005 |
| JP | 2005263983 | A | 9/2005 |
| JP | 2005344085 | A | 12/2005 |
| JP | 2006188608 | A | 7/2006 |
| JP | 2006257252 | A | 9/2006 |

(56) References Cited

FOREIGN PATENT DOCUMENTS

| | | | |
|---|---|---|---|
| JP | 2007063420 | A | 3/2007 |
| JP | 3924064 | B2 | 6/2007 |
| JP | 2007169484 | A | 7/2007 |
| JP | 2007231326 | A | 9/2007 |
| JP | 4101226 | B2 | 6/2008 |
| JP | 2008231278 | A | 10/2008 |
| JP | 2009001640 | A | 1/2009 |
| JP | 2009019106 | A | 1/2009 |
| JP | 2009073864 | A | 4/2009 |
| JP | 2009073865 | A | 4/2009 |
| JP | 2009135276 | A | 6/2009 |
| JP | 2009144121 | | 7/2009 |
| JP | 2009209286 | A | 9/2009 |
| JP | 2010229239 | A | 10/2010 |
| JP | 2010248389 | A | 11/2010 |
| JP | 2011504947 | A | 2/2011 |
| JP | 2011068733 | A | 4/2011 |
| JP | 2011102351 | A | 5/2011 |
| JP | 2012072389 | A | 4/2012 |
| JP | 2012102302 | | 5/2012 |
| JP | 2012102325 | A | 5/2012 |
| JP | 2013006957 | A | 1/2013 |
| JP | 2013510910 | | 3/2013 |
| JP | 2013189322 | A | 9/2013 |
| JP | 2014009284 | A | 1/2014 |
| JP | 2014040502 | A | 3/2014 |
| JP | 2015094091 | A | 5/2015 |
| JP | 2015199791 | A | 11/2015 |
| JP | 2016169897 | A | 9/2016 |
| JP | 2020007472 | A | 1/2020 |
| KR | 1019960008754 | | 10/1996 |
| KR | 19990017156 | U | 5/1999 |
| KR | 1019990054426 | | 7/1999 |
| KR | 20000042375 | A | 7/2000 |
| KR | 100296700 | B1 | 10/2001 |
| KR | 20030011016 | A | 2/2003 |
| KR | 20030012458 | A | 2/2003 |
| KR | 1020040020883 | A | 3/2004 |
| KR | 20040107204 | A | 12/2004 |
| KR | 20050053861 | A | 6/2005 |
| KR | 20060132336 | A | 12/2006 |
| KR | 100737393 | B1 | 7/2007 |
| KR | 100797852 | | 1/2008 |
| KR | 20080069170 | A | 7/2008 |
| KR | 20110010452 | A | 2/2011 |
| KR | 101314288 | | 4/2011 |
| KR | 20120033091 | A | 4/2012 |
| KR | 20130050807 | | 5/2013 |
| KR | 101318388 | | 10/2013 |
| KR | 20140042526 | A | 4/2014 |
| KR | 20140076155 | A | 6/2014 |
| KR | 20150011084 | A | 1/2015 |
| KR | 20150068557 | A | 6/2015 |
| KR | 20170038102 | A | 4/2017 |
| KR | 20170058808 | A | 5/2017 |
| KR | 20170103857 | A | 9/2017 |
| KR | 101862491 | B1 | 5/2018 |
| KR | 20230118420 | A | 8/2023 |
| RU | 2083532 | C1 | 7/1997 |
| RU | 2441898 | C2 | 2/2012 |
| RU | 2493233 | C2 | 9/2013 |
| SU | 1535880 | A1 | 1/1990 |
| TW | 201241166 | A1 | 10/2012 |
| TW | 201245431 | A1 | 11/2012 |
| UA | 50580 | | 10/2002 |
| WO | WO9012074 | | 10/1990 |
| WO | WO9945083 | | 9/1999 |
| WO | WO02062922 | | 8/2002 |
| WO | WO2003025093 | | 3/2003 |
| WO | WO2005023649 | | 3/2005 |
| WO | WO2005031297 | | 4/2005 |
| WO | WO2005115583 | | 12/2005 |
| WO | 2006010432 | A1 | 2/2006 |
| WO | WO2007103649 | | 9/2007 |
| WO | WO2008034424 | | 3/2008 |
| WO | WO2008105269 | | 9/2008 |
| WO | WO2009147983 | | 12/2009 |
| WO | WO2010032734 | | 3/2010 |
| WO | WO2010103992 | | 9/2010 |
| WO | WO2011000447 | | 1/2011 |
| WO | WO2011126043 | | 10/2011 |
| WO | 2012037454 | A2 | 3/2012 |
| WO | WO2012029979 | | 3/2012 |
| WO | WO2012031726 | | 3/2012 |
| WO | WO2013023872 | | 2/2013 |
| WO | WO2010107513 | | 9/2013 |
| WO | WO2013145679 | | 10/2013 |
| WO | WO2013153557 | | 10/2013 |
| WO | WO2014021909 | | 2/2014 |
| WO | WO2014043667 | | 3/2014 |
| WO | WO2014105064 | | 7/2014 |
| WO | WO2014153050 | | 9/2014 |
| WO | WO2016004106 | | 1/2016 |
| WO | WO2016033511 | | 3/2016 |
| WO | WO2016033515 | | 3/2016 |
| WO | WO2016086322 | | 6/2016 |
| WO | WO-2016109699 | A1 * | 7/2016 ..... C10B 33/00 |
| WO | WO2016109854 | | 7/2016 |
| WO | 2021225988 | A1 | 11/2021 |
| WO | WO2022159604 | | 7/2022 |
| WO | WO2022235839 | | 11/2022 |
| WO | 2023129090 | A2 | 7/2023 |

OTHER PUBLICATIONS

U.S. Appl. No. 17/967,615, filed Oct. 17, 2022, Quanci et al.

U.S. Appl. No. 18/047,916, filed Oct. 19, 2022, Quanci et al.

U.S. Appl. No. 18/052,739, filed Nov. 4, 2022, Quanci et al.

U.S. Appl. No. 18/052,760, filed Nov. 4, 2022, Quanci et al.

"High Alumina Cement-Manufacture, Characteristics and Uses," TheConstructor.org, https://theconstructor.org/concrete/high-alumina-cement/23686/; 12 pages.

"Refractory Castables," Victas.com, Dec. 28, 2011 (date obtained from WayBack Machine), https://www/vitcas.com/refactory-castables; 5 pages.

Gkotsis, et al., "Membrane-Based Technologies for Post-Combustion CO2 Capture from Flue Gases: Recent Progress in Commonly Employed Membrane Materials," Membranes 2023, 13, 898; 27 pages.

Mitsubishi Heavy Industries America, Inc., 'Development and demonstration of wasteheat integration with solvent process for more efficient CO2 removal from coal fired flue gas', 2017NETL CO2 Capture Technology Project Review Meeting, Aug. 22, 2017, pp. 1-43.

Japanese Decision of Final Rejection for Japanese Application No. 2023-568008; Date of Mailing: Mar. 18, 2025; 8 pages.

U.S. Appl. No. 12/849,192, filed Aug. 3, 2010, now U.S. Pat. No. 9,200,225, titled Method and Apparatus for Compacting Coal for a Coal Coking Process.

U.S. Appl. No. 13/631,215, filed Sep. 28, 2012, now U.S. Pat. No. 9,683,740, titled Methods for Handling Coal Processing Emissions and Associated Systems and Devices.

U.S. Appl. No. 13/730,692, filed Dec. 28, 2012, now U.S. Pat. No. 9,193,913, titled Reduced Output Rate Coke Oven Operation With Gas Sharing Providing Extended Process Cycle.

U.S. Appl. No. 14/921,723, filed Oct. 23, 2015, titled Reduced Output Rate Coke Oven Operation With Gas Sharing Providing Extended Process Cycle.

U.S. Appl. No. 14/655,204, now U.S. Pat. No. 10,016,714, filed Jun. 24, 2015, titled Systems and Methods for Removing Mercury From Emissions.

U.S. Appl. No. 16/000,516, now U.S. Pat. No. 11,117,087, filed Jun. 5, 2018, titled Systems and Methods for Removing Mercury From Emissions.

U.S. Appl. No. 17/459,380, filed Jun. 5, 2018, titled Systems and Methods for Removing Mercury From Emissions.

U.S. Appl. No. 13/830,971, filed Mar. 14, 2013, now U.S. Pat. No. 10,047,296, titled Non-Perpendicular Connections Between Coke

(56) References Cited

OTHER PUBLICATIONS

Oven Uptakes and a Hot Common Tunnel, and Associated Systems and Methods, now U.S. Pat. No. 10,047,295.
U.S. Appl. No. 16/026,363, filed Jul. 3, 2018, titled Non-Perpendicular Connections Between Coke Oven Uptakes and a Hot Common Tunnel, and Associated Systems and Methods.
U.S. Appl. No. 13/730,796, filed Dec. 28, 2012, now U.S. Pat. No. 10,883,051, titled Methods and Systems for Improved Coke Quenching.
U.S. Appl. No. 17/140,564, filed Jan. 4, 2021, titled Methods and Systems for Improved Coke Quenching.
U.S. Appl. No. 13/730,598, filed Dec. 28, 2012, now U.S. Pat. No. 9,238,778, titled Systems and Methods for Improving Quenched Coke Recovery.
U.S. Appl. No. 14/952,267, filed Nov. 25, 2015, now U.S. Pat. No. 9,862,888, titled Systems and Methods for Improving Quenched Coke Recovery.
U.S. Appl. No. 15/830,320, filed Dec. 4, 2017, now U.S. Pat. No. 10,323,192, titled Systems and Methods for Improving Quenched Coke Recovery.
U.S. Appl. No. 13/730,735, filed Dec. 28, 2012, now U.S. Pat. No. 9,273,249, titled Systems and Methods for Controlling Air Distribution in a Coke Oven.
U.S. Appl. No. 14/655,013, filed Jun. 23, 2015, now U.S. Pat. No. 11,142,699, titled Vent Stack Lids and Associated Systems and Methods.
U.S. Appl. No. 17/471,491, filed Sep. 10, 2021, now U.S. Pat. No. 11,142,699, titled Vent Stack Lids and Associated Systems and Methods.
U.S. Appl. No. 13/843,166, now U.S. Pat. No. 9,273,250, filed Mar. 15, 2013, titled Methods and Systems for Improved Quench Tower Design.
U.S. Appl. No. 15/014,547, filed Feb. 3, 2016, now, U.S. Pat. No. 10,927,303, titled Methods for Improved Quench Tower Design.
U.S. Appl. No. 17/155,818, filed Jan. 22, 2021, titled Methods and Systems for Improved Quench Tower Design.
U.S. Appl. No. 14/655,003, filed Jun. 23, 2015, titled Systems and Methods for Maintaining a Hot Car in a Coke Plant.
U.S. Appl. No. 16/897,957, filed Jun. 10, 2020, titled Systems and Methods for Maintaining a Hot Car in a Coke Plant.
U.S. Appl. No. 13/829,588, now U.S. Pat. No. 9,193,915, filed Mar. 14, 2013, titled Horizontal Heat Recovery Coke Ovens Having Monolith Crowns.
U.S. Appl. No. 15/322,176, filed Dec. 27, 2016, now U.S. Pat. No. 10,526,541, titled Horizontal Heat Recovery Coke Ovens Having Monolith Crowns.
U.S. Appl. No. 15/511,036, filed Mar. 14, 2017, now U.S. Pat. No. 10,968,383, titled Coke Ovens Having Monolith Component Construction.
U.S. Appl. No. 16/704,689, filed Dec. 5, 2019, titled Horizontal Heat Recovery Coke Ovens Having Monolith Crowns.
U.S. Appl. No. 17/190,720, filed Mar. 3, 2021, titled Coke Ovens Having Monolith Component Construction.
U.S. Appl. No. 13/589,009, filed Aug. 17, 2012, titled Automatic Draft Control System for Coke Plants.
U.S. Appl. No. 15/139,568, filed Apr. 27, 2016, now U.S. Pat. No. 10,947,455, titled Automatic Draft Control System for Coke Plants.
U.S. Appl. No. 17/176,391, filed Feb. 16, 2021, titled Automatic Draft Control System for Coke Plants.
U.S. Appl. No. 13/588,996, now U.S. Pat. No. 9,243,186, filed Aug. 17, 2012, titled Coke Plant Including Exhaust Gas Sharing.
U.S. Appl. No. 14/959,450, filed Dec. 4, 2015, now U.S. Pat. No. 10,041,002, titled Coke Plant Including Exhaust Gas Sharing, now U.S. Pat. No. 10,041,002.
U.S. Appl. No. 16/047,198, filed Jul. 27, 2018, now U.S. Pat. No. 10,611,965, titled Coke Plant Including Exhaust Gas Sharing.
U.S. Appl. No. 16/828,448, filed Mar. 24, 2020, titled Coke Plant Including Exhaust Gas Sharing.
U.S. Appl. No. 13/589,004, now U.S. Pat. No. 9,249,357, filed Aug. 17, 2012, titled Method and Apparatus for Volatile Matter Sharing in Stamp-Charged Coke Ovens.
U.S. Appl. No. 13/730,673, filed Dec. 28, 2012, titled Exhaust Flow Modifier, Duct Intersection Incorporating the Same, and Methods Therefor.
U.S. Appl. No. 15/281,891, filed Sep. 30, 2016, now U.S. Pat. No. 10,975,309, titled Exhaust Flow Modifier, Duck Intersection Incorporating the Same, and Methods Therefor.
U.S. Appl. No. 17/191,119, filed Mar. 3, 3021, titled Exhaust Flow Modifier, Duck Intersection Incorporating the Same, and Methods Therefor.
U.S. Appl. No. 13/598,394, now U.S. Pat. No. 9,169,439, filed Aug. 29, 2012, titled Method and Apparatus for Testing Coal Coking Properties.
U.S. Appl. No. 14/865,581, filed Sep. 25, 2015, now U.S. Pat. No. 10,053,627, titled Method and Apparatus for Testing Coal Coking Properties, now U.S. Pat. No. 10,053,627.
U.S. Appl. No. 14/839,384, filed Aug. 28, 2015, titled Coke Oven Charging System.
U.S. Appl. No. 15/443,246, now U.S. Pat. No. 9,976,089, filed Feb. 27, 2017, titled Coke Oven Charging System.
U.S. Appl. No. 14/587,670, filed Dec. 31, 2014, now U.S. Pat. No. 10,619,101, titled Methods for Decarbonizing Coking Ovens, and Associated Systems and Devices.
U.S. Appl. No. 16/845,530, filed Apr. 10, 2020, titled Methods for Decarbonizing Coking Ovens, and Associated Systems and Devices.
U.S. Appl. No. 14/984,489, filed Dec. 30, 2015, now U.S. Pat. No. 10,975,310, titled Multi-Modal Beds of Coking Material.
U.S. Appl. No. 14/983,837, filed Dec. 30, 2015, now U.S. Pat. No. 10,968,395, titled Multi-Modal Beds of Coking Material.
U.S. Appl. No. 14/986,281, filed Dec. 31, 2015, now U.S. Pat. No. 10,975,311, titled Multi-Modal Beds of Coking Material.
U.S. Appl. No. 17/222,886, filed Apr. 12, 2021, titled Multi-Modal Beds of Coking Material.
U.S. Appl. No. 14/987,625, filed Jan. 4, 2016, now U.S. Pat. No. 11,060,032, titled Integrated Coke Plant Automation and Optimization Using Advanced Control and Optimization Techniques.
U.S. Appl. No. 17/172,476, filed Feb. 10, 2021, titled Integrated Coke Plant Automation and Optimization Using Advanced Control and Optimization Techniques.
U.S. Appl. No. 14/839,493, filed Aug. 28, 2015, now U.S. Pat. No. 10,233,392, titled Method and System for Optimizing Coke Plant Operation and Output.
U.S. Appl. No. 16/251,352, filed Jan. 18, 2019, now U.S. Pat. No. 11,053,444, titled Method and System for Optimizing Coke Plant Operation and Output.
U.S. Appl. No. 17/363,701, filed Jun. 30, 2021, titled Method and System for Optimizing Coke Plant Operation and Output.
U.S. Appl. No. 14/839,551, filed Aug. 28, 2015, now U.S. Pat. No. 10,308,876, titled Burn Profiles for Coke Operations.
U.S. Appl. No. 16/428,014, filed May 31, 2019, now U.S. Pat. No. 10,920,148, titled Improved Burn Profiles for Coke Operations.
U.S. Appl. No. 17/155,219, filed Jan. 22, 2021, titled Improved Burn Profiles for Coke Operations.
U.S. Appl. No. 14/839,588, filed Aug. 28, 2015, now U.S. Pat. No. 9,708,542, titled Method and System for Optimizing Coke Plant Operation and Output.
U.S. Appl. No. 15/392,942, filed Dec. 28, 2016, now U.S. Pat. No. 10,526,542, titled Method and System for Dynamically Charging a Coke Oven.
U.S. Appl. No. 16/735,103, now U.S. Pat. No. 11,214,739, filed Jan. 6, 2020, titled Method and System for Dynamically Charging a Coke Oven.
U.S. Appl. No. 17/526,477, filed Jan. 6, 2020, titled Method and System for Dynamically Charging a Coke Oven.
U.S. Appl. No. 15/614,525, filed Jun. 5, 2017, titled Methods and Systems for Automatically Generating a Remedial Action in an Industrial Facility.
U.S. Appl. No. 15/987,860, filed May 23, 2018, now U.S. Pat. No. 10,851,306, titled System and Method for Repairing a Coke Oven.
U.S. Appl. No. 17/076,563, filed Oct. 21, 2020, now U.S. Pat. No. 11,186,778, titled System and Method for Repairing a Coke Oven.

(56) References Cited

OTHER PUBLICATIONS

U.S. Appl. No. 17/521,061, filed Nov. 8, 2021, titled System and Method for Repairing a Coke Oven.
U.S. Appl. No. 17/135,483, filed Dec. 28, 2020, titled Oven Health Optimization Systems and Methods.
U.S. Appl. No. 16/729,053, filed Dec. 27, 2019, titled Oven Uptakes.
U.S. Appl. No. 16/729,036, filed Dec. 27, 2019, now U.S. Pat. No. 11,365,355, titled Systems and Methods for Treating a Surface of a Coke Plant.
U.S. Appl. No. 17/747,708, filed May 18, 2022, titled Systems and Methods for Treating a Surface of a Coke Plant.
U.S. Appl. No. 16/729,201, filed Dec. 27, 2019, titled Gaseous Tracer Leak Detection.
U.S. Appl. No. 16/729,122, filed Dec. 27, 2019, titled Methods and Systems for Providing Corrosion Resistant Surfaces in Contaminant Treatment Systems.
U.S. Appl. No. 16/729,068, filed Dec. 27, 2019, titled Systems and Methods for Utilizing Flue Gas.
U.S. Appl. No. 16/729,129, filed Dec. 27, 2019, now U.S. Pat. No. 11,008,518, titled Coke Plant Tunnel Repair and Flexible Joints.
U.S. Appl. No. 17/320,343, filed May 14, 2021, titled Coke Plant Tunnel Repair and Flexible Joints.
U.S. Appl. No. 16/729,170, now U.S. Pat. No. 11, 193,069, filed Dec. 27, 2019, titled Coke Plant Tunnel Repair and Anchor Distribution.
U.S. Appl. No. 17/532,058, filed Nov. 22, 2021, titled Coke Plant Tunnel Repair and Anchor Distribution.
U.S. Appl. No. 16/729, 157, filed Dec. 27, 2019, now U.S. Pat. No. 11,071,935, titled Particulate Detection for Industrial Facilities, and Associated Systems and Methods.
U.S. Appl. No. 16/729,057, filed Dec. 27, 2019, now U.S. Pat. No. 11,021,655, titled Decarbonization of Coke Ovens and Associated Systems and Methods.
U.S. Appl. No. 17/321,857, filed May 17, 2021, titled Decarbonization of Coke Ovens and Associated Systems and Methods.
U.S. Appl. No. 16/729,212, filed Dec. 27, 2019, now U.S. Pat. No. 11,261,381, titled Heat Recovery Oven Foundation.
U.S. Appl. No. 17/584,672, filed Jan. 26, 2022, titled Heat Recovery Oven Foundation.
U.S. Appl. No. 16/729,219, now U.S. Pat. No. 11,098,252, filed Dec. 27, 2019, titled Spring-Loaded Heat Recovery Oven System and Method.
U.S. Appl. No. 17/388,874, filed Jul. 29, 2021, titled Spring-Loaded Oven System and Method.
U.S. Appl. No. 17/306,895, filed May 3, 2021, titled High- Quality Coke Products.
U.S. Appl. No. 18/168,142, filed Feb. 13, 2023, Quanci et al.
U.S. Appl. No. 18/313,647, filed May 8, 2023, Quanci et al.
U.S. Appl. No. 18/321,530, filed May 22, 2023, Quanci et al.
U.S. Appl. No. 18/363,465, filed Aug. 1, 2023, Quanci et al.
U.S. Appl. No. 18/363,508, filed Aug. 1, 2023, Choi et al.
U.S. Appl. No. 18/366,244, filed Aug. 7, 2023, Quanci et al.
"Asbestos", Virginia Department of Health, https://www.vdh.virginia.gov/environmental-health/public-health-toxicology/asbestos/, updated 2023, 2 pages.
"Ceramic fibers wool—to 1,300° C.", gTeek, Dec. 29, 2017 (date obtained from google search tools), https://www.gteek.com/ceramic-fibers-wool-to1-300-%C2%BOC, 15 pages.
De Cordova, et al. "Coke oven life prolongation—A multidisciplinary approach." 10.5151/2594-357X-2610 (2015) 12 pages.
"How Glass Is Made," Corning, https://www.corning.com/worldwide/en/innovation/materials-science/glass/how-glass-made.html, 2 pages.
Kusiorowski, et al., "Thermal decomposition of different types of absestos, "Journal of Thermal Analysis and Calorimetry • Feb. 2012, 109, 693-704 (2012).
Lin, Rongying et al., "Study on the synergistic effect of calcium and aluminum on improving ash fusion temperature of semi-coke," International Journal of Coal Preparation and Utilization, May 31, 2019 (published online), vol. 42, No. 3, pp. 556-564.
Lipunov, et al. "Diagnostics of the Heating System and Lining of Coke Ovens," Coke and Chemistry, 2014, Vopl. 57, No. 12, pp. 489-492.
Tiwari, et al., "A novel technique for assessing the coking potential of coals/cole blends for non-recovery coke making process," Fuel, vol. 107, May 2013, pp. 615-622.
Schlueter, R. "What's so good about coke made from coal, Aug. 29, 2016," Belleview News—Democrat, Rschuleter@bnd.com; 4 pages.
Seal School, Coal v. CokelFast differences and Comparison. Viewable on YouTube (Year:2020).
U.S. Appl. No. 18/892,228, filed Sep. 20, 2024, Quanci et al.
U.S. Appl. No. 18/469,704, filed Sep. 19, 2023, Crum et al.
U.S. Appl. No. 18/473,135, filed Sep. 22, 2023, Quanci et al.
U.S. Appl. No. 18/473,143, filed Sep. 22, 2023, Quanci et al.
U.S. Appl. No. 18/483,019, filed Oct. 9, 2023, West et al.
U.S. Appl. No. 18/486,021, filed Oct. 12, 2023, Quanci et al.
U.S. Appl. No. 18/492,913, filed Oct. 24, 2023, Quanci et al.
U.S. Appl. No. 18/501,488, filed Nov. 3, 2023, Quanci et al.
U.S. Appl. No. 18/501,795, filed Nov. 3, 2023, Quanci et al.
U.S. Appl. No. 18/506,616, filed Nov. 10, 2023, Quanci et al.
U.S. Appl. No. 18/506,746, filed Nov. 10, 2023, Quanci et al.
U.S. Appl. No. 18/511,148, filed Nov. 16, 2023, Quanci et al.
U.S. Appl. No. 18/511,621, filed Nov. 16, 2023, Quanci et al.
U.S. Appl. No. 18/584,320, filed Feb. 22, 2024, West et al.
U.S. Appl. No. 18/586,236, filed Feb. 23, 2024, Quanci et al.
Item HT 56107 Briquette, 'H' Type Household or Domestic Use, SECV Brown Coal Mine, Yallourn, Victoria, circa 1925, Museums Victoria Collections, https://collections.museumsvictoria.com.au/items/2286568, published on Mar. 2, 2021; 3 pages.
Chaudhari, K., Cupola Furnace, engineersgalary.com Jan. 24, 2016; 4 pages.
Ishiwata, et al. "Effect of coke diameter and oxygen concentration of blast on cupola operation." ISIJ International, 2011, vol. 51, pp. 1353-1359.
Ivanova, V. A. "Analysis of the requirements for foundry coke." IOP Conference Series: Materials Science and Engineering, 2020, vol. 986, pp. 1-6.
Office of the Federal Register, National Archives and Records Administration. (Apr. 14, 2005). 70 FR 19992—National Emission Standards for Coke Oven Batteries. [Government]. Office of the Federal Register, National Archives and Records Administration. https://www.govinfo.gov/app/details/FR-2005-04-15/05-6942.
Pearson, D.E., "Influence of Geology on CSR (Coke Strength After Reaction with C02)," 2009, 8 pages.
Powell, et al. "Cupola Furnaces", ASM International, downloaded from http://dl.asminternational.org/handbooks/edited-volume/chapter-pdf/501030/a0005197.pdf; 9 pages.
Australian Examination Report No. 1 for Australian 2022270111; Date of Mailing: Dec. 4, 2023; 6 pages.
International Search Report and Written Opinion for PCT/US2022/027722; Date of Mailing: Aug. 17, 2022; 11 pages.
U.S. Appl. No. 17/459,380, now, U.S. Pat. No. 11,845,037, filed Jun. 5, 2018, titled Systems and Methods for Removing Mercury From Emissions.
U.S. Appl. No. 16/026,363, filed Jul. 3, 2018, now U.S. Pat. No. 11,008,517, titled Non-Perpendicular Connections Between Coke Oven Uptakes and a Hot Common Tunnel, and Associated Systems and Methods.
U.S. Appl. No. 17/140,564, filed Jan. 4, 2021, now U.S. Pat. No. 11,807,812, titled Methods and Systems for Improved Coke Quenching.
U.S. Appl. No. 17/471,491, filed Sep. 10, 2021, now U.S. Pat. No. 11,939,526, titled Vent Stack Lids and Associated Systems and Methods.
U.S. Appl. No. 13/843,166, filed Mar. 15, 2013, now U.S. Pat. No. 9,273,250, titled Methods and Systems for Improved Quench Tower Design.
U.S. Appl. No. 17/155,818, filed Jan. 22, 2021, now U.S. Pat. No. 11,746,296, titled Methods and Systems for Improved Quench Tower Design.
U.S. Appl. No. 14/655,003, filed Jun. 23, 2015, now U.S. Pat. No. 10,760,002, titled Systems and Methods for Maintaining a Hot Car in a Coke Plant.

(56) References Cited

OTHER PUBLICATIONS

U.S. Appl. No. 16/897,957, filed Jun. 10, 2020, now U.S. Pat. No. 11,359,145, titled Systems and Methods for Maintaining a Hot Car in a Coke Plant.
U.S. Appl. No. 13/829,588, filed Mar. 14, 2013, now U.S. Pat. No. 9,193,915, titled Horizontal Heat Recovery Coke Ovens Having Monolith Crowns.
U.S. Appl. No. 17/190,720, now U.S. Pat. No. 11,795,400, filed Mar. 3, 2021, titled Coke Ovens Having Monolith Component Construction.
U.S. Appl. No. 13/589,009, filed Aug. 17, 2012, now U.S. Pat. No. 9,359,554, titled Automatic Draft Control System for Coke Plants.
U.S. Appl. No. 17/176,391, now U.S. Pat. No. 11,692,138, filed Feb. 16, 2021, titled Automatic Draft Control System for Coke Plants.
U.S. Appl. No. 18/321,530, filed May 22, 2023, titled Automatic Draft Control System for Coke Plants.
U.S. Appl. No. 13/588,996, filed Aug. 17, 2012, now U.S. Pat. No. 9,243,186, titled Coke Plant Including Exhaust Gas Sharing.
U.S. Appl. No. 14/959,450, filed Dec. 4, 2015, now U.S. Pat. No. 10,041,002, titled Coke Plant Including Exhaust Gas Sharing.
U.S. Appl. No. 16/828,448, filed Mar. 24, 2020, now U.S. Pat. No. 11,441,077, titled Coke Plant Including Exhaust Gas Sharing.
U.S. Appl. No. 13/589,004, filed Aug. 17, 2012, now U.S. Pat. No. 9,249,357, titled Method and Apparatus for Volatile Matter Sharing in Stamp-Charged Coke Ovens.
U.S. Appl. No. 13/730,673, filed Dec. 28, 2012, now U.S. Pat. No. 9,476,547, titled Exhaust Flow Modifier, Duct Intersection Incorporating the Same, and Methods Therefor.
U.S. Appl. No. 13/598,394, filed Aug. 29, 2012, now U.S. Pat. No. 9,169,439, titled Method and Apparatus for Testing Coal Coking Properties.
U.S. Appl. No. 14/839,384, filed Aug. 28, 2015, now U.S. Pat. No. 9,580,656, titled Coke Oven Charging System.
U.S. Appl. No. 15/443,246, filed Feb. 27, 2017, now U.S. Pat. No. 9,976,089, titled Coke Oven Charging System.
U.S. Appl. No. 16/845,530, filed Apr. 10, 2020, now U.S. Pat. No. 11,359,146, titled Methods for Decarbonizing Coking Ovens, and Associated Systems and Devices.
U.S. Appl. No. 17/172,476, filed Feb. 10, 2021, now U.S. Pat. No. 11,788,012, titled Integrated Coke Plant Automation and Optimization Using Advanced Control and Optimization Techniques.
U.S. Appl. No. 17/155,719, filed Jan. 22, 2021, now U.S. Pat. No. 11,441,078, titled Improved Burn Profiles for Coke Operations.
U.S. Appl. No. 16/735,103, filed Jan. 6, 2020, now U.S. Pat. No. 11,214,739, titled Method and System for Dynamically Charging a Coke Oven.
U.S. Appl. No. 15/614,525, filed Jun. 5, 2017, now U.S. Pat. No. 11,508,230, titled Methods and Systems for Automatically Generating a Remedial Action in an Industrial Facility.
U.S. Appl. No. 18/047,916, filed Oct. 19, 2022, titled Methods and Systems for Automatically Generating a Remedial Action in an Industrial Facility.
U.S. Appl. No. 17/521,061, now U.S. Pat. No. 11,845,898, filed Nov. 8, 2021, titled System and Method for Repairing a Coke Oven.
U.S. Appl. No. 16/729,053, filed Dec. 27, 2019, now U.S. Pat. No. 11,760,937, titled Oven Uptakes.
U.S. Appl. No. 17/747,708, filed May 18, 2022, now U.S. Pat. No. 12,060,525, titled Systems and Methods for Treating a Surface of a Coke Plant.
U.S. Appl. No. 18/770,264, filed Jul. 11, 2024, titled Systems and Methods for Treating a Surface of a Coke Plant.
U.S. Appl. No. 16/729,122, filed Dec. 27, 2019, now U.S. Pat. No. 11,395,989, titled Methods and Systems for Providing Corrosion Resistant Surfaces in Contaminant Treatment Systems.
U.S. Appl. No. 17/843,164, filed Jun. 17, 2022, now U.S. Pat. No. 11,819,802, titled Methods and Systems for Providing Corrosion Resistant Surfaces in Contaminant Treatment Systems.
U.S. Appl. No. 16/729,068, filed Dec. 27, 2019, now U.S. Pat. No. 11,486,572, titled Systems and Methods for Utilizing Flue Gas.
U.S. Appl. No. 17/947,520, filed Sep. 19, 2022, titled Systems and Methods for Utilizing Flue Gas.
U.S. Appl. No. 17/320,343, filed May 14, 2021, now U.S. Pat. No. 11,597,881, titled Coke Plant Tunnel Repair and Flexible Joints.
U.S. Appl. No. 18/168,142, filed Feb. 13, 2023, titled Coke Plant Tunnel Repair and Flexible Joints.
U.S. Appl. No. 17/532,058, now U.S. Pat. No. 11,505,747, filed Nov. 22, 2021, titled Coke Plant Tunnel Repair and Anchor Distribution.
U.S. Appl. No. 17/967,615, filed Oct. 17, 2022, titled Coke Plant Tunnel Repair and Anchor Distribution.
U.S. Appl. No. 17/321,857, filed May 17, 2021, now U.S. Pat. No. 11,643,602, titled Decarbonization of Coke Ovens and Associated Systems and Methods.
U.S. Appl. No. 18/313,622, filed May 8, 2023, titled Decarbonization of Coke Ovens and Associated Systems and Methods.
U.S. Appl. No. 17/584,672, now U.S. Pat. No. 11,845,897, filed Jan. 26, 2022, titled Heat Recovery Oven Foundation.
U.S. Appl. No. 18/492,913, filed Oct. 24, 2023, titled Heat Recovery Oven Foundation.
U.S. Appl. No. 17/388,874, filed Jul. 29, 2021, now, U.S. Pat. No. 11,680,208, titled Spring-Loaded Heat Recovery Oven System and Method.
U.S. Appl. No. 17/306,895, now U.S. Pat. No. 11,767,482, filed May 3, 2021, now U.S. Pat. No. 11,767,482, titled High-Quality Coke Products.
U.S. Appl. No. 18/363,465, filed Aug. 1, 2023, titled High- Quality Coke Products.
U.S. Appl. No. 18/466,549, filed Sep. 13, 2023, titled High-Quality Coke Products.
U.S. Appl. No. 18/793,631, filed Aug. 2, 2024, titled High-Quality Coke Products.
U.S. Appl. No. 18/501,488, filed Nov. 3, 2023, titled Coal Blends, Foundry Coke Products, and Associated Systems, Devices, and Methods.
U.S. Appl. No. 18/501,795, filed Nov. 3, 2023, titled Coal Blends, Foundry Coke Products, and Associated Systems, Devices, and Methods.
U.S. Appl. No. 18/052,739, filed Nov. 4, 2022, now U.S. Pat. No. 11,946,108, titled Foundry Coke Products and Associated Processing Methods Via Cupolas.
U.S. Appl. No. 18/586,236, filed Feb. 23, 2024, titled Foundry Coke Products and Associated Processing Methods Via Cupolas.
U.S. Appl. No. 18/052,760, filed Nov. 2, 2022, now U.S. Pat. No. 11,851,724, titled Foundry Coke Products, and Associated Systems, Devices, and Methods.
U.S. Appl. No. 18/506,746, filed Nov. 10, 2023, titled Foundry Coke Products, and Associated Systems, Devices, and Methods.
U.S. Appl. No. 18/892,228, filed Sep. 20, 2024, titled Foundry Coke Products, and Associated Systems, Devices, and Methods.
U.S. Appl. No. 18/511,148, filed Nov. 16, 2023, titled Products Comprising Char and Carbon, and Associated Systems, Devices, and Methods.
U.S. Appl. No. 18/511,621, filed Nov. 16, 2023, titled Pelletized Products and Associated Systems, Devices, and Methods.
U.S. Appl. No. 18/506,616, filed Nov. 10, 2023, titled Systems and Methods for Removing Mercury From Emissions.
U.S. Appl. No. 18/473,143, filed Sep. 22, 2023, titled Methods and Systems for Improved Coke Quenching.
U.S. Appl. No. 17/471,491, filed Sep. 10, 2021, now U.S. Pat. No. 11,939,526 (Mar. 26, 2024), titled Vent Stack Lids and Associated Systems and Methods.
U.S. Appl. No. 18/584,320, filed Feb. 22, 2024, titled Vent Stack Lids and Associated Systems and Methods.
U.S. Appl. No. 18/483,019, filed Oct. 9, 2023, titled Coke Ovens Having Monolith Component Construction.
U.S. Appl. No. 15/281,891, filed Sep. 30, 2016, now U.S. Pat. No. 10,975,309, titled Exhaust Flow Modifier, Duck Therefor.
U.S. Appl. No. 17/172,476, filed Feb. 10, 2021, now U.S. Patent No. 11,788,012, titled Integrated Coke Plant Automation and Optimization Using Advanced Control and Optimization Techniques.

(56) References Cited

OTHER PUBLICATIONS

U.S. Appl. No. 18/473,143, filed Sep. 22, 2023, titled Integrated Coke Plant Automation and Optimization Using Advanced Control and Optimization Techniques.
U.S. Appl. No. 18/469,704, filed Sep. 19, 2023, titled System and Method for Repairing a Coke Oven.
U.S. Appl. No. 18/486,021, filed Oct. 12, 2023, titled Methods and Systems for Providing Corrosion Resistant Surfaces in Contaminant Treatment Systems.
U.S. Appl. No. 18/770,274, filed Jul. 11, 2024, Quanci et al.
U.S. Appl. No. 18/793,631, filed Aug. 2, 2024, Quanci et al.
Japanese Notice of Rejection for Japanese Application No. 2023-568008; Date of Maling: Jun. 18, 2024; 7 pages.
Korean Office Action for Korean Application No. 10-2023-7041644; Date of Mailing: Jun. 26, 2024; 7 pages.
U.S. Appl. No. 07/587,742, filed Sep. 25, 1990, now U.S. Pat. No. 5,114,542, titled Nonrecovery Coke Oven Battery and Method of Operation.
U.S. Appl. No. 07/878,904, filed May 6, 1992, now U.S. Pat. No. 5,318,671, titled Method of Operation of Nonrecovery Coke Oven Battery.
U.S. Appl. No. 09/783,195, filed Feb. 14, 2001, now U.S. Pat. No. 6,596,128, titled Coke Oven Flue Gas Sharing.
U.S. Appl. No. 07/886,804, filed May 22, 1992, now U.S. Pat. No. 5,228,955, titled High Strength Coke Oven Wall Having Gas Flues Therein.
U.S. Appl. No. 08/059,673, filed May 12, 1993, now U.S. Pat. No. 5,447,606, titled Method of and Apparatus for Capturing Coke Oven Charging Emissions.
U.S. Appl. No. 08/914,140, filed Aug. 19, 1997, now U.S. Pat. No. 5,928,476, titled Nonrecovery Coke Oven Door.
U.S. Appl. No. 09/680,187, filed Oct. 5, 2000, now U.S. Pat. No. 6,290,494, titled Method and Apparatus for Coal Coking.
U.S. Appl. No. 10/933,866, filed Sep. 3, 2004, now U.S. Pat. No. 7,331,298, titled Coke Oven Rotary Wedge Door Latch.
U.S. Appl. No. 11/424,566, filed Jun. 16, 2006, now U.S. Pat. No. 7,497,930, titled Method and Apparatus for Compacting Coal for a Coal Coking Process.
U.S. Appl. No. 12/405,269, filed Mar. 17, 2009, now U.S. Pat. No. 7,998,316, titled Flat Push Coke Wet Quenching Apparatus and Process.
U.S. Appl. No. 13/205,960, filed Aug. 9, 2011, now U.S. Pat. No. 9,321,965, titled Flat Push Coke Wet Quenching Apparatus and Process.
U.S. Appl. No. 11/367,236, filed Mar. 3, 2006, now U.S. Pat. No. 8,152,970, titled Method and Apparatus for Producing Coke.
U.S. Appl. No. 12/403,391, filed Mar. 13, 2009, now U.S. Pat. No. 8,172,930, titled Cleanable in Situ Spark Arrestor.
U.S. Appl. No. 14/655,204, now U.S. Pat. No. 10,016,714, filed on Jun. 24, 2015, titled Systems and Methods for Removing Mercury From Emissions.
U.S. Appl. No. 16/000,516, now U.S. Pat. No. 11,117,087, filed on Jun. 5, 2018, titled Systems and Methods for Removing Mercury From Emissions.
U.S. Appl. No. 17/459,380, now, U.S. Pat. No. 11,845,037, filed on Jun. 5, 2018, titled Systems and Methods for Removing Mercury From Emissions.
U.S. Appl. No. 18/321,530, filed May 22, 2023, now U.S. Pat. No. 12,195,671, titled Automatic Draft Control System for Coke Plants.
U.S. Appl. No. 18/977,609, filed Dec. 11, 2024, titled Automatic Draft Control System for Coke Plants.
U.S. Appl. No. 18/047,916, filed Oct. 19, 2022, now U.S. Pat. No. 12,190,701, titled Methods and Systems for Automatically Generating a Remedial Action in an Industrial Facility.
U.S. Appl. No. 18/958,671, filed Nov. 25, 2024, titled Methods and Systems for Automatically Generating a Remedial Action in an Industrial Facility.
U.S. Appl. No. 17/135,483, filed Dec. 28, 2020, now U.S. Pat. No. 12,227,699, titled Oven Health Optimization Systems and Methods.
U.S. Appl. No. 19/054,358, filed Feb. 14, 2025, titled Oven Health Optimization Systems and Methods.
U.S. Appl. No. 18/793,631, filed Aug. 2, 2024, now U.S. Pat. No. 12,215,289, titled High-Quality Coke Products.
U.S. Appl. No. 18/971,912, filed Dec. 6, 2024, titled Systems for Filtering Fines From Coke Products and Associated Devices and Methods.
U.S. Appl. No. 18/501,488, filed Nov. 3, 2023, now U.S. Pat. No. 12,110,458, titled Coal Blends, Foundry Coke Products, and Associated Systems, Devices, and Methods.
U.S. Appl. No. 18/954,859, filed Nov. 21, 2024, titled Systems, Devices and Methods for Screening Industrial Products.
U.S. Appl. No. 18/954,882, filed Nov. 21, 2024, titled Flat Push Hot Car for Foundry Coke and Associated Systems and Methods.
U.S. Appl. No. 18/955,181, filed Nov. 21, 2024, titled Emissions Recovery Systems for Industrial Facilities, and Associated Assemblies and Methods.
U.S. Appl. No. 18/972,005, filed Dec. 6, 2024, titled Milling Systems and Methods for Producing Materials With a Particular Particle Size Distribution.
U.S. Appl. No. 18/971,647, filed Dec. 6, 2024, titled Systems and Methods for Capturing Greenhouse Gases From Coke Production Facilities.
U.S. Appl. No. 18/949,426, filed Nov. 15, 2024, titled Pelletized Products and Associated Systems, Devices and Methods.
U.S. Appl. No. 17/459,380, filed Aug. 27, 2021, Quanci et al.
U.S. Appl. No. 17/526,477, filed Nov. 15, 2021, Quanci et al.
U.S. Appl. No. 17/532,058, filed Nov. 22, 2021, Quanci et al.
U.S. Appl. No. 17/584,672, filed Jan. 26, 2022, Quanci et al.
U.S. Appl. No. 17/747,708, filed May 18, 2022, Quanci et al.
U.S. Appl. No. 17/843,164, filed Jun. 17, 2022, Quanci et al.
ASTM D5341-99(2010)e1, Standard Test Method for Measuring Coke Reactivity Index (CRI) and Coke Strength After Reaction (CSR), ASTM International, West Conshohocken, PA, 2010.
Astrom, et al., "Feedback Systems: An Introduction for Scientists and Engineers," Sep. 16, 2006, available on line at http://people/duke.edu/-hpgavin/SystemID/References/Astrom-Feedback-2006.pdf ; 404 pages.
Basset et al., "Calculation of steady flow pressure loss coefficients for pipe junctions," Proc Instn Mech Engrs., vol. 215, Part C, p. 861-881 IMechIE 2001.
Beckman et al., "Possibilities and limits of cutting back coking plant output," Stahl Und Eisen, Verlag Stahleisen, Dusseldorf, DE, vol. 130, No. 8, Aug. 16, 2010, pp. 57-67.
Bloom, et al., "Modular cast block—The future of coke oven repairs," Iron & Steel Technol, AIST, Warrendale, PA, vol. 4, No. 3, Mar. 1, 2007, pp. 61-64.
Boyes, Walt. (2003), Instrumentation Reference Book (3rd Edition)—34.7.4.6 Infrared and Thermal Cameras, Elsevier. Online version available at: https://app.knovel.com/hotlink/pdf/id:kt004QMGV6/instrumentation-reference-2/ditigal-video.
Clean coke process: process development studies by USS Engineers and Consultants, Inc., Wisconsin Tech Search, request date Oct. 5, 2011, 17 pages.
"Conveyor Chain Designer Guild", Mar. 27, 2014 (date obtained from wayback machine), Renold.com, Section 4, available online at: http://www.renold/com/upload/renoldswitzerland/conveyor_chain_-_designer_guide.pdf.
Costa, et al., "Edge Effects on the Flow Characteristics in a 90 deg Tee Junction," Transactions of the ASME, Nov. 2006, vol. 128, pp. 1204-1217.
Crelling, et al., "Effects of Weathered Coal on Coking Properties and Coke Quality", Fuel, 1979, vol. 58, Issue 7, pp. 542-546.
Database WPI, Week 199115, Thomson Scientific, Lond, GB; AN 1991-107552.
Diez, et al., "Coal for Metallurgical Coke Production: Predictions of Coke Quality and Future Requirements for Cokemaking", International Journal of Coal Geology, 2002, vol. 50, Issue 1-4, pp. 389-412.
Industrial Furnace Design Handbook, Editor-in-Chief: First Design Institute of First Ministry of Machinery Industry, Beijing: Mechanical Industry Press, pp. 180-183, Oct. 1981.

(56) References Cited

OTHER PUBLICATIONS

Joseph, B., "A tutorial on inferential control and its applications," Proceedings of the 1999 American Control Conference (Cat. No. 99CH36251), San Diego, CA, 1999, pp. 3106-3118 vol. 5.
Kerlin, Thomas (1999), Practical Thermocouple Thermometry—1.1 The Thermocouple. ISA. Online version available at https://app.knovel.com/pdf/id:kt007XPTM3/practical-thermocouple/the-thermocouple.
Kochanski et al., "Overview of Uhde Heat Recovery Cokemaking Technology," AISTech Iron and Steel Technology Conference Proceedings, Association for Iron and Steel Technology, U.S., vol. 1, Jan. 1, 2005, pp. 25-32.
Knoerzer et al. "Jewell-Thompson Non-Recovery Cokemaking", Steel Times, Fuel & Metallurgical Journals Ltd. London, GB, vol. 221, No. 4, Apr. 1, 1993, pp. 172-173,184.
Madias, et al., "A review on stamped charging of coals" (2013). Available at https://www.researchgate.net/publication/263887759_A_review_on_stamped_charging_of_coals.
Metallurgical Coke MSDS, ArcelorMittal, May 30, 2011, available online at http://dofasco.arcelormittal.com/-/media/Files/A/Arcelormittal-Canada/material-safety/metallurgical-coke.pdf.
"Middletown Coke Company HRSG Maintenance BACT Analysis Option 1—Individual Spray Quenches Sun Heat Recovery Coke Facility Process Flow Diagram Middletown Coke Company 100 Oven Case #1-24.5 VM", (Sep. 1, 2009), URL: http:/web.archive.org/web/20090901042738/http://epa.ohio.gov/portals/27/transfer/ptiApplication/mcc/new/262504.pdf, (Feb. 12, 2016), XP055249803 [X] 1-13 p. 7 pp. 8-11.
Practical Technical Manual of Refractories, Baoyu Hu, etc., Beijing: Metallurgical Industry Press, Chapter 6; 2004, 6-30.
Refractories for Ironmaking and Steelmaking: A History of Battles over High Temperatures; Kyoshi Sugita (Japan, Shaolin Zhang), 1995, p. 160, 2004, 2-29.
Rose, Harold J., "The Selection of Coals for the Manufacture of Coke," American Institute of Mining and Metallurgical Engineers, Feb. 1926, 8 pages.
Waddell, et al., "Heat-Recovery Cokemaking Presentation," Jan. 1999, pp. 1-25.
Walker D N et al, "Sun Coke Company's heat recovery cokemaking technology high coke quality and low environmental impact", Revue De Metallurgie—Cahiers D'informations Techniques, Revue De Metallurgie. Paris, FR, (Mar. 1, 2003), vol. 100, No. 3, ISSN 0035-1563, p. 23.
Westbrook, "Heat-Recovery Cokemaking at Sun Coke," AISE Steel Technology, Pittsburg, PA, vol. 76, No. 1, Jan. 1999, pp. 25-28.
"What is dead-band control," forum post by user "wireaddict" on AllAboutCircuits.com message board, Feb. 8, 2007, accessed Oct. 24, 2018, at https:/forum.allaboutcircuits.com/threads/what-is-dead-band-control.4728/; 8 pages.
Yu et al., "Coke Oven Production Technology," Lianoning Science and Technology Press, first edition, Apr. 2014, pp. 356-358.
"Resources and Utilization of Coking Coal in China," Mingxin Shen ed., Chemical Industry Press, first edition, Jan. 2007, pp. 242-243, 247.
Chen, et al., "Influence of biomass addition on Jincheng coal ash fusion temperatures," Fuel, vol. 160, 2015, pp. 614-620, ISSN 0016-2361,https://doi.org/10.1016/j.fuel.2015.08.024.
High Quality Qualified Customized Low Ash Sulfur Foundry Coke, Rizhaq Hengqiao Carbon Co., Ltd. 2012 (Year: 2021).
Li, Y., et al. "Assessment on the effect of unburned pulverized coal on the properties of coke in blast furnace." Ironmaking & Steelmaking. 2020;47(3):228-237.
Ratanakuakangwan, S. "Comparison of metallurgical coke and ignite coke for power generation in Thailand," IOP Conference Series: Material Science Engineering, vol. 191, 012048, 2017, pp. 1-6.
Rejdak, et al., ""A. Stamp-Charged Coke-Making Technology—The Effect of Charge Density and theAddition of Semi-Soft Coals on the Structural, Textural and Quality Parameters of Coke. Energies 2021, 14,3401. https://doi.org/10.3390/en14123401.
Rejdak, et al., "Use of Alternative Raw Materials in Coke-Making: New Insights in the Use of Lignites for Blast Furnace Coke Production," Energies. 2020; 13(11):2832. https://doi.org/10.3390/en13112832.
Extended European Search Report for European Application No. 22799533.9; Date of Mailing: May 20, 2025; 6 pages.

* cited by examiner

| ρ (bulk Density) lb/ft3 | bottom screen size (in) 1 | 2 | 3 | 3.5 | 4 | 5 | 6 |
|---|---|---|---|---|---|---|---|
| | Rh (Hydraulic Radius) | | | | | | |
| 25 | 1.27 | 1.64 | 1.98 | 2.15 | 2.32 | 2.66 | 2.99 |
| 26 | 1.18 | 1.53 | 1.85 | 2.01 | 2.17 | 2.48 | 2.79 |
| 27 | 1.11 | 1.43 | 1.73 | 1.88 | 2.03 | 2.32 | 2.61 |
| 28 | 1.04 | 1.33 | 1.62 | 1.76 | 1.89 | 2.17 | 2.44 |
| 29 | 0.97 | 1.25 | 1.51 | 1.64 | 1.77 | 2.03 | 2.28 |
| 30 | 0.91 | 1.17 | 1.42 | 1.54 | 1.66 | 1.90 | 2.13 |
| 31 | 0.85 | 1.09 | 1.32 | 1.44 | 1.55 | 1.77 | 2.00 |
| 32 | 0.79 | 1.02 | 1.24 | 1.34 | 1.45 | 1.66 | 1.87 |
| 33 | 0.74 | 0.95 | 1.16 | 1.26 | 1.36 | 1.55 | 1.75 |
| 34 | 0.69 | 0.89 | 1.08 | 1.17 | 1.27 | 1.45 | 1.63 |
| 35 | 0.65 | 0.83 | 1.01 | 1.10 | 1.18 | 1.35 | 1.52 |

FOUNDRY COKE PRODUCTS, AND ASSOCIATED SYSTEMS AND METHODS

CROSS-REFERENCE TO RELATED APPLICATION(S)

This application claims priority to U.S. Provisional Patent Application No. 63/184,016 filed May 4, 2021, the disclosures of which are incorporated herein by reference in their entireties.

TECHNICAL FIELD

This disclosure relates to foundry coke products, and associated systems and methods for manufacturing thereof.

BACKGROUND

Coke is a solid carbon fuel and carbon source used to melt and reduce iron ore in the production of steel. Foundry coke has a large size relative to blast coke and is of exceptional quality, including relatively low impurities, and relatively high carbon content, strength, and stability. Foundry coke is used in foundry cupolas to melt iron and produce cast iron and ductile iron products. However, the production cost including the manufacturing cost, transportation cost, and environmental cost, for foundry coke is high. Therefore, there is a need in the art to improve the production process thereby to obtain high quality foundry coke at a higher yield and/or a lower cost. This application satisfies the need by providing a high-quality foundry coke with many unique and improved properties.

DETAILED DESCRIPTION

Figure 1A:
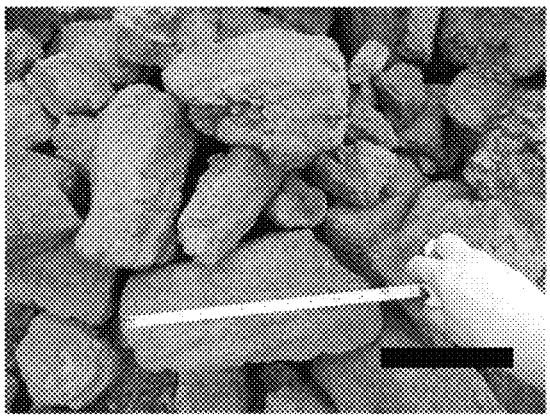
FIGS. 1A-1E shows the shape and size of various coke products, including FIGS. 1A and 1B showing foundry coke produced with 10% weight breeze in accordance with embodiments of the present technology, FIGS. 1C and 1D showing a first commercially available foundry coke made in the USA in a conventional byproduct plant (shown on a piece of 8.5"×11" paper for reference), and FIG. 1E showing a second commercially available foundry coke 2 made in a foreign country in a stamp charged byproduct plant (shown on a piece of 8.5"×11" paper for reference).
Figure 1B:
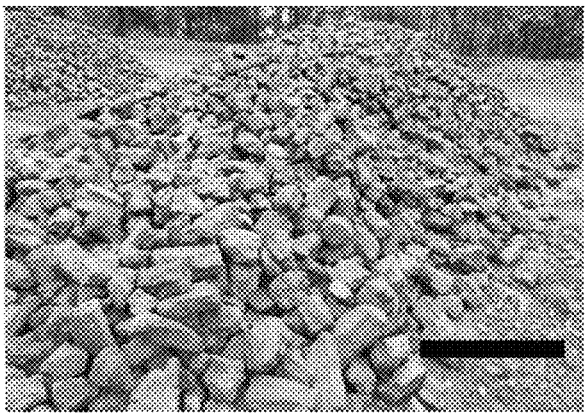
Figure 1C:
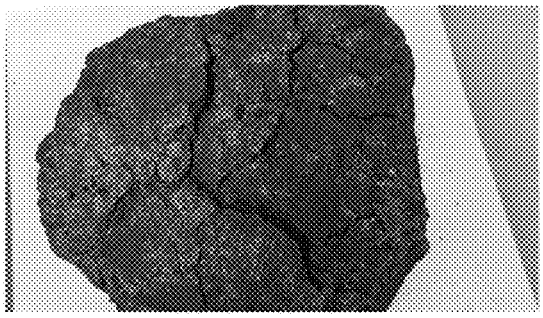
Figure 1D:
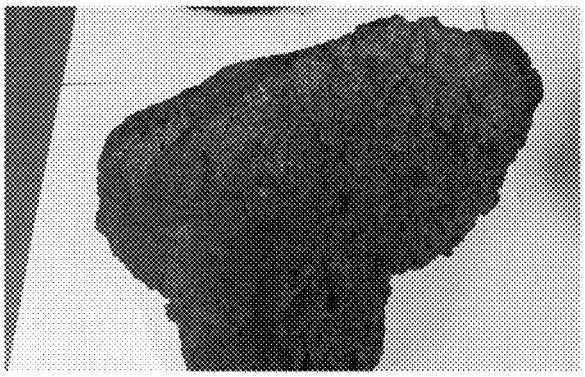
Figure 1E:
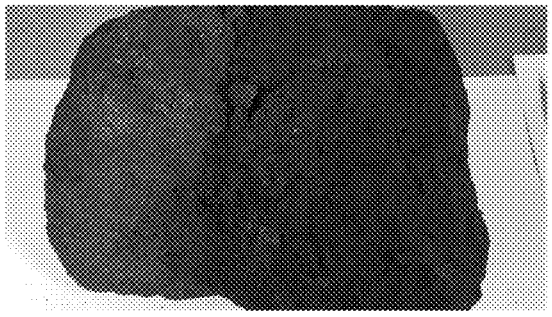

Disclosed herein are high quality coke products, including foundry coke products (referred to herein as "HD+™"), having unique properties. The coking process produces coke products of various sizes in different fractions. Conventionally, the coke products are classified based on size: foundry coke having a size of 4"+, egg (industrial coke) having a size of 2-4", stove having a size of 1-2" or 1-1.5", nut having a size of 0.5-1", and breeze having a size <0.5". According to aspects of the disclosure, the HD+™ coke products disclosed herein are produced using a predetermined coal blend including certain percentage of inerts and/or breeze in a horizontal oven (e.g., a heat recovery oven, a non-recovery oven, or a Thompson oven). The HD+™ coke products of the present technology can be classified based on different characteristics. In one example, the HD+™ coke products include foundry coke having a hydraulic diameter of 3.5"+, egg coke having a hydraulic diameter of 1.5-3.5", breeze having a hydraulic diameter of 0.5-1.5", and fines having a size of <0.5". All HD+™ breeze can be crushed to <⅜" and recycled to coal blend for the coking process, while fines may impose an issue with heat recovery (e.g., due to potential burn loss and high ash content). Therefore, some or all fines are recycled depending on the coking process. eggs are only recycled if additional breeze loading is required but mostly, eggs can be sold and used in sugar beet and mineral wool or rock wool production.

In certain embodiments, disclosed herein is HD+™ coke having a shape distinguishable from commercially available foundry coke, which has a substantially round shape and a diameter of at least 4". Unlike the conventional round-shaped, black foundry coke, the foundry coke disclosed herein has an oblong "finger-shape", as shown in FIG. 1. In certain embodiments, the HD+™ foundry coke has a high aspect ratio of length to width. For example, the HD+™ foundry coke has a length between 2" and 18", between 3" and 15", between 4" and 12", or between 4" and 10" and a width between 1.5" and 5", between 3" and 5", or between 2" and 4". In some embodiments, the HD+™ foundry coke has a length of at least 2", at least 3", at least 4", at least 5", at least 6", at least 7", at least 8", at least 9", at least 10", at least 11", at least 12", at least 13", at least 14", at least 15", at least 16", at least 17", or at least 18". In some embodiments, the HD+™ foundry coke has a width of at least 1.5", at least 2", at least 3", at least 4", or at least 5". In certain embodiments, the HD+™ foundry coke has a length:width ratio of at least 1.1, at least 1.5, at least 2.0, at least 2.5, at least 3.0, at least 3.5, at least 4.0, at least 4.5, at least 5.0, at least 5.5, at least 6.0, at least 6.5, at least 7.0, at least 7.5, at least 8.0, at least 8.5, at least 9.0, at least 9.5, or at least 10.0. In certain embodiments, at least 40%, at least 45%, at least 50%, at least 55%, at least 60%, at least 65%, at least 70%, at least 75%, at least 80%, at least 85%, at least 90%, at least 95%, at least 98%, or at least 99% of the HD+™ foundry coke falls within the ranges of the length, width, and the ratio of length:width disclosed above.

In certain embodiments, the HD+™ foundry coke has a hydraulic diameter (Dh) larger than its actual or effective diameter. By comparison, the conventional round-shaped foundry coke has a Dh equivalent to or approximately the same as the actual diameter. Dh is a function of hydraulic radius (Rh), which is defined as follows:

$$Rh = \frac{\varepsilon b Dp}{6(1-\varepsilon b)}$$

εb is the interparticle porosity of the coke bed, calculated as follows:

$$\varepsilon b = 1 - \frac{\rho b}{\rho a}$$

where ρb is the bulk density and ρa is the apparent density of coke.

Dp, which is the harmonic mean particle diameter, and represents the size of a uniform coke that has the same surface-to-volume ratio as a nonuniform coke, can be calculated as follows:

$$Dp = \frac{1}{\sum_i \frac{fi}{Di}}$$

where fi is the weight fraction of the coke charge having a diameter Di. For uniform size coke, Dp=Di.

In certain embodiments, the foundry coke has a hydraulic diameter of at least 2", at least 2.5", at least 3", at least 3.5", at least 4.0", at least 4.5", at least 5", at least 5.5", or at least 6.0". As an example, a hydraulic diameter of 3.5" can be approximately equivalent to an actual diameter of 4.0". In certain embodiments, the egg has a hydraulic diameter of between 1.5" and 3.5" or between 1.5" and 2".

Figure 2:
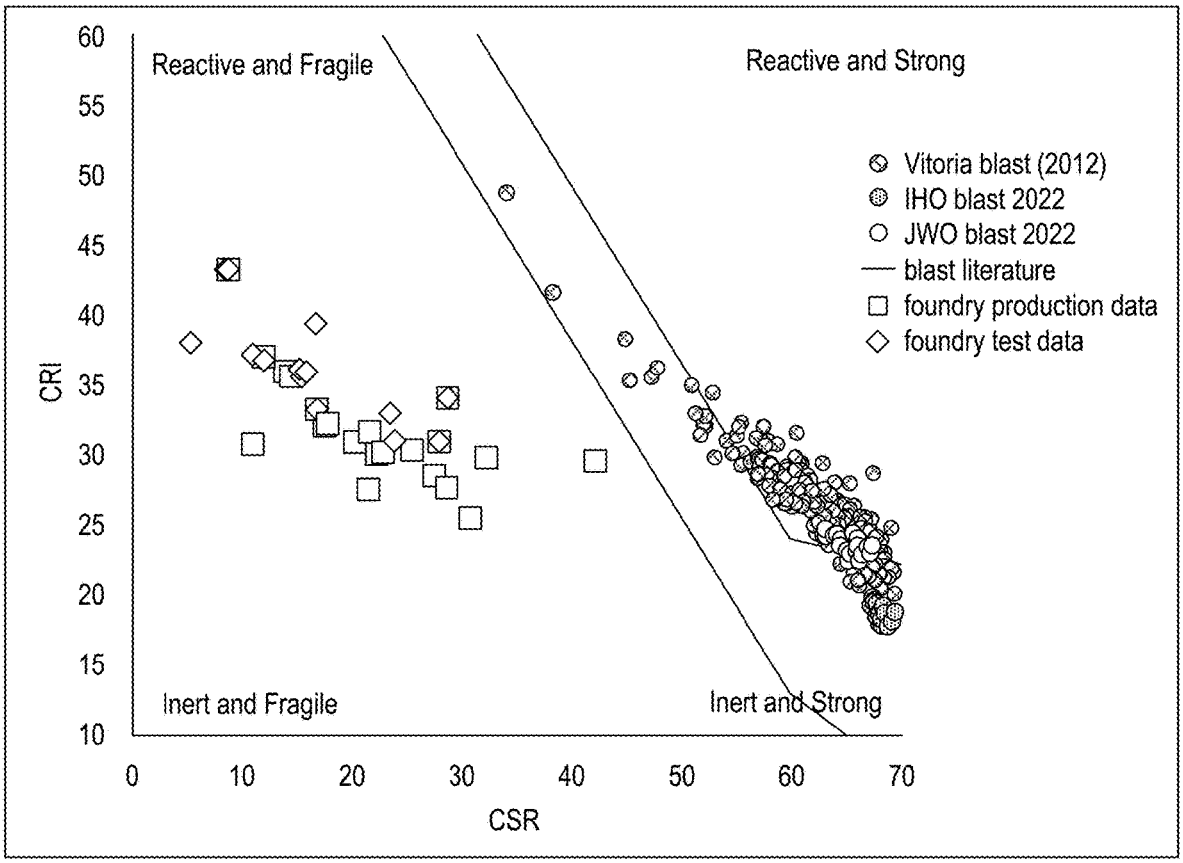
FIG. 2 shows the Coke Strength after Reaction (CSR) and Coke Reactivity Index (CRI) of foundry coke in accordance with embodiments of the present technology, relative to blast coke and related literature (Diez et al., International Journal of Coal Geology 50: 389-412 (2002)).

Coke Reactivity Index (CRI) represents the percentage of weight loss of the coke after Boudouard reaction: $CO_2 + C_{(coke)} = 2CO$ in heated kiln for 2 hours. Coke Strength after Reaction (CSR) is based on a tumble strength test of coke remaining after the CRI kiln reaction. As shown in FIG. 2, CSR and CRI has an inverse correlation.

In operation within a cupola, as metal and coke heat and progress downward through the cupola, the heat of combustion of the coke causes the metal to melt, increase in viscosity, and eventually form liquid metal that is high or higher is carbon. At an upper portion of the cupola, heat dries the cupolas and reduces moistures, but preferably does not burn the coke. If the coke is burned or cooked at the upper portion of the cupola (i.e., too early), as opposed to deeper in the cupola at a lower portion or reaction zone (as referred to herein), relatively high amounts of carbon monoxide and/or hydrogen are produced, which corresponds to a loss of carbon and/or less carbon that can be transferred to the metal in a lower portion of the cupola. Stated differently, burning the coke too early in the cupola, or at an area other than a reaction zone of the cupola, can cause carbon from the coke to react with carbon dioxide to form carbon monoxide via the Boudouard reaction. This generally results in efficiency losses and higher costs for steel production, including the need to use more coke and more oxygen or wind at the reaction region of the cupola. Additionally, such undesirable reactions at the upper portion of the cupola can result in more smoke production and a lower metal tap temperature, which can limit operational ability of the cupola and also correspond to efficiency losses. Such undesirable reactions can occur due to characteristics of the coke, including the size, shape, density, porosity, composition, and/or chemistry thereof. In view of this, the CRI of the coke should be in a particular range to ensure the coke is inert enough to resist the Boudouard reaction at upper portions of the cupola and reactive enough to cook/combust within the appropriate reaction zone of the cupola.

In certain embodiments, the HD+™ foundry coke disclosed herein can have a CSR between 10% and 25%, between 5% and 20%, or between 10% and 15%. In certain embodiments, the HD+™ coke has a CRI between 15% and 65%, at least 30%, at least 40%, or at least 45%. In some embodiments, CSI is preferably increased (e.g., irrespective of CSR) to enable the desired melting profile of the coke within the cupola. The percentage of breeze loading during the coking process affects the CSR of the coke, where a higher breeze loading results in a decrease in CSR until a certain minimum threshold is reached (e.g., 10-15% CSR. In certain embodiments, the egg has the same or approximately the same CSR as the foundry coke disclosed above. In certain embodiments, the egg has the same or approximately the same CRI as the foundry coke disclosed above.

In certain embodiments, the foundry coke has a 4" drop shatter of at least 60%, at least 65%, at least 70%, at least 75%, at least 80%, at least 85%, or at least 90%, and/or a 2" drop shatter of at least 85%, at least 90%, or at least 95%, both using 4"+ starting materials. In certain embodiments, the foundry coke has one or more customized references, such as an ash content between 5% and 12%, less than 10%, less than 9.5%, less than 9%, less than 8.5%, less than 8%, less than 7.5%, or less than 7%, a sulfur content less than 1%, less than 0.9%, less than 0.8%, less than 0.7%, less than 0.6%, or less than 0.5%, a volatile matter (VM) content less than 2%, less than 1%, or between 0.1% and 1%, a moisture content less than 15%, less than 10%, less than 9%, less than 8%, less than 7%, less than 6%, less than 5%, less than 4%, less than 3%, less than 2%, less than 1%, or between 1% and 10%, or a fixed carbon content at least 80%, at least 85%, at least 90%, or at least 95%.

In certain embodiments, the total coke produced by the proprietary process has a size distribution as follows: the foundry coke is at least 35%, at least 40%, at least 45%, at least 50%, at least 55%, at least 60%, at least 65%, at least 70%, at least 75%, or at least 80%, the mid-size coke including the egg and breeze is between 5% and 35%, between 10% and 30%, or between 15% and 20%, the fines is less than 10%, less than 8%, or less than 5%. Preferably, the fraction of foundry coke is at a highest possible percentage in the total coke produced.

Due to its unique size and shape, the HD+™ coke disclosed herein has an advantage of achieving a desirable packing density as demonstrated in the working example below.

Example 1: Packing Test

This example demonstrates a cupola packing simulation by a simplistic 2D random packing model. Comparing to the uniformly sized coke, coke having a wide size distribution is expected to have a higher bulk density, greater surface area, and lower bed porosity when loaded in an oven.

Figure 3A:
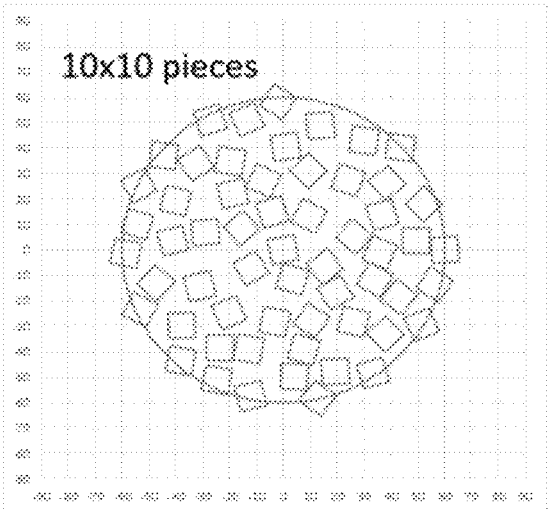
FIG. 3A-3C show the simulation of packing tests for coke pieces of various sizes disposed within a certain diameter of a cupola, including FIG. 3A having coke products of a uniform size of 10"×10", FIG. 3B having coke products having a uniform size of 4"×10", and FIG. 3C having coke products having random sizes.

FIG. 3A shows a 2D simulated packing test of coke having a uniform size of 10"×10". The circle represents the cross section of a cupola with a radius of 60". Each of the squares represents a piece of foundry coke that is a cube 10" on a side. The coke pieces were sequentially attempted to be added in in random locations and with random rotations. If the new coke piece did not overlap with any previous pieces, then it was placed and otherwise discarded. Overlap was determined by the intersection of coke edges. In this particular simulation 10,000 pieces were attempted and only 61 were able to fit in.

The gross assumptions for this model include: (1) the next layer of pieces lays on top of this one; (2) the parts of the coke pieces that extend outside of the circle are ignored as a trivial error; (3) this cross-section is essentially equivalent to any other cross section in the cupola; (4) the relative density of the coke loading is proportional to the ratio of the sum of the areas of the squares to the area of the total circle; and (5) although not exactly accurate, the relative surface area is roughly proportional to the sum of perimeters of the coke pieces.

Figure 3B:
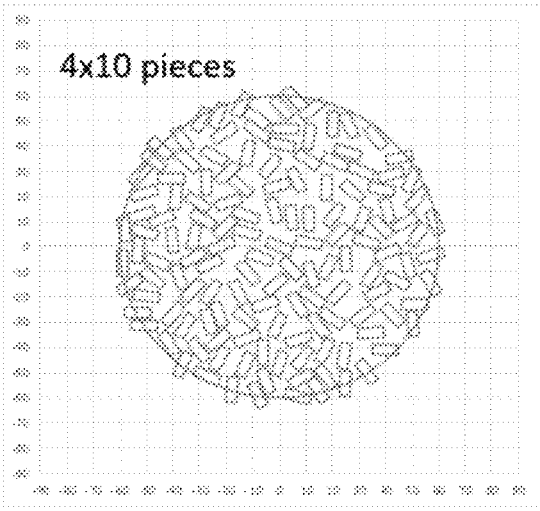

In a side-by-side comparison of fitting 10"×10" pieces (illustrated in FIG. 3A) and 4"×10" pieces (illustrated in FIG. 3B), the ratio of the covered area and the sum of perimeters of the coke pieces are compared. For the 10"×10" pieces, 58 pieces were placed, resulting in a 51% coverage of the cupola area of 11,309 square": (10×10×58)/11,309=51%; and a sum of perimeters of 2,320": 2×(10+10)×58=2,320. For the 4"×10" pieces, 138 pieces were placed, resulting in a 49% coverage of the cupola area of 11,309 square": (4×10×138)/11,309=49%; and a sum of perimeters of 3,864": 2×(4+10)×138=3,864.

The next improvement in the simulation was to: (1) Allow variation in the length and width of the coke pieces between a user defined maximum and minimum. Each piece is assumed have a square small end (i.e. L×W×W); and (2) Allow for the piece to tilt so smaller "corners" of the piece can fit in the allowed spaces. When full range of tilt was allowed, the simulation favored standing the pieces on small end. Therefore, the maximum tilt was limited to 30 degrees arbitrarily.

Figure 3C:
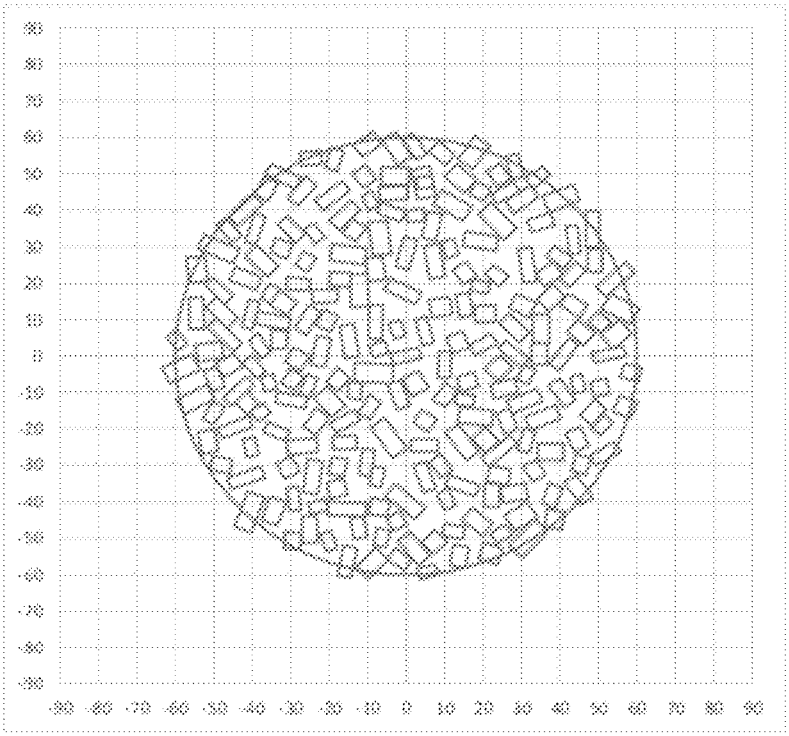

Based on this assumption, coke pieces of various sizes were fitted to cupola radius of 60" as shown in FIG. 3C. The coke pieces have a length between 4" and 10" and a width between 3" and 5", and 10,000 attempts were made for the fitting. For the pieces of various sizes, 209 pieces were placed, resulting in a 47% coverage of the cupola area of 11,309 square": 5,365/11,309=47%; and a sum of perimeters of 4,383". Therefore, the packing test demonstrates that the relative density of the coke loading did not change significantly, while the relative surface area increased significantly comparing the packing simulations in FIGS. 3A-C. The results are summarized in Table 1 below.

TABLE 1

Coke Pieces Packing Test Results

| Coke Size | % of coverage area (packing density) | Sum of perimeters (relative surface area) |
|---|---|---|
| A (10" × 10") | 51% | 2320 |
| B (4" × 10") | 49% | 3864 |
| C ([3-5"] × [4-10"]) | 47% | 4383 |

Figure 4:
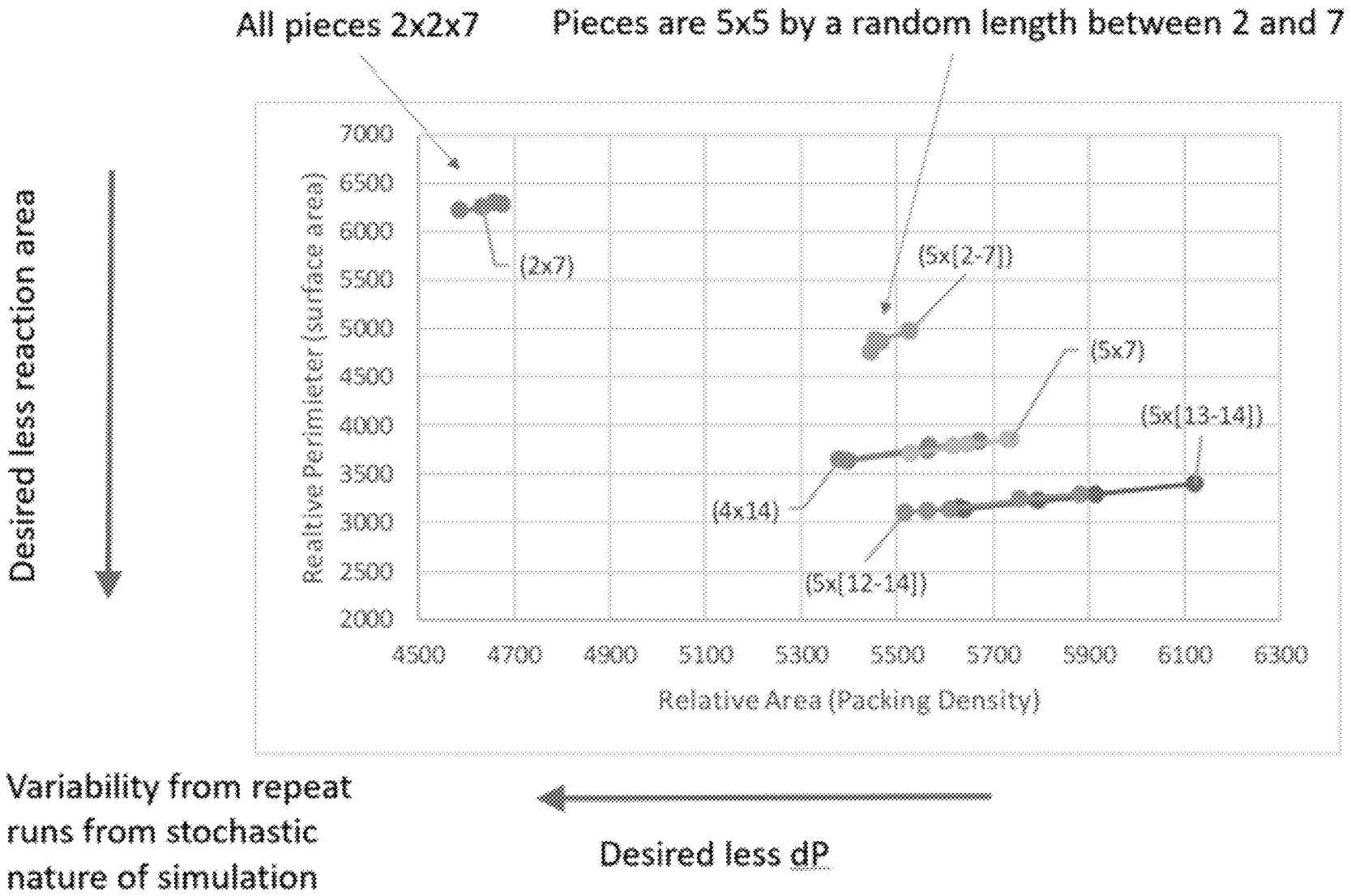
FIG. 4 shows variability from repeat runs from stochastic nature of simulation in packing tests for cupola.

FIG. 4 shows variability from repeat runs from stochastic nature of simulation.

Example 2: Calculation of Hydraulic Radius

An Excel model was used to calculate hydraulic radius of the foundry coke based on its measured size distribution, the presumed bottom screen cut and the bulk density using the formulas disclosed above.

The oblong shape of our coke has the potential to create a sparse packing density which in turn increases the effective hydraulic radius. This in turn makes the cupola performance of the foundry improve due to the reduction of latent heat loss from the reaction of $CO_2$ and coke to form CO which occurs on the surface of the coke. Higher interstitial volume to coke surface area ratios help on this factor.

Hydraulic radius can also be improved by cutting out the small coke but the yield will be compromised. The oblong coke shape may prove to be a significant cupola performance benefit.

Figures 5A, 5B:
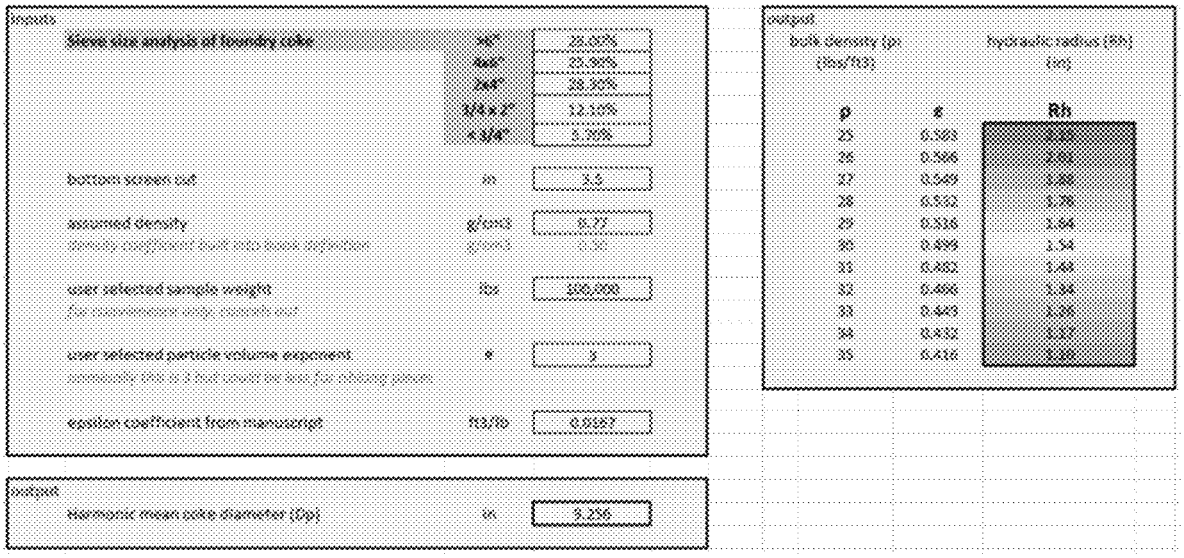
FIG. 5 shows an example calculation of hydraulic radius for coke products.
Figure 6:
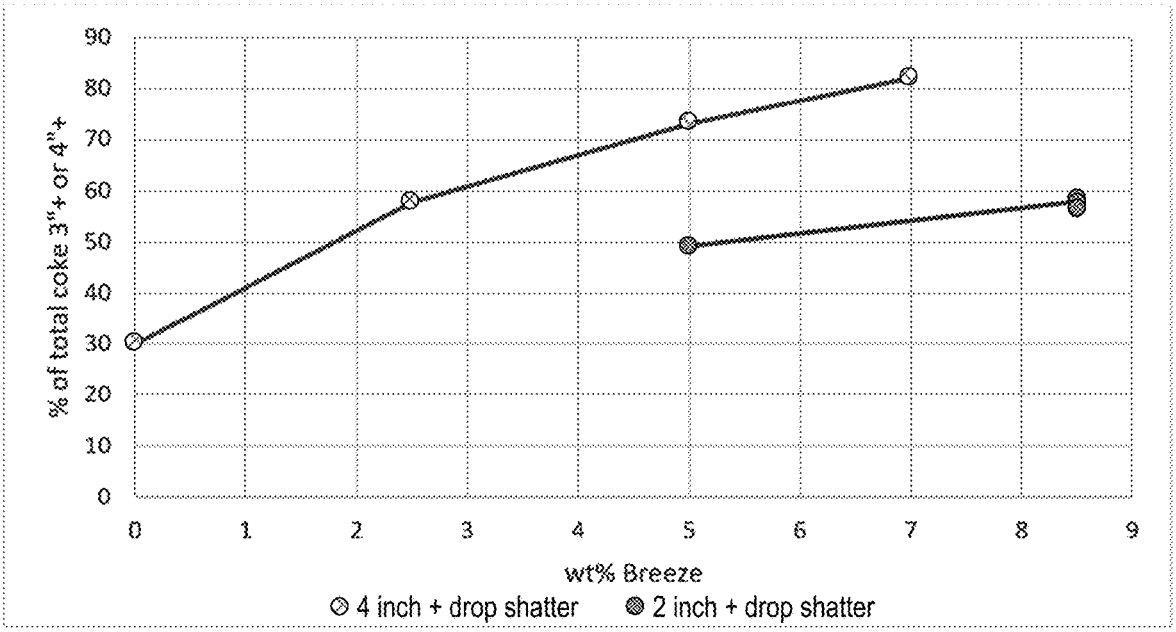
FIG. 6 shows that the yield on coal of 3"+ coke (curve at the top, data from a publication in 1956) and 4"+ coke (curve at the bottom) improved with an increased breeze loading, in accordance with embodiments of the present technology.

The bulk density of the screened coke, as well as unscreened coke, is measured and can be used in the calculation. The calculation results are shown in FIG. 5.

Preparation of Coal Blend

According to aspects of the disclosure, obtaining high quality coke, in particular, oversized foundry coke, includes using an optimized blend of coal having a predetermined percentage of inerts or breeze. The coal blend preparation includes breeze preparation, coal selection and blend recipe optimization, and blend preparation.

Breeze Preparation

As shown in the Figures, the yield of both 3"+ coke and 4"+ coke improved with an increased breeze loading. Crushed breeze is coke breeze having a size of <⅜" and can be obtained by crushing larger coke, for example, in a rod mill, ball mill or other grinding component. In one exemplary embodiment of the disclosure, coke with a low ash content is ground in a mill to produce crushed breeze for blending into the coal blend, improving total final yield optimization. The size window of the coke breeze can be adjusted to optimize ash content and minimize yield loss of intermediate sized coke (e.g., egg) being used to grind. Dust is screened out from breeze to remove the most ash with the least overall yield impact.

The selected coke is crushed to the desired size range by various means, for example, by rod mill, to be recycled into a coal blend as breeze.

The coke feed is screened for sizes. Too large coke is not cost or procedure efficient for grinding. The coke feed is also characterized and optimized based on various attributes such as size, ash content, and hardness. In certain embodiments, the grind can operate in shifts for different size of feedstocks and then recombine. In certain embodiments, the grinder can be optimized for each feed.

Conventionally, the coke is classified based on size: foundry coke having a size of 4"+, egg (industrial coke) having a size of 2-4", stove having a size of 1-2" or 1-1.5", nut having a size of ⅜-1", and breeze <0.5". The foundry coke and egg coke disclosed herein have a size of 3.5"+ and 1.5-3.5", respectively. HD+™ coke having a size of less than 1.5" or 2.0" is ground and recycled to the coal blend. Within this group, breeze having a size of 0.5-2.0" can be recycled, while fines having a size less than ½" may impose an issue with heat recovery due to potential burn loss and high ash content. eggs are only recycled if additional breeze loading is required.

Figure 7:
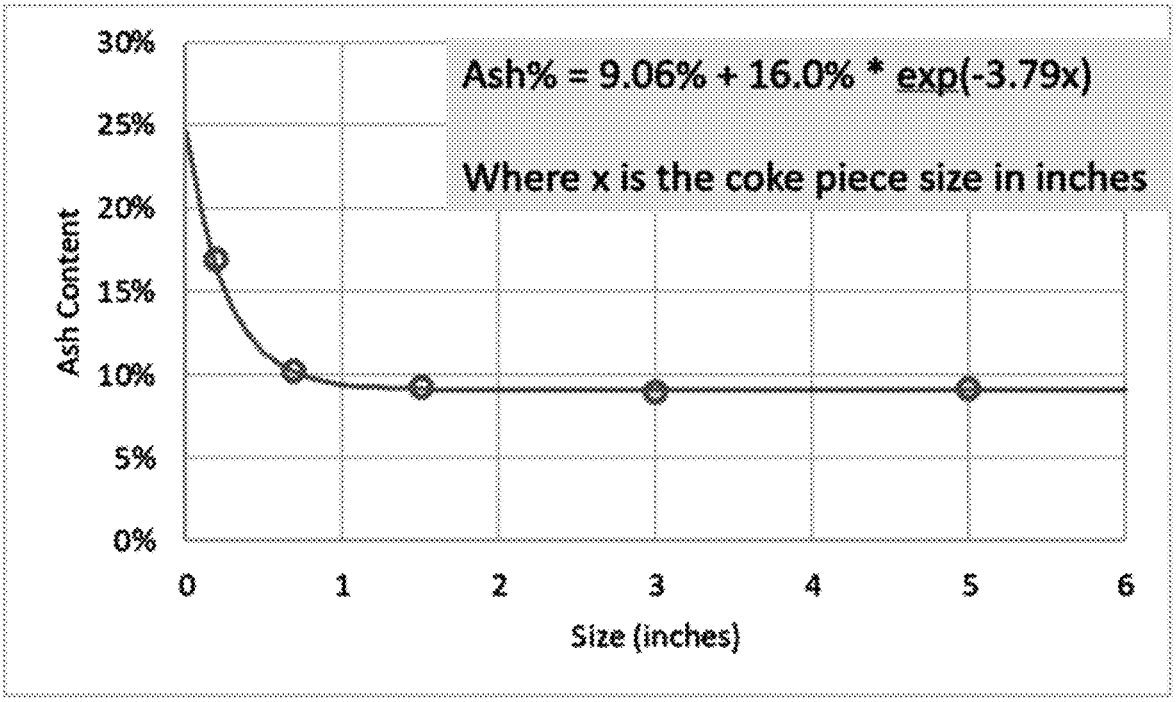
FIG. 7 shows the correlation of ash content and coke size, in accordance with embodiments of the present technology.
Figure 13:
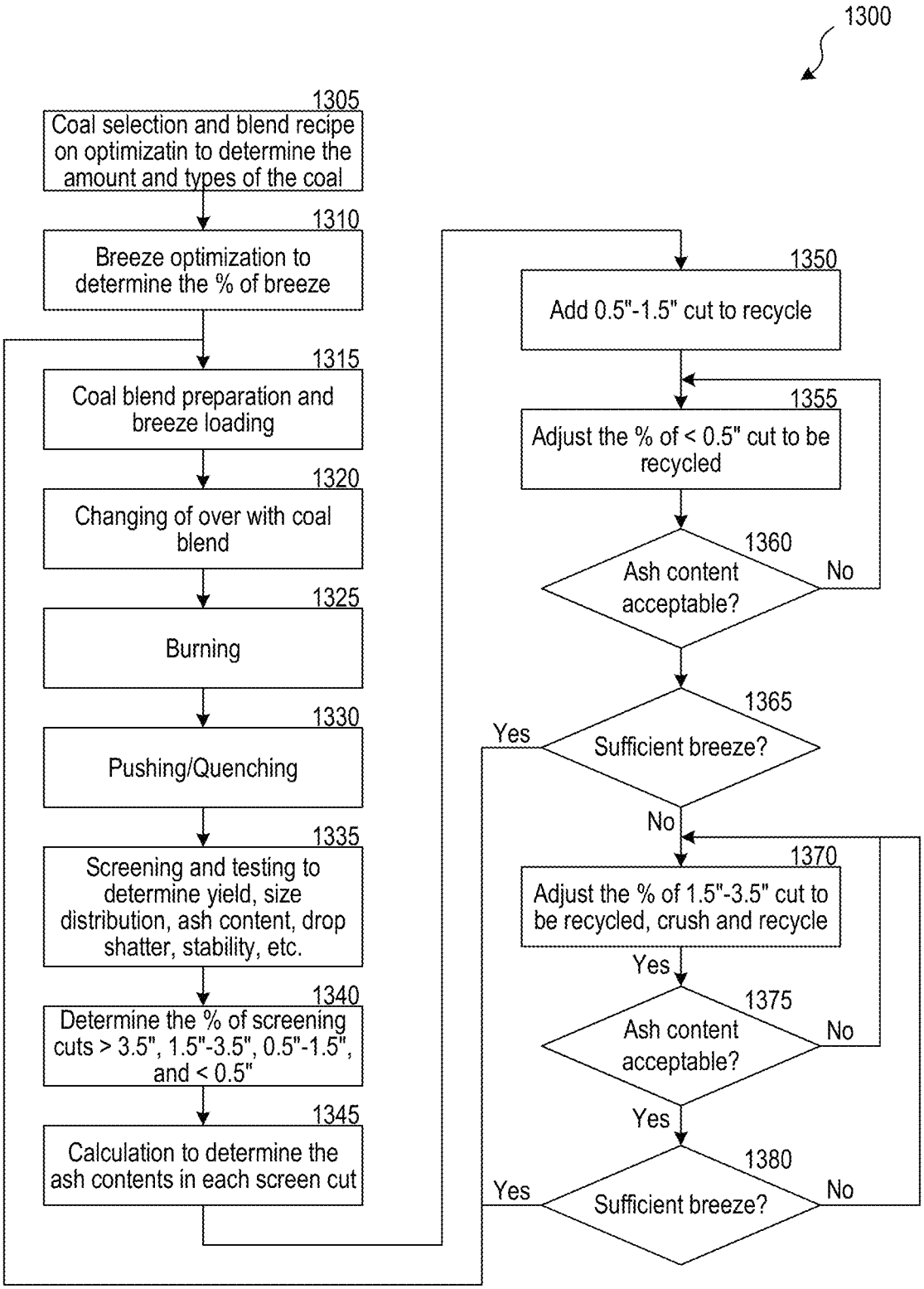
FIG. 13 shows an example flow chart of the process of producing HD+ Coke with optimized breeze recycle, in accordance with embodiments of the present technology.

Accordingly, after each production cycle, coke products are screened for size: screen cut having a size of less than 0.5" (fines), screen cut having a size of 0.5-2.0" (breeze), screen cut having a size of 1.5-3.5" (egg), and screen cut having a size of >3.5" (foundry coke). The recycle process is shown in a flow chart (FIG. 13). Although fines are low cost, not all fines are recycled due to its high ash content and its contribution to high dust generation. FIG. 7 shows the predicted ash content correlation with the coke size. Preferably breeze contains a high percentage of low ash breeze and high ash breeze is less than 0.5% such that all breeze is recycled. Some eggs are crushed and recycled to achieve a sufficient breeze loading and no foundry coke is crushed.

Because of the optimization and recycling in the process disclosed herein, not all egg coke is crushed and recycled to make up a sufficient breeze loading. The remaining egg coke can be sold and used, for example, in sugar beet and rock wool production. Alternatively, by-product low ash breeze produced can be purchased to make up a sufficient breeze loading for the coal blend such that most or all eggs can be sold as product. In certain embodiments, the coke breeze is crushed to 65% with 20 mesh and +60 mesh.

Coal Selection and Blend Recipe Optimization

The coking coal for the blend is selected based on many factors, including but not limited to, volatile matter (VM), vitrinite distribution, inert (which correlates with the percentage of breeze loading), fluidity of the blend, ash/sulfur contents, and cost of coal. One or more selected types of coal at predetermined percentages are mixed with breeze to form a coal blend, which is optimized to achieve a desired yield of high-quality coke products. Various tests and analyses are performed on the coal blend to ensure high yield and high-quality coke products.

The proximate/sulfur analysis is basically the overall chemistry and the conventional wisdom is to select a coal blend that displays the lowest ash yield and sulfur content possible. Ash is the disposable inert residue that concentrates in the product coke ash, but provides limited benefit to carbonization. The total sulfur is a detriment to CSR but a portion of it concentrates in the molten iron and causes the product to be brittle. In the foundry business operators look critically at ash and sulfur as they can find their way in the produced hot metal. In the Ultimate Analysis the total carbon is the working foundation of carbonization. Hydrogen is a major component of the Exinoid group of macerals in the petrography; these having their origin in plant resins and sap. They contribute more to the evolution of volatile gases and less to the rheological deformations. Excessive oxygen can be an indication that the coal has been subjected to weathering exposure to air and/or water, contributing to inferior fluidity and dilatation.

The rheological test parameters include the Gieseler Plasticity (fluidity), Amu Dilatation and the Free Swelling Index test procedures. The free swelling index while not the best quantitative method provides a rough screening for coals that lend themselves to coke making. The Gieseler and Amu tests are critical in selecting coals for coke making and are instrumental in producing uniformly high strength coke.

The petrographic analysis is a quantitative method of identifying the microscopic fossilized plant components. The ratio balance of the different plant tissues has a profound contribution to the carbonization process and the woody material represented by vitrinite is the primary driver that produces the coke microtextures and cell structure in the product coke.

Therefore, producing strong coke is multidimensional and the individual coal quality characteristics are simultaneously working with and against each other.

According to aspects of the disclosure, a low volatile matter (VM) coal blend is selected to facilitate low temperature oven runs. In general, a lower VM results in a higher yield of total coke, and a higher yield of foundry coke and larger coke. In certain embodiments, the VM of the coal blend is between 15%-40%, between 20%-33%, or between 20% and 24%. In certain embodiments, the VM of the coal blend is less than 25%, less than 24%, less than 23%, less than 22%, less than 21%, less than 20%, less than 19%, or less than 18%. In certain embodiments, the water content is adjusted lower to balance the VM, and can be within a range of between 6% and 15%, between 9% and 12%, or between 10% and 12%. In some embodiments, the moisture is at least 8%, at least 9%, at least 10%, or at least 11%.

According to further aspects of the disclosure, the coal blend can be an expanding coal and the coking oven is a horizontal oven that is not limited by wall pressure as in a 'slot'-type oven or by-product oven. In operation, during the plastic stage of the coking process, swelling of the coal mass can arise due to the inability of volatile emissions to easily escape. Swelling can impart pressure to the refractory walls of the 'slot'-type ovens. Parameters of importance in evaluating the swelling risk of coal are rank, inert content and bulk density. Generally, as rank increases, inert content decreases or bulk density increases the greater is the danger of hazardous wall pressures arising. After the swelling stage coke shrinks and contracts. Excessive shrinkage is associated with reduced coke strength due to the formation of fissures. However, for a byproduct coke plant, some shrinkage of the coke mass is required if the coke is to be readily pushed from the oven.

The coal blend comprises reactive components including vitrinite, liptinite, and reactive semifusinite, and inert materials including coke (including breeze), inert semifusinite, fusinite, macrinite, and mineral matter. The reactive components provide the "glue" while the inert materials are the filler that provides coke strength. The ratio between the reactive components and the inert materials are optimized to produce strong uniform coke. In certain embodiments, the total inert in the coal blend including the breeze is between 20% and 40% or between 35% and 40%, in which the breeze makes up approximately between 15% to 20%. In certain embodiments, the ratio of total inert:total reactive is 20:80, 21:79, 22:78, 23:77, 24:76, 25:75, 26:74, 27:73, 28:72, 29:71, 30:70, 31:69, 32:68, 33:67, 34:66, 35:65, 36:64, 37:63, 38:62, 39:61, or 40:60.

Selection of the types of vitrinite also has an influence on the yield and quality of coke products. In certain embodiments, the vitrinite includes one or more of V9, V10, V11, V12, V13, V14, V15, V16, V17, V18, and V19. In certain embodiments, the vitrinite includes V15, V16, and V17, the combination of which makes up at least 30% of the petrography of the blend. In certain embodiments, the vitrinite includes less than 4% or less than 2% of V18.

In general, low contents of ash and sulfur in a coal blend is desirable. However, coal having very low ash and sulfur content is more expensive and may drive up the production cost. Moreover, the ash content of the coal blend should be optimized not only in the coke products but also in consideration of breeze recycling discussed above. In certain embodiments, the ash content in the coal blend is less than 12%, less than 11%, less than 10%, less than 9%, less than 8%, less than 7%, less than 6.5%, less than 6%, less than 5.5%, or less than 5%. In certain embodiments, the ash content in the coal blend is about 8%-9%, about 6%-7%, or about 5%-6%. In certain embodiments, the sulfur content in the coal blend is less than 1.5%, less than 1.0%, less than 0.9%, less than 0.8%, less than 0.7%, less than 0.6%, or less than 0.5%. In certain embodiments, the ash content and/or the sulfur content of the coal blend can be adjusted based on customers' requirements for the final coke products.

The moisture content of the coal blend can be adjusted at different stages, for example, moisture can be adjusted in the coal blend before charge or in coal blend at charge. In certain embodiments, the moisture content can be measured, and extra water can be added to the coal blend on its way to the oven or while charging to increase the moisture content to target 8%-15% water, or 10%-13% water. The water can be added to delay the peak temperature, to slow down volatile matter (VM) release, and/or to move the coke line. Less moisture content is needed at the oven if the oven runs cool. In certain embodiments, the moisture content of the coal blend is between 4% and 20%, between 5% and 15%, between 10% and 15%, or between 10% and 13%.

The coal blend goes through liquid and solid phases transition during the coking process. At low temperatures, the coal blend is solid. With the increase of oven temperature, the coal blend softens and becomes sticky, then fluid, and then resolidifies. The coal blend must have a certain degree of fluidity to facilitates between-particle bonding. The Gieseler plasticity test is performed to determine the coal blend fluidity. A coal sample is packed into a small retort (2 cm diameter and 3 cm tall) with a stirring rod embedded. The stirring rod has a constant torque applied to it. The assembly can be a temperature controlled/heated viscometer. A chemical reaction is taking place and changing the viscosity. The assembly is submerged in a hot furnace bath and heated. At first the packed coal prevents the rod from spinning. As it is heated the coal eventually melts enough for the rod to start spinning. This is the initial softening temperature. As the coal melts further the rod spins faster and this movement is measured and recorded every minute in dial division per minute (ddpm). There are 100 dial divisions in a full circle. There is a temperature where the ddpm is hits the peak (maximum fluidity temperature). Above that temperature the coal starts to turn into coke and slows down the stirring rod. Eventually the rod stops at the final solidification temperature. The fluidity is the maximum rotational speed of the rod in ddpm. The fluidity is often reported on the log scale: Fluidity 1000 ddpm corresponds to log(F)=3. The log(F) of a blend of coals will be the weighted average of the log(F) of the components. Older instruments have an upper limit of 30,000 ddpm so many high fluidity coals will have 30,000 ddpm. Modern instrument can go up to 100,000 DDPM (1000 rpm). The plastic range of the coal is difference between the final solidification temperature and the initial softening temperature. A high fluidity and a high plastic range implies a coal will become very fluid in the coking process allowing it to flow around the inert particles and create strong coke.

In certain embodiments, the coal blend has a fluidity of at least 200 ddpm, between 100 ddpm and 2000 ddpm, or between 200 ddpm and 1200 ddpm. A higher fluidity is desirable and various additives such as tars, coal tar and other heavy oils in the coal blend can increase the fluidity. On the other hand, stamp charging can lower the bottom end of the fluidity, to about 20 ddpm. In certain embodiments, the fluidity of the coal blend is in the range of log(F)=2-3, log(F)=2-4, or log(F)≥3.

In certain embodiments, the coal blend is optimized based on the foundry product property predictions. For example, the percentage of breeze may be optimized in the coal blend. Breeze loading has effects on drop shatter, stability, dust production, and yield.

Figure 8:
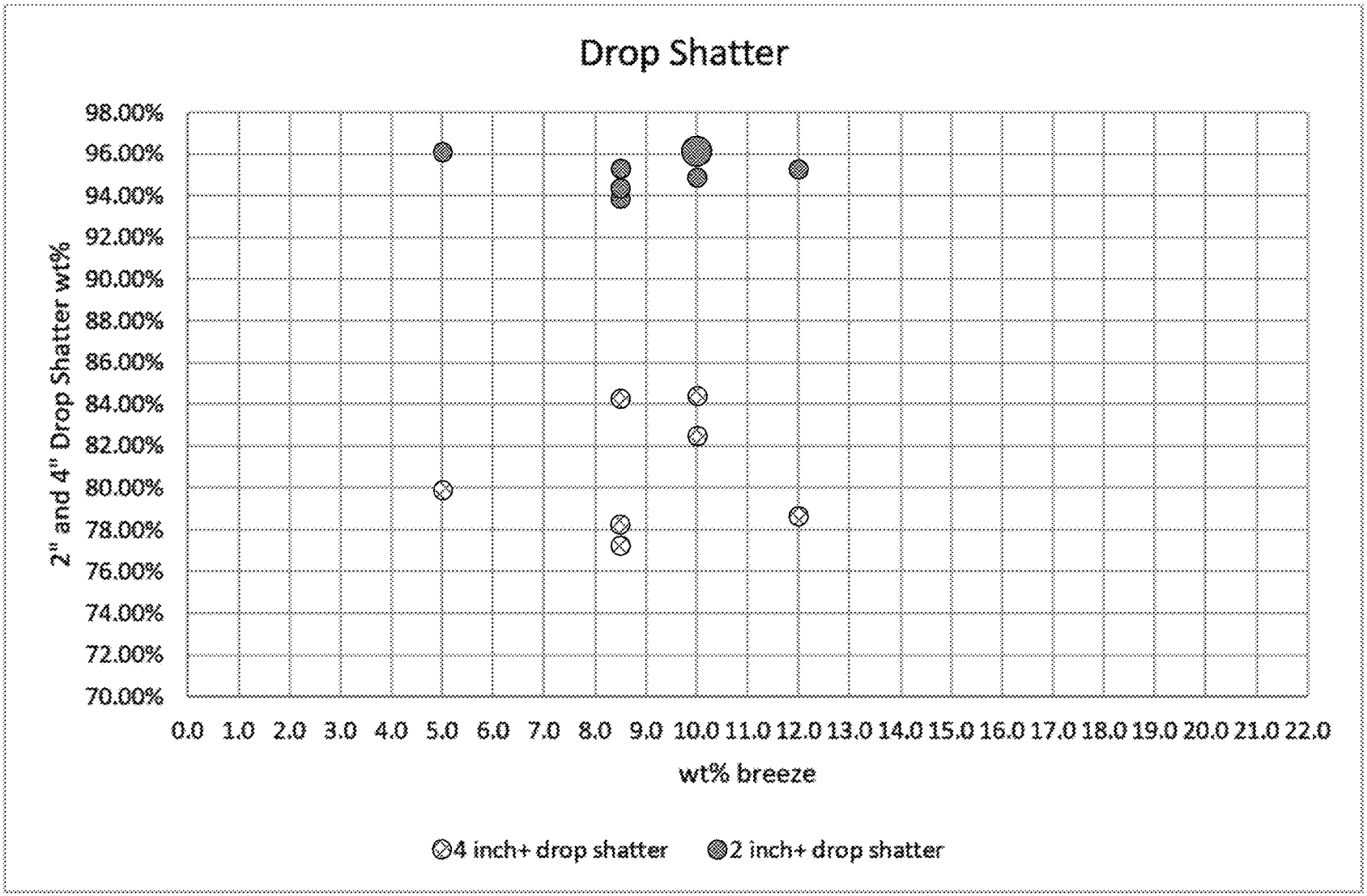
FIG. 8 shows the 2" and 4" drop shatter of foundry coke at various breeze loadings from 5% to 12%, in accordance with embodiments of the present technology, with the 2" drop shatter ranging from about 93% to about 96%, and the 4" drop shatter ranging from about 77% to about 85%.
Figure 9A:
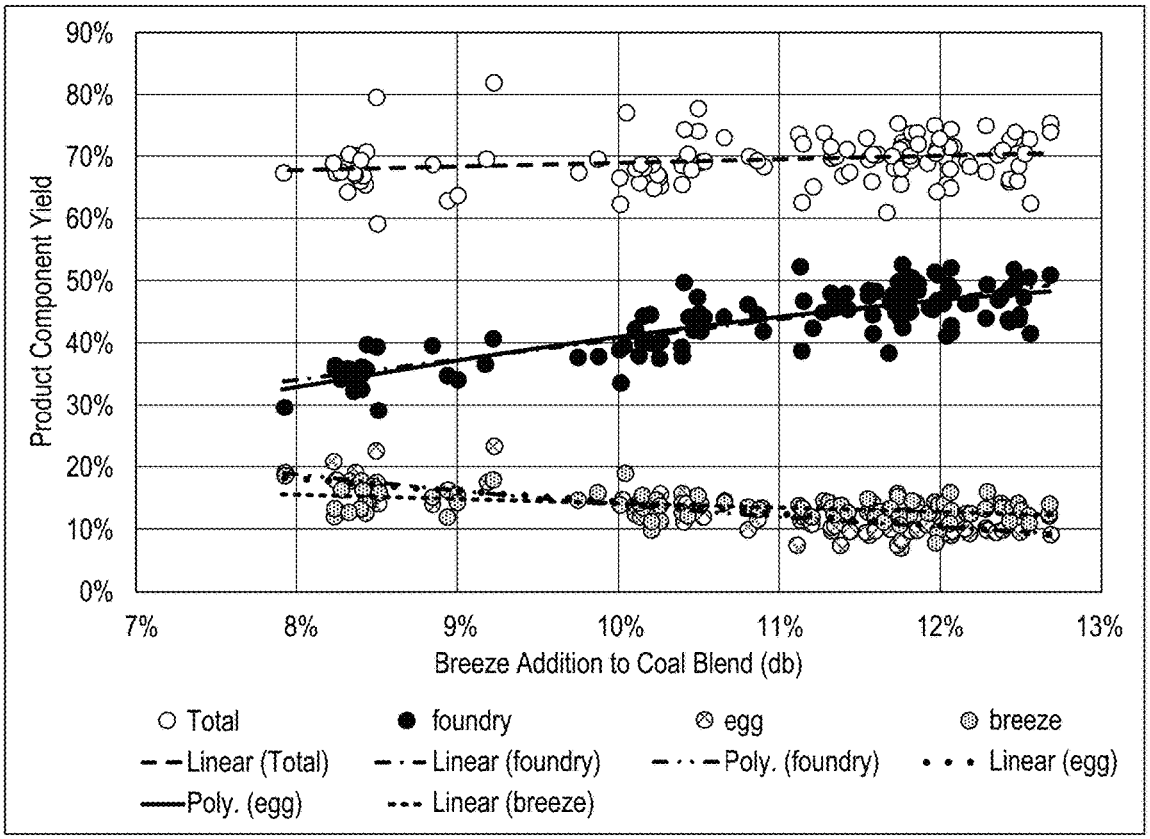
FIG. 9A shows coke yield modeling of different size groups as a function of the breeze loading from 5% to 12% weight, in accordance with embodiments of the present technology.
Figure 9B:
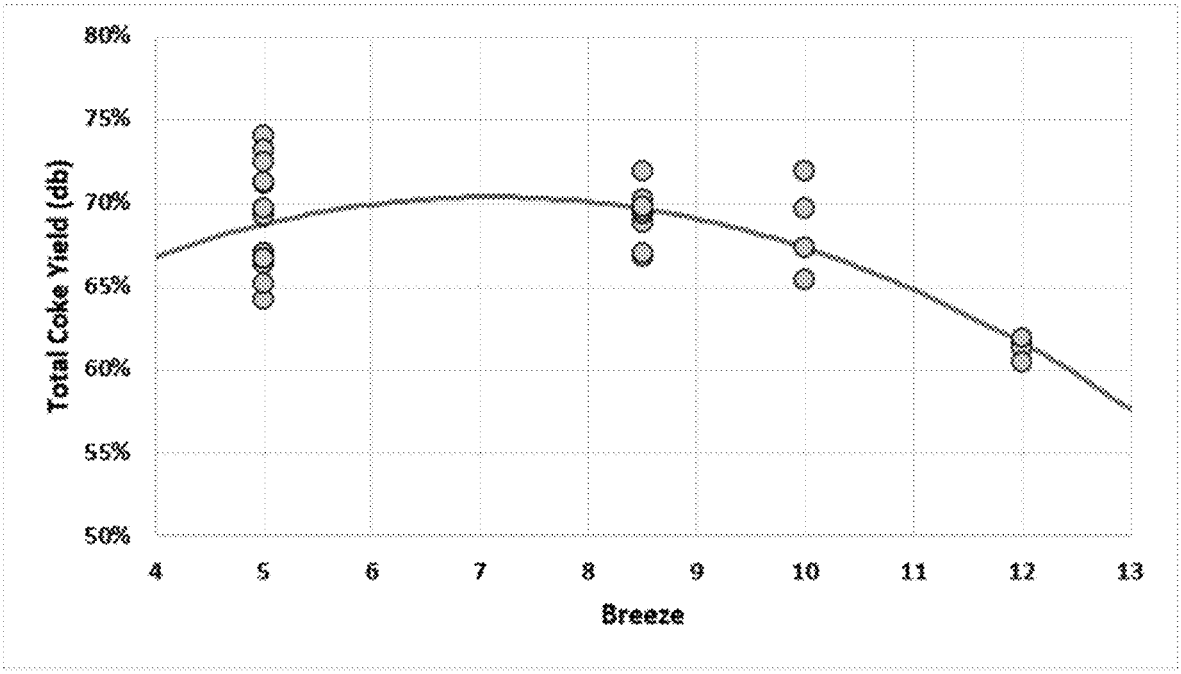
FIGS. 9B-9E show the yield modeling of each group, including FIG. 9B showing total coke, FIG. 9C showing foundry coke, FIG. 9D showing undersized coke, and FIG. 9E showing breeze, with data points at approximately 8.0-13% weight breeze loadings, in accordance with embodiments of the present technology.
Figure 9C:
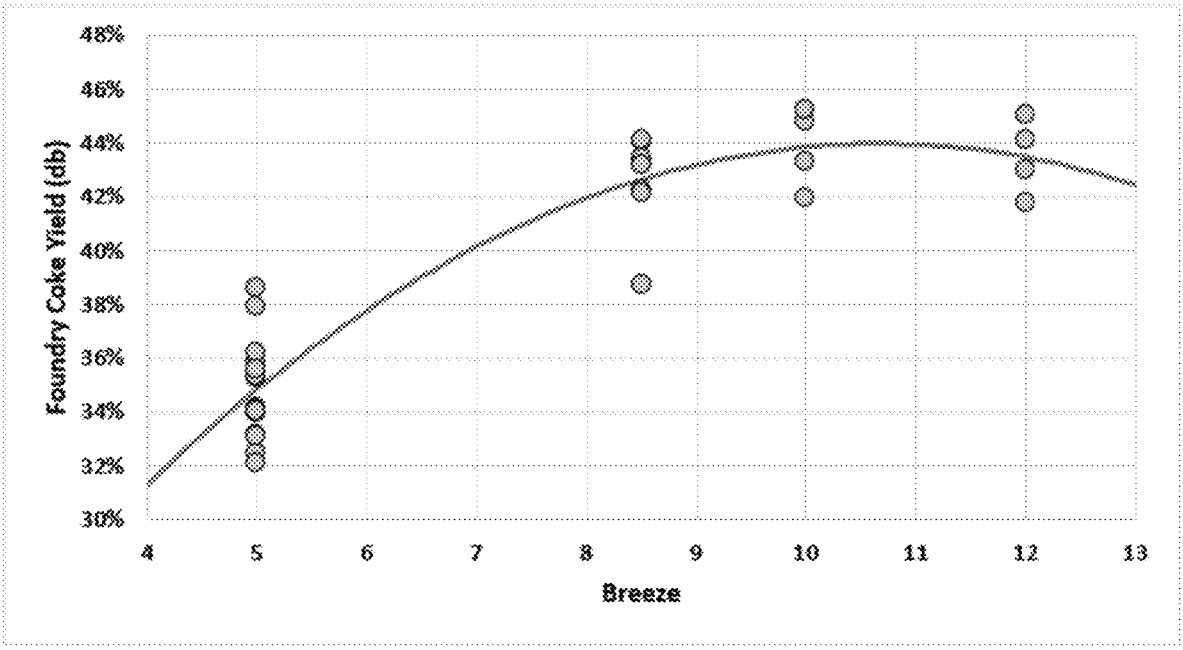
Figure 9D:
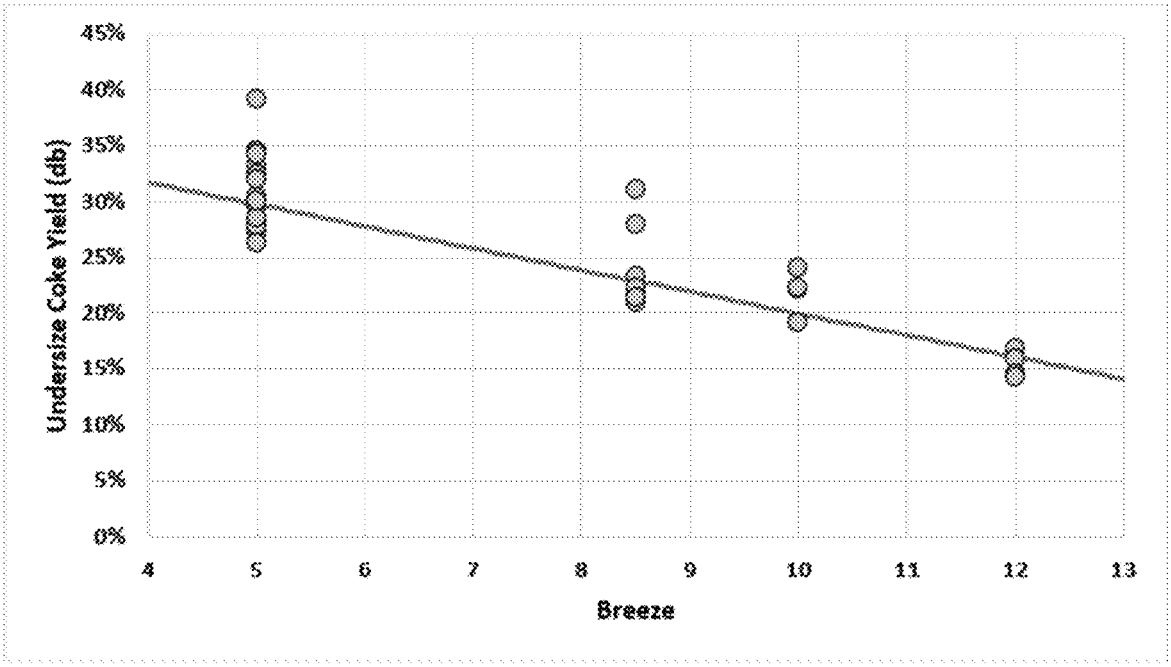
Figure 9E:
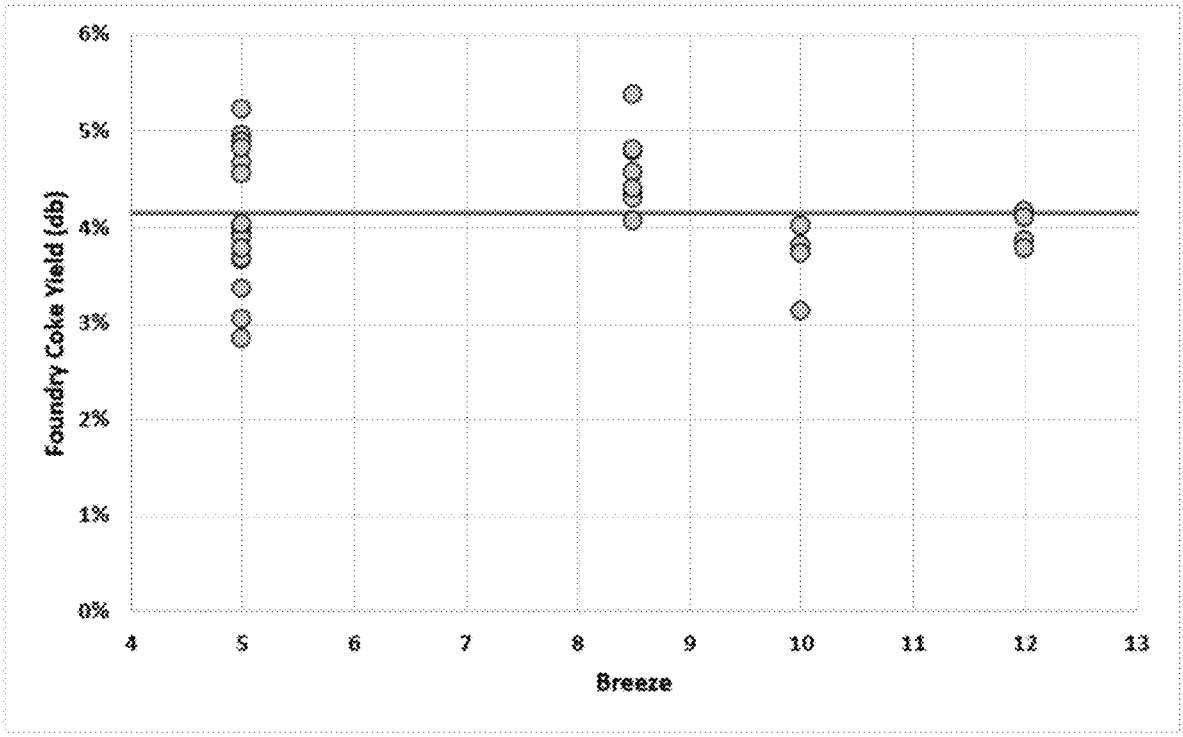
Figure 10:
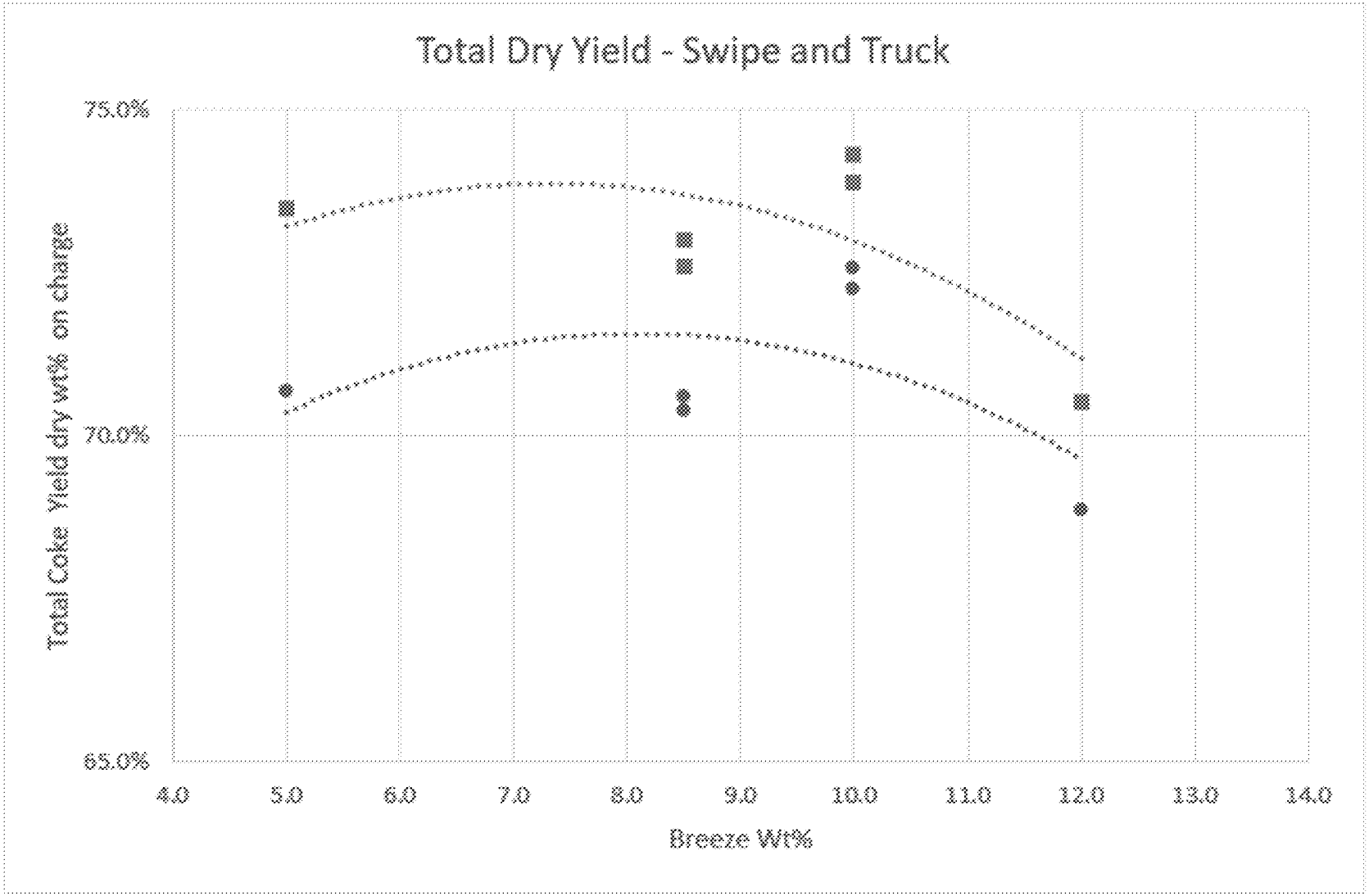
FIG. 10 shows second order fit of the dry yield on charge of total coke as a function of breeze from 5% to 12% weight, in accordance with embodiments of the present technology.
Figure 11A:
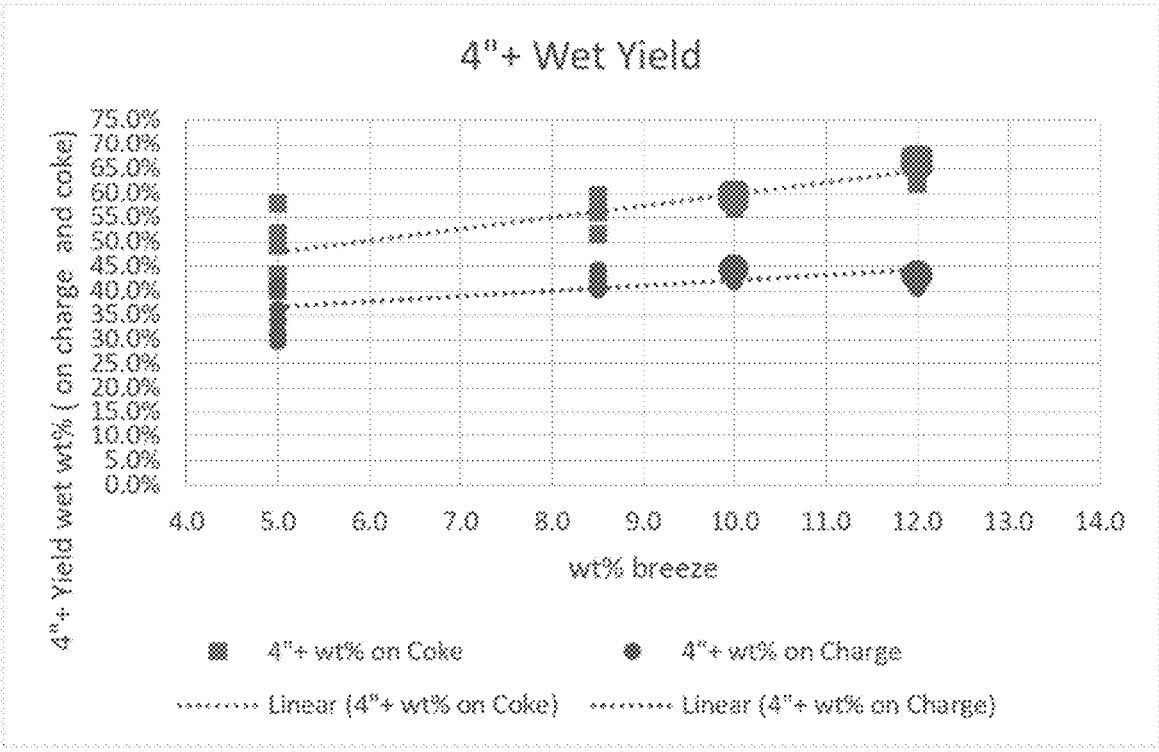
FIG. 11A shows the wet yield and FIG. 11B shows the dry yield of 4"+ foundry coke, in accordance with embodiments of the present technology.
Figure 11B:
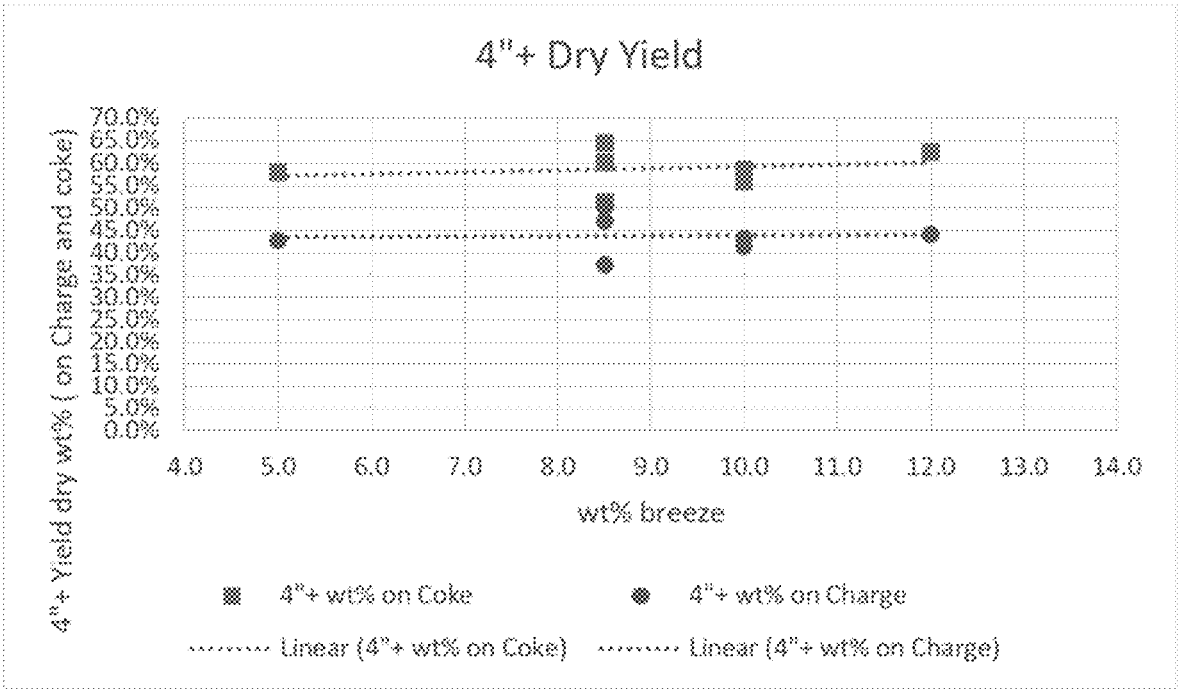
Figure 12:
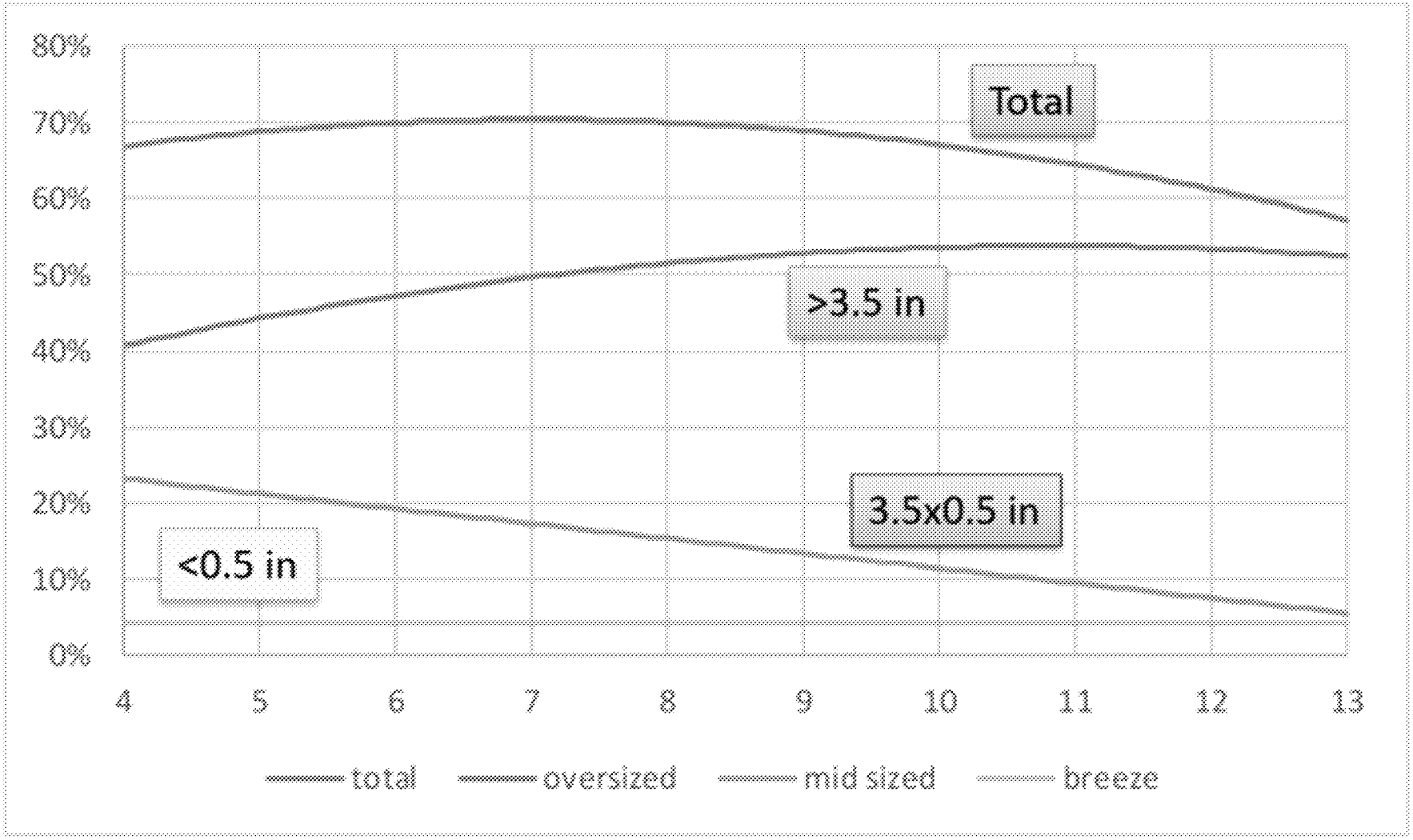
FIG. 12 shows yield models as a function of breeze recycle input in accordance with embodiments of the present technology. During recycle optimization, the mid-sized section is split into two groups: screen cut (3.5"×1.5"), a fraction or all of which may be rod milled and recycled, and screen cut (1.5"×0.5"), which is recycled. A fraction or all of screen cut (<0.5") may be recycled.

Typically, a drop shatter test is performed using 4"+ coke as the starting materials and the drop shatter for both 4" and 2" is evaluated. FIG. 8 shows the drop shatter of 4" and 2" as a function of breeze loading from 5%-12%. In some embodiments, the drop shatter can peak or close to peak at 12%, 13%, 14%, 15%, 16%, 17%, 18%, 19%, or 20% breeze loading.

In general, a higher breeze loading results in a higher yield in both the total coke and HD+ foundry coke, as shown in the Figures.

Burning and Oven Design

The burning step of the foundry producing procedure is performed in heat recovery ovens. Other ovens may be used as well by adapting the coal blend and other parameters, for example, non-recovery ovens and by products ovens. Non-limiting examples of the parameters that can be optimized including cycle time, temperature control, modifications to sole flue, top air, and the oven types.

Cycle Time Optimization

In certain embodiments, the burning step has a 24-hour cycle, a 48-hour cycle, a 72-hour cycle, or a longer cycle.

Heat Recovery Ovens

The burning practice in the process disclosed herein is modified in various aspects comparing to the blast practice to produce high quality foundry coke. In certain embodiments, the crown temperature and the sole flue temperature for producing foundry coke are suppressed at the start. This is different from the process for blast, which attempts to heat the sole flue (SF) as hot as possible (without surpassing a not-to-exceed (NTE) temperature) at first and maintain the heat in the SF throughout the coking cycle. The crown temperature and the sole flue temperature can be suppressed by slowing down the rate and/or quantity of released VM before or during charge, or by slowing down the combustion in the crown and SF via burning practices. Changing the VM content has a large impact on the crown and SF peak temperatures after charge.

The higher the VM content can lead to higher the peaks and NTE temperatures. To help combat the VM and effects thereof, water is added to the coal as it goes into the oven. Moisture also has a large impact on the peaks after charge, and a relatively high moisture content can slow down the rate of the temperature increase and help control temperatures as the water evaporates. Typically, the coal is dried to around 5% moisture for blast ovens, but with foundry ovens, the coal is not previously dried, and water may be added before charge to increase the density of the charge. In this regard, it is generally desirable to minimize soak times for foundry coke at lower temperatures. This is in contrast to the process for producing blast coke, in which it is generally desirable to have longer soak times.

Another difference between blast and foundry is the set up after charge. Usually on blast ovens, the door holes and sole flues are opened or closed based on the temperature of each specific oven. With foundry, the goal is to keep the crown temperature lower throughout the cycle, so all door holes are shut on each charge. With foundry, the SF are only partially opened, usually around 12 open, to prevent the SF from getting too hot. This restriction of oxygen in the crown and SF can lead to combustion in the common tunnel, where oxygen is introduced through leaks around the uptakes. On blast ovens, where the goal is to get the SF as hot as possible on the first day, combustion in the tunnel is strictly avoided.

Figure 16:
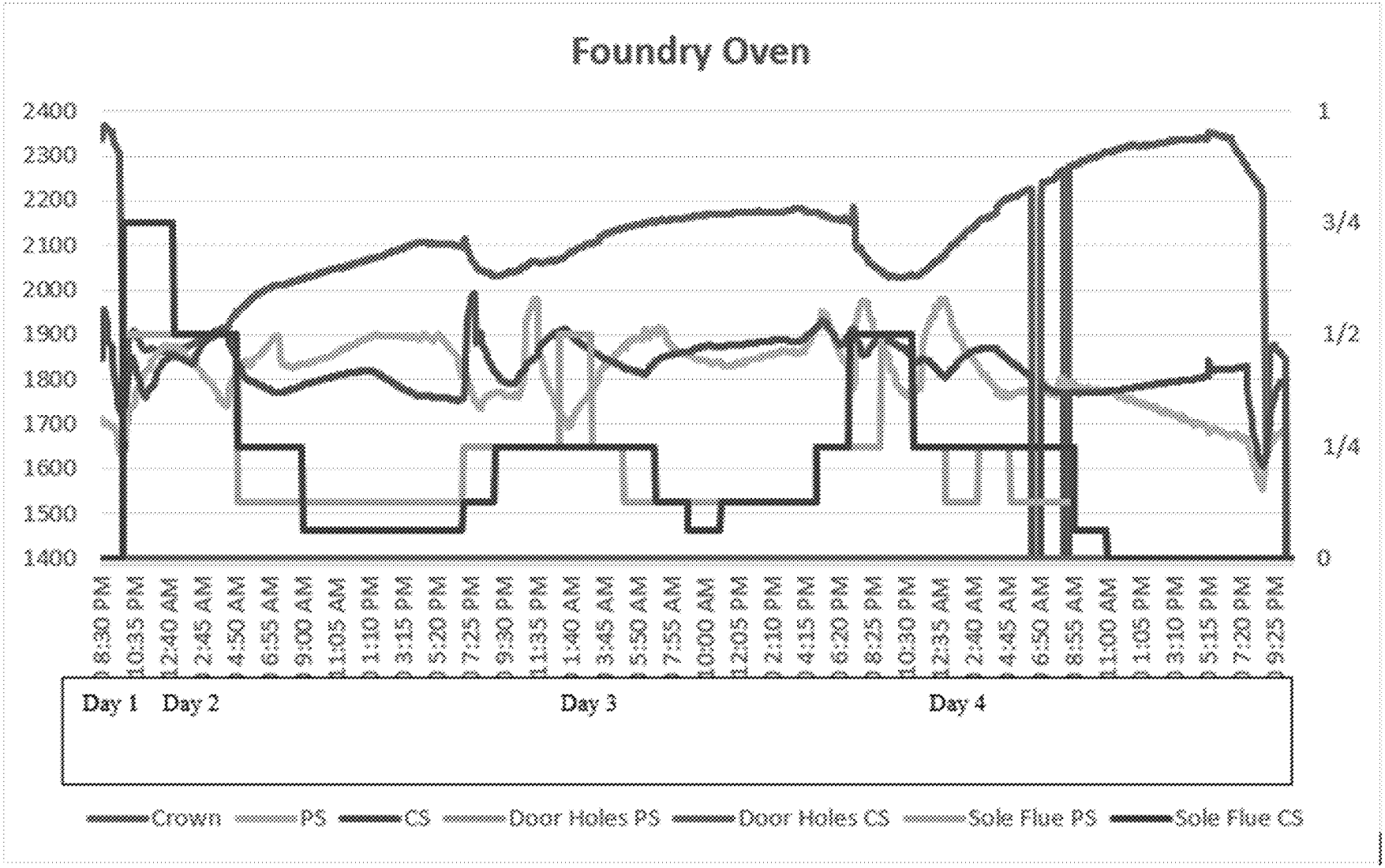
FIG. 16 shows the temperature trend and the adjustments to the sole flue for a foundry oven, in accordance with embodiments of the present technology.
Figure 17A:
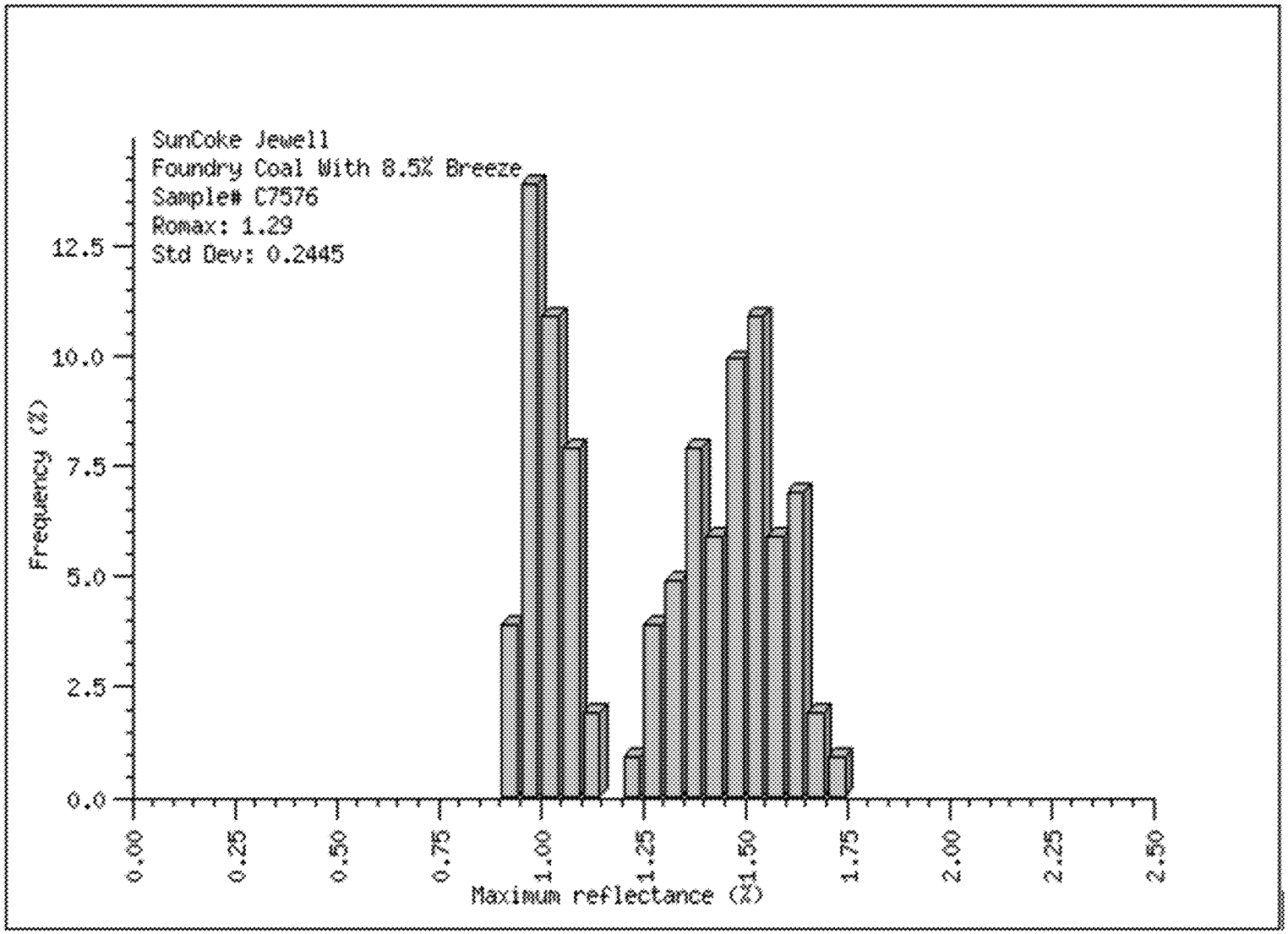
FIGS. 17A and 17B show an exemplary vitrinite reflectance and random reflectance of a coal blend with 8.5% breeze, respectively, in accordance with embodiments of the present technology.
Figure 17B:
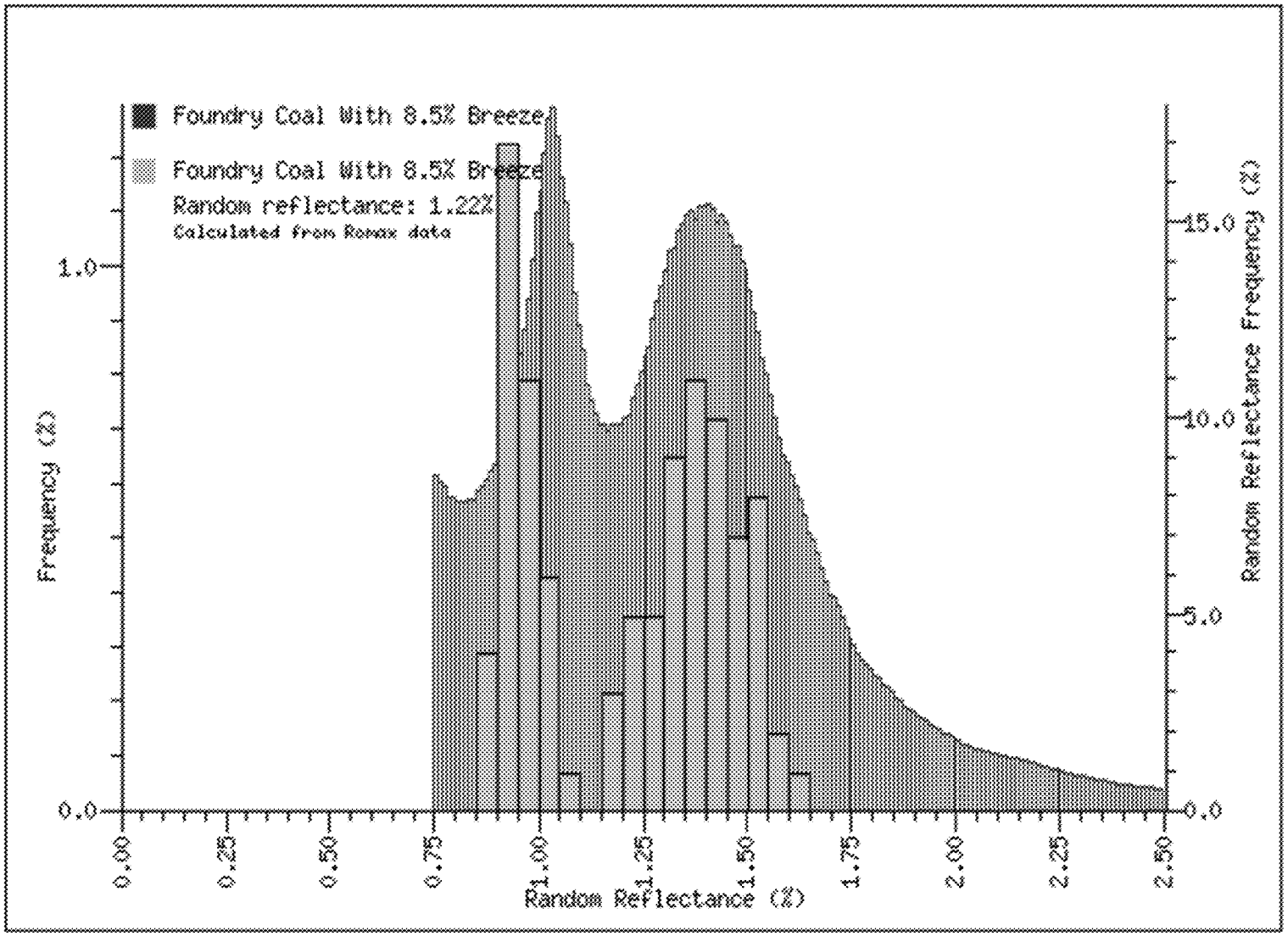
Figure 18:
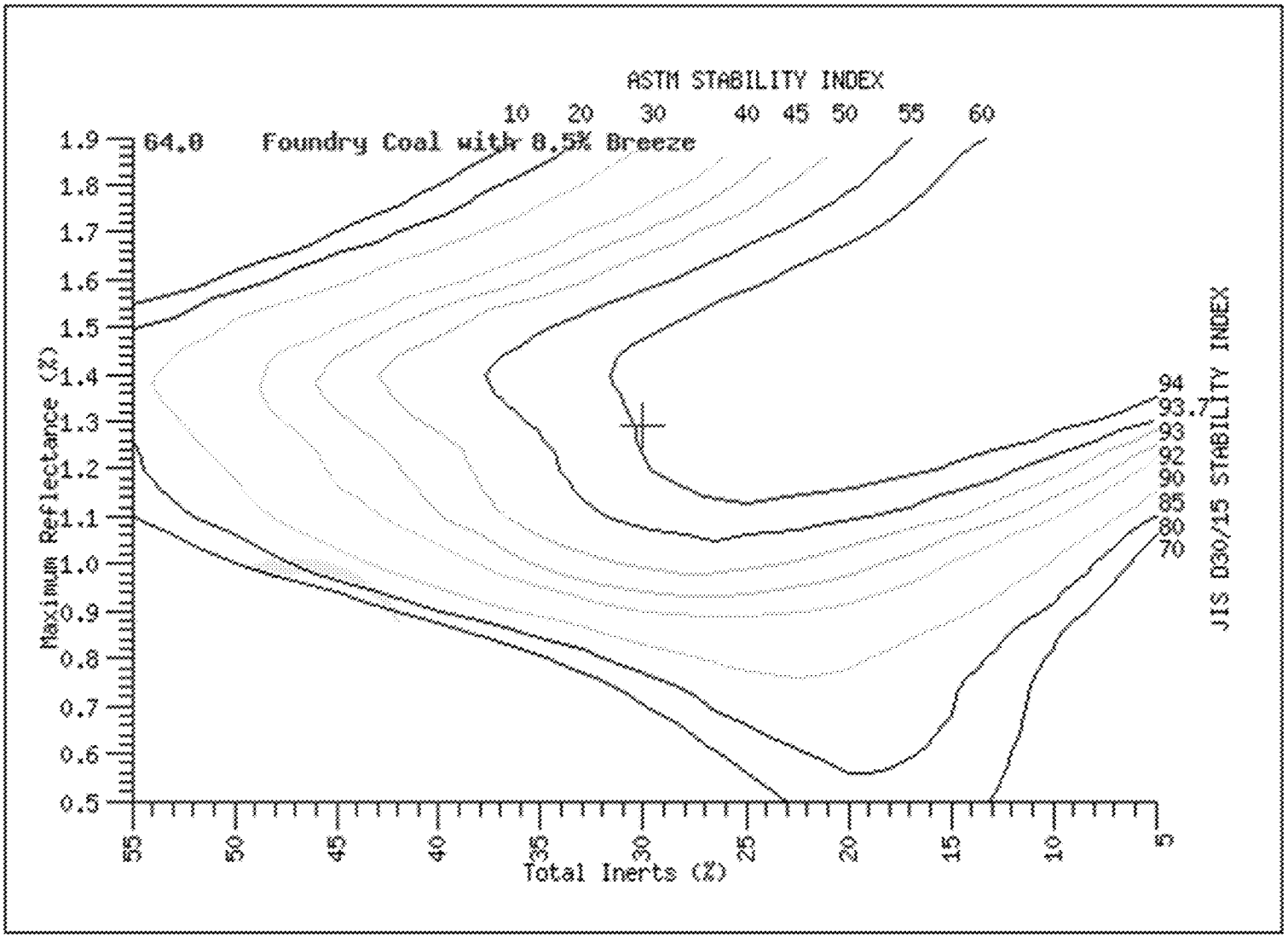
FIG. 18 shows an exemplary predicted coke strength based on a coal blend with 8.5% breeze, in accordance with embodiments of the present technology.
Figure 19:
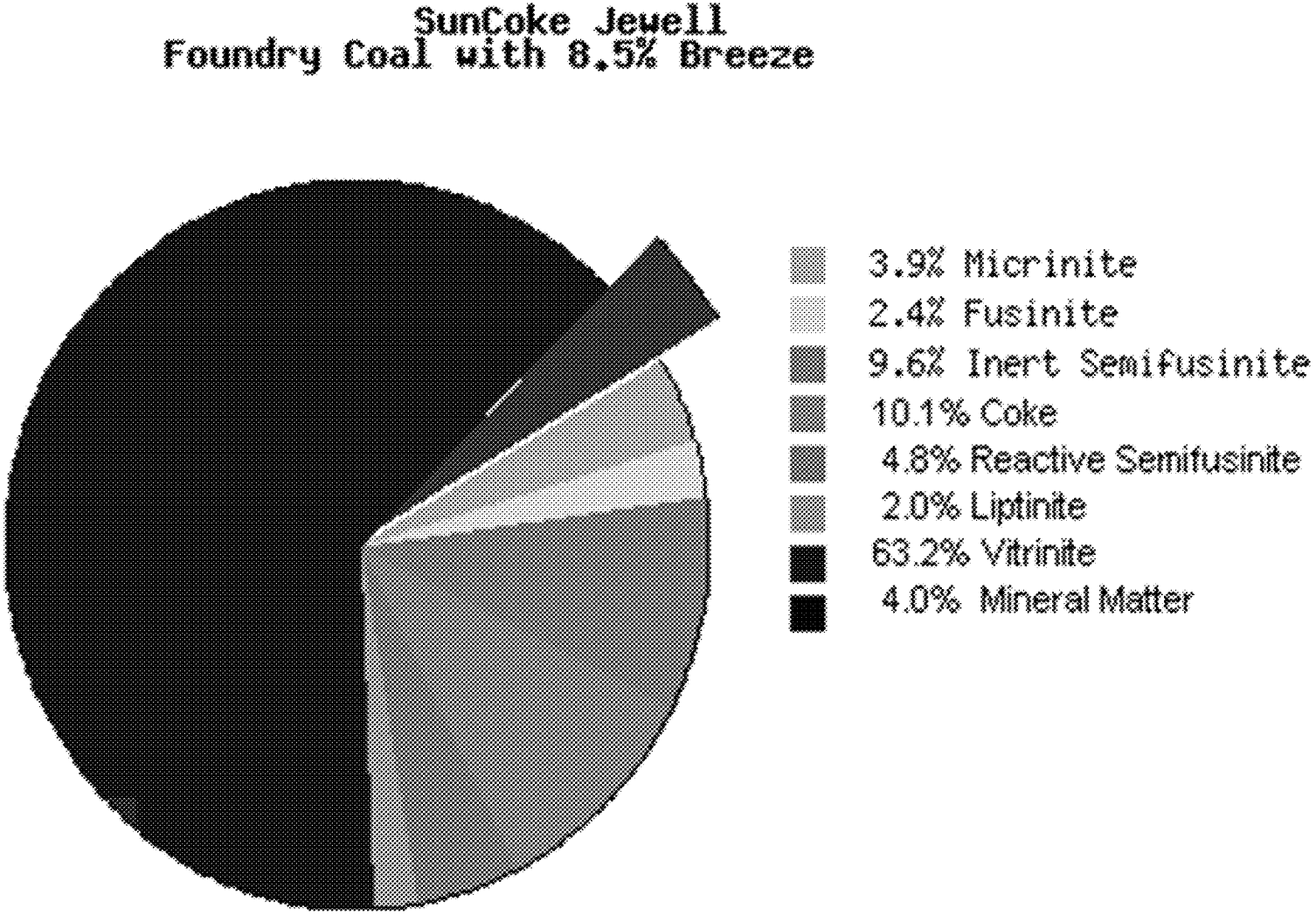
FIG. 19 shows an exemplary maceral distribution of reactive components and inert materials in a coal blend with 8.5% breeze, in accordance with embodiments of the present technology.
Figure 20A:
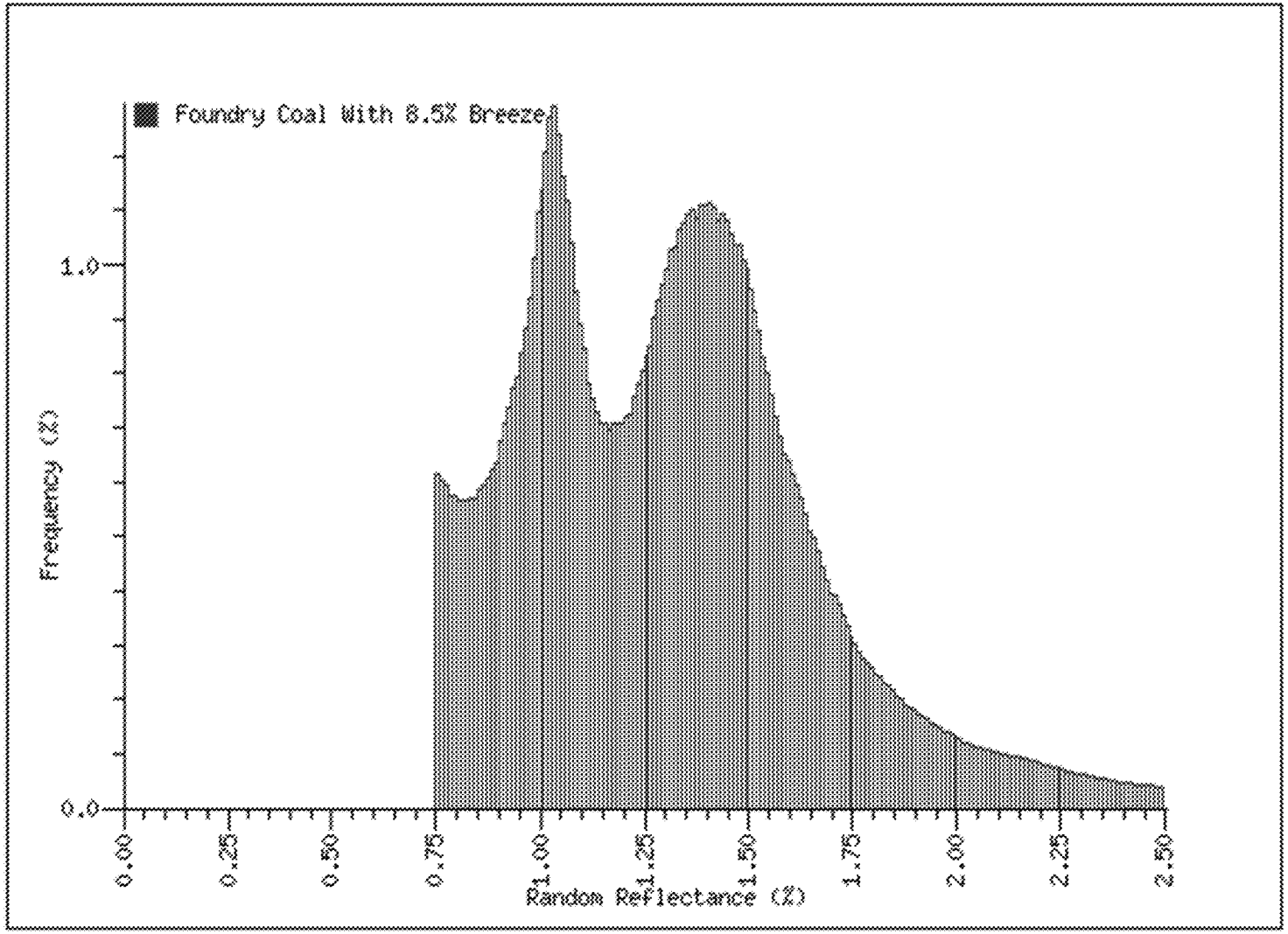
FIG. 20A shows a reflectance profile of the coal blend with 8.5% breeze
Figure 20B:
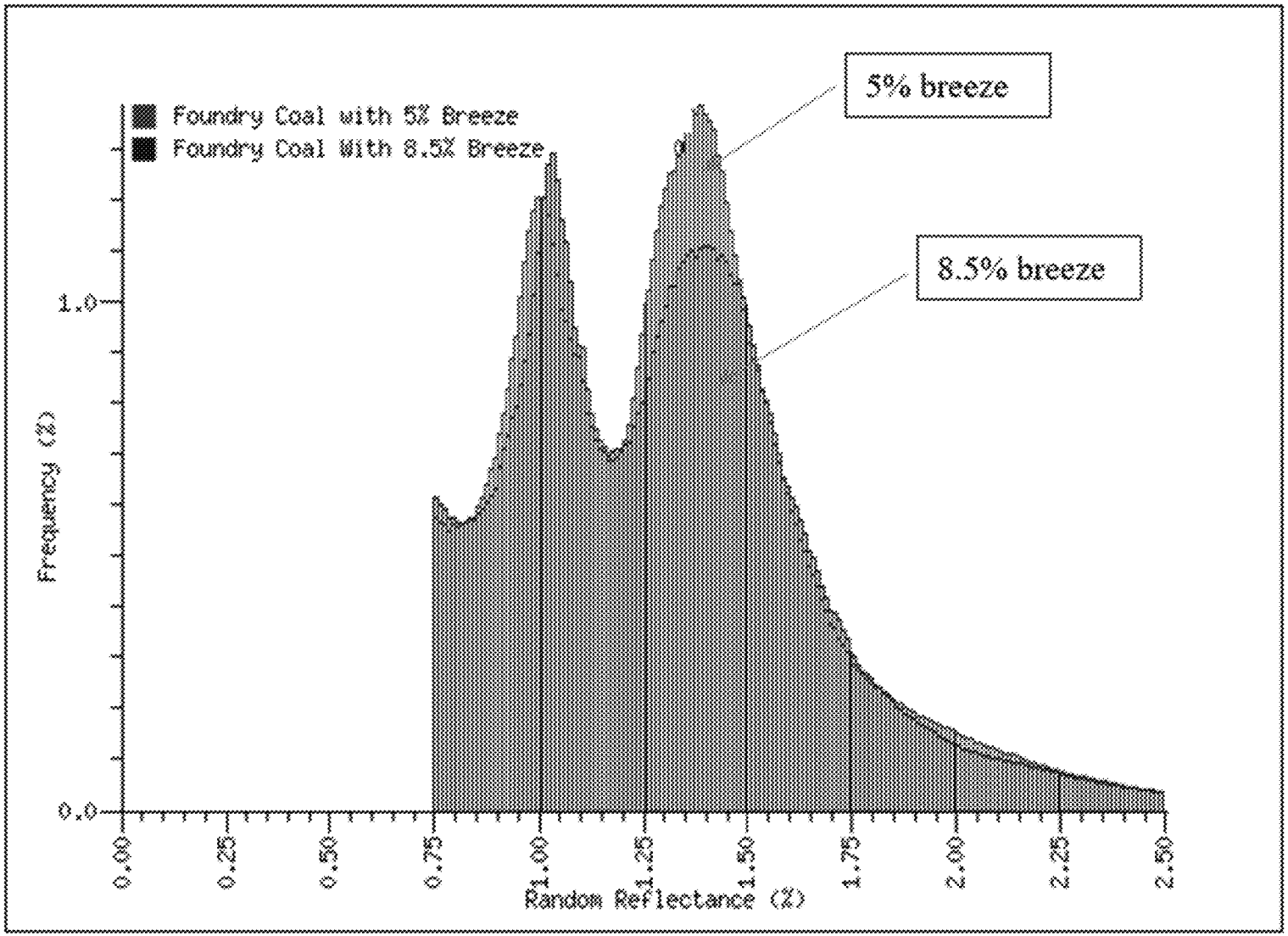
FIG. 20B shows the comparison of the reflectance profiles of a coal blend with 8.5% breeze and a coal blend with 5% breeze.

In certain embodiments, a lower SF temperature is maintained throughout the cycle. In blast ovens, the target is to get the SF hot in the beginning of the cycle, usually around 2300° F.-2600° F., depending on the oven condition and charge weight and try to maintain as long as possible. The SF temperature will gradually drop throughout the cycle to around 1900° F.-2100° F. This is managed by partially or entirely opening the SF damper immediately after charge, then slowly closing it throughout the first half of the cycle. Usually the SF dampers are fully closed within the first 24 hours after charge. Once the SF damper is closed down, it is not opened again until the next charge. Half way through the cycle, the adjacent oven is charged, which leads to an increase in the SF temperatures, but the SF dampers remain closed. A representative trend is shown in the Figures. In a foundry oven, the goal is to keep the SF temp around the 1600-2300° F. range and more preferably around 1850° F. for the whole cycle. Since the door holes remain closed throughout the cycle, the SF dampers are used to control the SF temperature. For example, when the adjacent ovens are charged around 24 and 48 hours into the cycle on a 72-hour cycle, the SF dampers are typically opened up again to help prevent the SF temperatures from increasing too much. FIG. 16 shows the temperature trends and the SF adjustments. The first 12 hours are similar to a typical blast oven, but the remaining hours vary drastically from blast ovens, as re-opening a SF damper after it is closed does not occur on blast ovens.

In certain embodiments, sole flue walls can be modified to partially or entirely redirect or short circuit the flow. In certain embodiments, pipes can be inserted into sole flues to move air towards the center of bed an away from end walls. For example, ceramic pipe(s) can be inserted in through sole flue damper, front end sticks can be positioned in about 5-10 feet, e.g., halfway to middle, back end sticks can be positioned out of flue hole a couple of", not necessary to be air tight around edge, and long flue application. The ovens can include long sole flues that extend beneath and along a length of the oven chamber or split flues. The split flues can have a slower rate in the middle of the bed because of the layout. Larger coke is obtained in the middle of the oven that cokes out last (the longest coking time).

Figure 14:
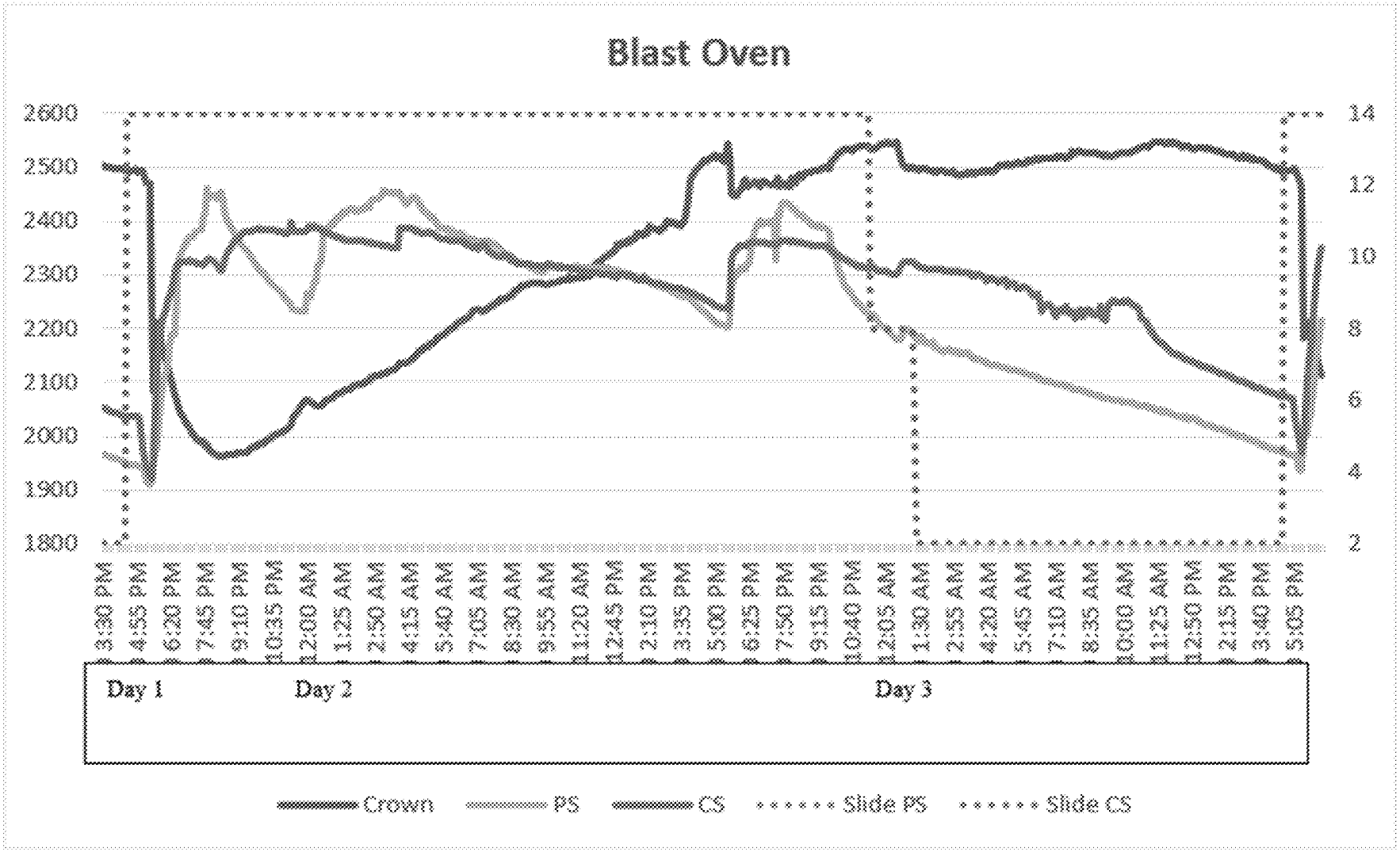
FIG. 14 shows the temperature trend for a blast oven, in accordance with embodiments of the present technology.
Figure 15:
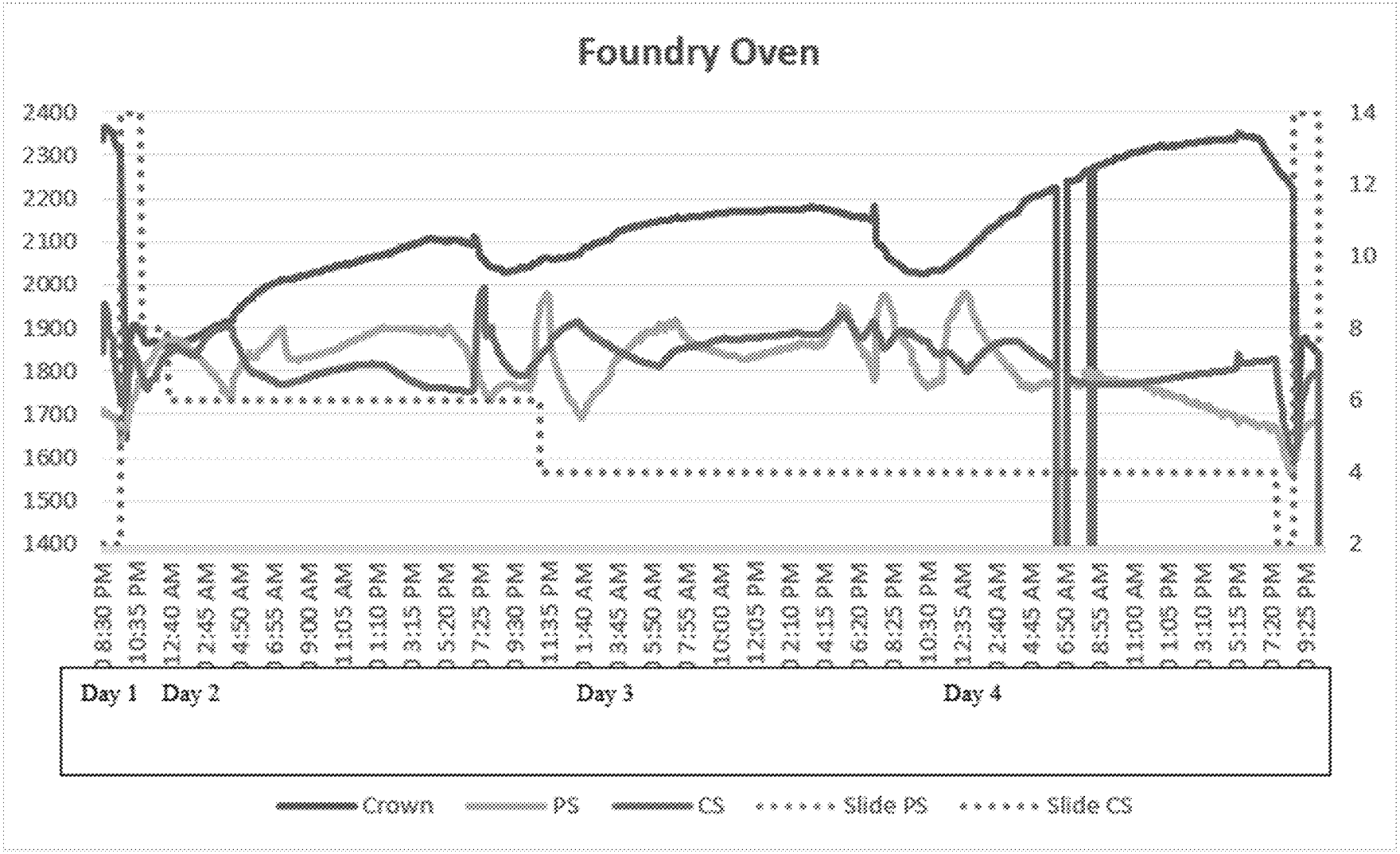
FIG. 15 shows the temperature trend for a foundry oven, in accordance with embodiments of the present technology.

In certain embodiments, the crown temperature is suppressed throughout the cycle. The goal for foundry ovens is to maintain the crown temp approximately 150° F. above the SF temperature. Typically the crown temperature will start off lower, then gradually increase throughout the cycle and peak on the last day of the cycle. The trend is similar for blast ovens, but the crown temperature is significantly higher for blast ovens. See representative trends for blast and foundry in FIGS. 14 and 15, respectively. Blast oven crown temperature usually dips to around 1900° F.-2000° F. during charge and slowly increases throughout the cycle, peaking at around 2400° F.-2600° F. on the last day of the cycle (almost always 48-hour cycle for blast). On blast ovens, one tool to control crown temperature is the use of the door holes, which are sometimes opened when the adjacent oven is charged in order to provide a boost in the crown temperature. In foundry ovens, the door holes are kept closed for the whole cycle in an effort to lower the crown temperature. Since the door holes are not enough to lower the crown temperature in foundry ovens, the uptakes are used very differently. The uptakes are initially opened fully, then closed drastically to the midway point approximately one hour into the cycle. They are then closed another couple "approximately two hours after the first adjustment and closed another couple" about twelve hours after that. This aggressive closure of the uptakes is different from the uptake usage on blast ovens, where the uptakes usually remain mostly open for the first half of the cycle and are then gradually reduced. FIGS. 14 and 15 show the difference in uptake positioning for blast oven and foundry oven, respectively.

In certain embodiments, the burning practice disclosed herein includes shimming uptakes. One of the issues with the uptakes is that over time, the 2" gap that should exist when an uptake is fully closed has eroded into a 4-6" gap, which can drastically impede the efforts to reduce draft to the oven. Shims can be added to some foundry ovens to get back to the 2" gap or even a 1" gap.

In certain embodiments, external gas sharing jumpovers with or without a control valve can be added. The position of the control valve can be determined on an oven by oven basis, similar to determining the positions of the SF and door holes. The use and position of the control valve can be adjusted based on which oven needs the gas more. For example, if one oven is getting too hot, the valve can be opened more to allow more gas into the adjacent oven. If the adjacent oven is also too hot, however, the valve can be closed and the oven runs with rich crown and SF to control the temperatures (for foundry only). If one oven is cooling off too fast and the adjacent oven is hotter, the valve can be opened more to allow more gas to flow. Currently on ovens with jumpovers or other similar means (e.g., gas sharing ports), charging an oven provides a boost of gas to the midcycle oven next to it, which may or may not be needed.

Additionally, having control valves can give the burners better control over the gas flow in a variety of different scenarios, such as normal operation, push delays, short charging, over charging, ovens with significant cracks into the other adjacent oven, ovens with significant air in leakage, oven repair, etc. In push delays, if oven 1 is delayed, the valve can be opened to allow more heat from oven 2, but then the valve is closed after charge to help conserve heat in oven 1 where it is needed most. In short charging, the valve can be closed or partially closed to help keep the gas in the oven if the jump over is towards the CS, or opened to allow additional gas in the adjacent oven if the jumpover is closer to the push side. This can help balance out SF temperatures, in addition to adjusting the SF, door holes and uptakes. With over charging, the valves can be opposite of the short charging. If there are significant cracks in between oven 2 and 3 for example, and oven 2 is charged, the valve between oven 1 and 2 and the valve between oven 3 and 4 can be closed to help preserve heat in those ovens. However, this may have an undesired effect of increasing the gas flow through the cracks and causing the cracks to erode faster. This, therefore, can be a short-term solution used only when it is really needed, for example, when combined with a long push delay. In ovens with significant air in leakage, the valve can be closed after charge to help build up heat and opened when the adjacent oven is charged to help give a boost mid-cycle. That assumes that the adjacent oven does not also have large air in leakage and does not need the mid-cycle boost. In cases of oven repair, the valve is closed between the adjacent oven and the empty oven, which can help improve safety.

In certain embodiments, for 48-hour cycles, every two ovens can have valves or ports between them, where the current jumpovers are, and this configuration provides sufficient control throughout the cycle. For 72-hour cycles, however, it is desirable to have jumpers with control valves on all the ovens. This will connect all the ovens, and therefore, the control valves are necessary to allow burners to control the gas. It allows an oven to pull from either oven next to it, depending on which one is being charged. This assumes that the push cycle will change to pushing 2 runs of every sixth oven (similar to MTO) or 1 run of every third oven so that one oven adjacent to a charged oven will be charged on the second day and the other adjacent oven would be charged on the third day. This helps control oven temperatures on the third day by either allowing gas into an oven if it is too cold or out of an oven if it is too hot. However, this configuration does not work on end ovens which only have one adjacent oven. The complexity of using the valves can increase significantly in this scenario, as burners are able to share gas with two or more ovens. This also opens up the possibility of gas traveling through a bank of ovens. After charge, there is a significant amount of gas can be released, but water can be used to slow down the release.

In certain embodiments, various types of valves may be used, for example, butterfly valves, and slide valves which may be used for automation. In certain embodiments, control point(s) can be placed between the buckstays on the push side either mechanically or pneumatically to allow more accurate control such that the burner can look into the ovens while adjusting the valve.

Yield

Yield is shown as a function of breeze loading percentage, breeze grind coal chemistry (VM, reactives/inerts, vitrinite distribution, rheology), operating parameters (charge tons, density, cycle time, screening, soak time) interaction terms between the above.

From the foregoing it will be appreciated that, although specific embodiments of the technology have been described herein for purposes of illustration, various modifications may be made without deviating from the spirit and scope of the technology. Further, certain aspects of the new technology described in the context of particular embodiments may be combined or eliminated in other embodiments. Moreover, while advantages associated with certain embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein. Thus, the disclosure is not limited except as by the appended claims.

CONCLUSION

It will be apparent to those having skill in the art that changes may be made to the details of the above-described embodiments without departing from the underlying principles of the present disclosure. In some cases, well known structures and functions have not been shown or described in detail to avoid unnecessarily obscuring the description of the embodiments of the present technology. Although steps of methods may be presented herein in a particular order, alternative embodiments may perform the steps in a different order. Similarly, certain aspects of the present technology disclosed in the context of particular embodiments can be combined or eliminated in other embodiments. Furthermore, while advantages associated with certain embodiments of the present technology may have been disclosed in the context of those embodiments, other embodiments can also exhibit such advantages, and not all embodiments need necessarily exhibit such advantages or other advantages disclosed herein to fall within the scope of the technology. Accordingly, the disclosure and associated technology can encompass other embodiments not expressly shown or described herein, and the invention is not limited except as by the appended claims.

Throughout this disclosure, the singular terms "a," "an," and "the" include plural referents unless the context clearly indicates otherwise. Additionally, the term "comprising," "including," and "having" should be interpreted to mean including at least the recited feature(s) such that any greater number of the same feature and/or additional types of other features are not precluded.

Reference herein to "one embodiment," "an embodiment," "some embodiments" or similar formulations means that a particular feature, structure, operation, or characteristic described in connection with the embodiment can be included in at least one embodiment of the present technology. Thus, the appearances of such phrases or formulations herein are not necessarily all referring to the same embodiment. Furthermore, various particular features, structures, operations, or characteristics may be combined in any suitable manner in one or more embodiments.

Unless otherwise indicated, all numbers expressing weight percentages, concentrations, compositions, and other numerical values used in the specification and claims, are to be understood as being modified in all instances by the term "approximately." Accordingly, unless indicated to the contrary, the numerical parameters set forth in the following specification and attached claims are approximations that may vary depending upon the desired properties sought to be obtained by the present technology. At the very least, and not as an attempt to limit the application of the doctrine of equivalents to the scope of the claims, each numerical parameter should at least be construed in light of the number of reported significant digits and by applying ordinary rounding techniques. Additionally, all ranges disclosed herein are to be understood to encompass any and all subranges subsumed therein. For example, a range of "1 to 10" includes any and all subranges between (and including) the minimum value of 1 and the maximum value of 10, i.e., any and all subranges having a minimum value of equal to or greater than 1 and a maximum value of equal to or less than 10, e.g., 5.5 to 10.

The disclosure set forth above is not to be interpreted as reflecting an intention that any claim requires more features than those expressly recited in that claim. Rather, as the following claims reflect, inventive aspects lie in a combination of fewer than all features of any single foregoing disclosed embodiment. Thus, the claims following this Detailed Description are hereby expressly incorporated into this Detailed Description, with each claim standing on its own as a separate embodiment. This disclosure includes all permutations of the independent claims with their dependent claims.

The present technology is illustrated, for example, according to various aspects described below as numbered clauses (1, 2, 3, etc.) for convenience. These are provided as examples and do not limit the present technology. It is noted that any of the dependent clauses may be combined in any combination, and placed into a respective independent clause.

1. A coke having an oblong shape, wherein the length: width ratio of the coke is at least 1.1, at least 1.5, at least 2.0, at least 2.5, at least 3.0, at least 3.5, at least 4.0, at least 4.5, at least 5.0, at least 5.5, at least 6.0, at least 6.5, at least 7.0, at least 7.5, at least 8.0, at least 8.5, at least 9.0, at least 9.5, or at least 10.0.

2. The coke of any one of the clauses herein, wherein the length is between 2" and 18", between 3" and 15", between 4" and 12", or between 4" and 10" and the width is between 1.5" and 5", between 3" and 5", or between 2" and 4".

3. The coke of any one of the clauses herein, wherein the length is at least 2", at least 3", at least 4", at least 5", at least 6", at least 7", at least 8", at least 9", at least 10", at least 11", at least 12", at least 13", at least 14", at least 15" at least 16", at least 17", or at least 18".

4. The coke of any one of the clauses herein, wherein the width is at least 1.5", at least 2", at least 3", at least 4", or at least 5".

5. A population of coke products produced by a horizontal oven, wherein at least 40%, at least 45%, at least 50%, at least 55%, at least 60%, at least 65%, at least 70%, at least 75%, at least 80%, at least 85%, at least 90%, at least 95%, at least 98%, or at least 99% of the population has an oblong shape, wherein the length:width ratio of the coke is at least 1.1, at least 1.5, at least 2.0, at least 2.5, at least 3.0, at least 3.5, at least 4.0, at least 4.5, at least 5.0, at least 5.5, at least 6.0, at least 6.5, at least 7.0, at least 7.5, at least 8.0, at least 8.5, at least 9.0, at least 9.5, or at least 10.0.

6. A population of coke products produced by a horizontal oven, wherein at least 40%, at least 45%, at least 50%, at least 55%, at least 60%, at least 65%, at least 70%, at least 75%, at least 80%, at least 85%, at least 90%, at least 95%, at least 98%, or at least 99% of the population has an oblong shape, wherein the length is between 2" and 18", between 3" and 15", between 4" and 12", or between 4" and 10" and the width is between 1.5" and 5", between 3" and 5", or between 2" and 4".

7. A coke having a hydraulic diameter (Dh) greater than the actual diameter of the coke, wherein the coke has a Coke Reactivity Index (CRI) between 20% and 45% and a Coke Strength after Reaction (CSR) between 5% and 60%.

8. The coke of any one of the clauses herein, wherein the Dh is at least 2", at least 2.5", at least 3", or at least 3.5".

9. The coke of any one of the clauses herein, wherein the CRI is less than 40%, or between 31% and 37%.

10. The coke of any one of the clauses herein, wherein the CSR is between 5% and 50%, or between 15% and 40%.

11. The coke of any one of the clauses herein, wherein the CRI is between 31% and 37%, and the CSR is between 15% and 50%.

12. The coke of any one of the clauses herein, wherein the coke has a 4" drop shatter of at least 60%, at least 65%, at least 70%, at least 75%, at least 80%, at least 85%, or at least 90% when using coke having a size of at least 4" as the starting material.

13. The coke of any one of the clauses herein, wherein the coke has a 2" drop shatter of at least 85%, at least 90%, or at least 95% when using coke having a size of at least 4" as the starting material.

14. The coke of any one of the clauses herein, wherein the coke has an ash content between 5% and 12%, less than 10%, less than 9.5%, less than 9%, less than 8.5%, less than 8%, less than 7.5%, or less than 7%, a sulfur content less than 1%, less than 0.9%, less than 0.8%, less than 0.7%, less than 0.6%, or less than 0.5%, a volatile matter (VM) content less than 2%, less than 1%, or between 0.4% and 1%, a moisture content less than 15%, less than 10%, less than 9%, less than 8%, less than 7%, less than 6%, less than 5%, less than 4%, less than 3%, less than 2%, less than 1%, or between 1% and 10%, or a fixed carbon content at least 80%, at least 85%, at least 90%, or at least 95%.

15. The coke of any one of the clauses herein, wherein the coke has a gray or light gray color.

16. The coke of any one of the clauses herein, wherein the coke is made in a horizontal oven.

17. The coke of any one of the clauses herein, wherein the coke is made from a coal blend comprising one or more types of coal and coke breeze, wherein the breeze is between 5% and 15% weight of the coal blend.

18. The coke of clause 17, wherein the coal blend has volatile matter (VM) between 15%-40%, between 23%-33%, or between 20% and 24%.

19. The coke of any one of clauses 17 or 18, wherein the coal blend comprises reactive components comprising vitrinite, liptinite, and reactive semifusinite, and inert materials comprising coke (including breeze), inert semifusinite, fusinite, macrinite, and mineral matter, wherein the inert materials are between 20% and 40% or between 30% and 35%. 20. The coke of any one of the clauses herein, wherein the vitrinite comprises one or more of V9, V10, V11, V12, V13, V14, V15, V16, V17, V18, and V19.

21. The coke of any one of the clauses herein, wherein the vitrinite comprises V15, V16, and V17, the combination of which makes up at least 30% of the petrography of the blend.

22. The coke of any one of the clauses herein, wherein the coal blend has a fluidity of at least 200 ddpm, between 100 ddpm and 2000 ddpm, or between 200 ddpm and 1200 ddpm.

23. A method of making a coke comprising:

preparing a coal blend comprising one or more types of coal and coke breeze, wherein the coke breeze is between 5% and 15% weight of the coal blend; and burning the coal blend in a horizontal oven to obtain the high quality foundry coke.

24. The method of any one of the method clauses herein, wherein the coal blend has volatile matter (VM) between 15%-40%, between 23%-33%, or between 20% and 24%.

25. The method of any one of the method clauses herein, wherein the coal blend comprises reactive components comprising vitrinite, liptinite, and reactive semifusinite, and inert materials comprising coke (including breeze), inert semifusinite, fusinite, macrinite, and mineral matter, wherein the inert materials are between 20% and 40% or between 30% and 35%.

26. The method of clause 25, wherein the vitrinite comprises one or more of V9, V10, V11, V12, V13, V14, V15, V16, V17, V18, and V19.

27. The method of clause 25, wherein the vitrinite comprises V15, V16, and V17, the combination of which makes up at least 30% of the petrography of the blend.

28. The method of any one of the method clauses herein, wherein the coal blend has a fluidity of at least 200 ddpm, between 100 ddpm and 2000 ddpm, or between 200 ddpm and 1200 ddpm.

29. The method of any one of the method clauses herein, wherein the horizontal oven includes a heat recovery oven, a non-recovery oven, and a Thompson oven.

30. A coke product configured to be combusted in a cupola furnace, the coke product comprising:

an oblong shape including a length of at least 4" and a width of at least 1.5", wherein the length:width ratio of the coke product is at least 2.0.

31. The coke product of any one of the clauses herein, wherein the length is between 6-12".

32. The coke product of any one of the clauses herein, wherein the width is at least 2.5".

33. The coke product of any one of the clauses herein, wherein the length is at least 10" and the width is at least 2.5".

34. The coke product of any one of the clauses herein, wherein the coke product has a diameter of at least 3".

35. The coke product of any one of the clauses herein, wherein the coke product has a Coke Reactivity Index (CRI) of at least 40%.

36. The coke product of any one of the clauses herein, wherein the coke product has a Coke Reactivity Index (CRI) of at least 40% and a Coke Strength after Reaction (CSR) of at least 10%.

37. The coke product of any one of the clauses herein, wherein the coke product has a Coke Reactivity Index (CRI) between 25-45% and a Coke Strength after Reaction (CSR) of at least 10%.

38. The coke product of any one of the clauses herein, wherein the coke product has a 4" drop shatter of at least 90%.

39. The coke product of any one of the clauses herein, wherein the coke product has a 2" drop shatter of at least 85%.

40. A population of coke products produced by a horizontal coke oven, the population of coke products comprising:

foundry coke products including— an oblong shape, a length of at least 3", a width of at least 1.5", a length:width ratio of least 2.5; and a diameter of at least 3.5"

egg coke products having a diameter of 1.5-3.5"; and breeze coke products having a diameter of 0.5-1.5".

41. The population of coke products of any one of the clauses herein, wherein:

the foundry coke products comprise at least 60% of the population of coke products;

the egg coke products and the breeze coke products comprise at least 20% of the population of coke products.

42. The population of coke products of any one of the clauses herein, wherein the foundry coke products comprise an ash content of between 5-12% and a volatile matter content less than 2%.

43. The population of coke products any one of the clauses herein, wherein the foundry coke products comprise a moisture content of at least 5%.

44. The population of coke products of any one of the clauses herein, wherein the coke product has a Coke Reactivity Index (CRI) of at least 40% and a Coke Strength after Reaction (CSR) of at least 10%.

45. The population of coke products of any one of the clauses herein, wherein the coke product has a 4" drop shatter of at least 90%.

46. A method of making coke products configured to be combusted in a cupola furnace, the method comprising:

preparing a coal blend comprising coal, and breeze coke products having a diameter of at least 0.5-1.5", wherein the breeze coke products comprise 5-15% of the coal blend; and combusting the coal blend in a horizontal oven to produce foundry coke products, the foundry coke products comprising an oblong shape including a length of at least 4", a width of at least 1.5", and a length:width ratio of at least 2.0.

47. The method of any one of the clauses herein, wherein the coal blend has volatile matter (VM) between 15-40% and a fluidity of at least 200 dial division per minute (ddpm).

48. The method of any one of the clauses herein, wherein the foundry coke products further comprise:

egg coke products having a diameter of at least 1.5-3.5"; and breeze coke products having a diameter of at least 0.5-1.5".

49. The method of any one of the clauses herein, wherein the foundry coke products comprise at least 60% of the population of coke products, and the egg coke products and the breeze coke products together comprise at least 20% of the population of coke products.

We claim:

1. A method of making coke products configured to be combusted in a cupola furnace, the method comprising:

preparing a coal blend comprising coal, and breeze coke products, wherein the breeze coke products comprise at least 5% of the coal blend and have a diameter of no more than 0.5"; and combusting the coal blend in a horizontal oven to produce a population of coke products, wherein the population of coke products includes foundry coke products comprising an oblong shape including a length of at least 4", a width of at least 1.5", and a length: width ratio of at least 2.0.

2. The method of claim 1, wherein the coal blend has volatile matter (VM) between 15-40% and a fluidity of at least 200 dial division per minute (ddpm).

3. The method of claim 1, wherein the population of coke products further comprises:

egg coke products having a hydraulic diameter of at least 1.5-3.5"; and breeze coke products having a hydraulic diameter of at least 0.5-1.5".

4. The method of claim 3, wherein the foundry coke products comprise at least 60% of the population of coke products, and the egg coke products and the breeze coke products together comprise at least 20% of the population of coke products.

5. The method of claim 1, wherein the foundry coke products comprise an ash content of between 5-12%.

6. The method of claim 1, wherein the foundry coke products comprise a volatile matter content less than 2%.

7. The method of claim 1, wherein the foundry coke products comprise a moisture content of at least 2%.

8. The method of claim 1, wherein the foundry coke products have a Coke Reactivity Index (CRI) of at least 40%.

9. The method of claim 1, wherein the foundry coke products have a Coke Strength after Reaction (CSR) of at least 10%.

10. The method of claim 1, wherein the foundry coke products have a 4" drop shatter of at least 90%.

11. The method of claim 1, wherein the breeze coke products comprise between 5-15% of the coal blend.

12. The method of claim 1, wherein the breeze coke products comprise at least 15% of the coal blend.

* * * * *